US006806811B1

(12) United States Patent
Readler

(10) Patent No.: US 6,806,811 B1
(45) Date of Patent: Oct. 19, 2004

(54) INFRA-RED PERIMETER ALARM

(76) Inventor: Blaine C. Readler, 11320 Florindo Rd., San Diego, CA (US) 92127

( * ) Notice: Subject to any disclaimer, the term of this patent is extended or adjusted under 35 U.S.C. 154(b) by 0 days.

(21) Appl. No.: 10/234,512

(22) Filed: Sep. 4, 2002

Related U.S. Application Data

(63) Continuation-in-part of application No. 10/109,243, filed on Mar. 27, 2002, now abandoned.

(51) Int. Cl.[7] ..... G08B 13/00; G08B 13/18; G06M 7/00

(52) U.S. Cl. ..... 340/541; 340/552; 340/555; 340/556; 340/557; 340/564; 250/221

(58) Field of Search ..... 340/541, 555–557, 340/564, 552; 250/221

(56) References Cited

U.S. PATENT DOCUMENTS

| | | | | | |
|---|---|---|---|---|---|
| 3,623,057 | A | * | 11/1971 | Hedin et al. | 340/557 |
| 3,688,298 | A | * | 8/1972 | Miller et al. | 340/557 |
| 3,711,846 | A | * | 1/1973 | Schlisser et al. | 340/557 |
| 3,733,602 | A | * | 5/1973 | Cuckler et al. | 342/27 |
| 3,825,916 | A | * | 7/1974 | Steele et al. | 340/557 |
| 4,949,075 | A | * | 8/1990 | Kurti et al. | 340/555 |
| 5,195,060 | A | * | 3/1993 | Roll | 367/118 |
| 5,198,799 | A | * | 3/1993 | Pascale | 340/552 |
| 5,760,686 | A | * | 6/1998 | Toman | 340/540 |
| 6,130,615 | A | * | 10/2000 | Poteet | 340/573.6 |

* cited by examiner

*Primary Examiner*—Daniel J. Wu
*Assistant Examiner*—Lam Pham

(57) ABSTRACT

A very reliable alarm system is comprised of transceiver node devices interconnected via infrared links forming a secure perimeter, whereby each transceiver node in the perimeter receives an infrared transmission from a previous transceiver node, and itself transmits an infrared signal to the next transceiver node in the perimeter. If a break of an infrared link occurs, such as would happen if an intruder enters the perimeter area, an indication of the break is communicated around to a base unit device either by each subsequent node device inhibiting its infrared transmission, or changing its transmission to that of a special alarm signal. Upon receiving an indication of a perimeter break the base unit device alerts alarm signaling devices such as audible or visual alarm indicators. Each transceiver node device is able to determine its position in the perimeter and, in one embodiment of the invention, the position information of the node device following an infrared link break is communicated around to the base unit device for presentation. During normal, non-breached operation, each transceiver node device can use its known perimeter location to generate a unique infrared transmission so that a receiving unit is able to distinguish the previous unit's transmission from others in the perimeter. As an aid to initial setup, the transceiver node devices can be placed into a calibration mode in which the user is provided visual indication as to the alignment of the transmitted infrared beam from one transceiver node with the infrared receiver of another node. In a different arrangement, by initiating the linked infra-red transmissions from source nodes separate from the base unit, and including multiple infra-red receivers on some link nodes, non-enclosed boundaries can be protected from breaches.

8 Claims, 30 Drawing Sheets

| # Link Nodes | # clocks | LCs/second @ 10kHz |
|---|---|---|
| 1 | 240 | 41.7 |
| 2 | 420 | 23.8 |
| 3 | 650 | 15.4 |
| 4 | 930 | 10.8 |
| 5 | 1260 | 7.9 |
| 6 | 1640 | 6.1 |

Sync State Machine

Run State Machine

| LINK_NUM | # Link Nodes | # clocks per LC |
|---|---|---|
| 2 | 1 | 240 |
| 3 | 2 | 420 |
| 4 | 3 | 650 |
| 5 | 4 | 930 |
| 6 | 5 | 1,260 |
| 7 | 6 | 1,640 |

INFRA-RED PERIMETER ALARM

This is a Continuation In Part of application Ser. No. 10/109,243, Filed Mar. 27, 2002, now abandoned.

CROSS-REFERENCE TO RELATED APPLICATIONS

Not Applicable.

SEQUENCE LISTING

Not Applicable

BACKGROUND

1. Field of Invention

This invention relates to alarm systems, and more particularly to a perimeter monitoring system which uses infrared links to create a boundary through which intrusion is detected.

Still more particularly, the infrared links of the perimeter monitoring system may optionally be synchronized so that the infrared transmitter for one link will not falsely be received by the receiver of another link and, optionally, breach information can be transmitted to a base location.

2. Description of Prior Art

Personal and property security has long been a concern and continues to be as evidenced by increased utilization of automobile and house alarms systems. The most prevalent type of alarm is that of intrusion detection, where incursion into some defined area is sensed and indicated with either an overt broadcast alarm, or a covert alert, e.g., an automatic telephone call to the police. A example of this is a simple automobile alarm which is triggered by the opening of doors (the existing door button that activates the internal dome light is often used). In this case access to the protected area, the internal space of the car, is generally made at specific locations, i.e., the car doors, and only these are sensed. (Of course, more sophisticated car alarms may include motion sensors so that window entry is also detected). Another example of existing intrusion detection systems are the many house alarm systems available. Here the detection methods can be separated into two general categories: 1) internal presence detection, and 2) perimeter violation. Examples of the former are proximity motion and heat sensors. In the latter case, as in the car alarm, advantage is taken of the fact that entry is generally made via specific locations, e.g., windows and doors, and sensors are thus placed at those points. Internal presence detection via proximity detectors can be very effective but have two drawbacks: they can be tripped unwontedly by pets, and by their very nature only alarm after premises entry has already been made. A perimeter security system consisting of a series of door and window sensors, on the other hand, although often times more difficult to install, can provide secure protection along with free internal movement. Of course, many home protection systems include both categories for optimum security.

Another example of perimeter violation protection, and one that encompasses a larger area, is estate property that is bordered by an entry-resistant wall. Here, again like the car alarm and the house perimeter sensors, entry is limited to specific locations, in this case the driveway, and an intrusion sensor is placed only there. Unlike the perimeter sensors used in a house system that need only detect, for example, that a window or door contact has been broken, however, the sensor method used here must detect an intrusion through a span of open area, e.g., the driveway opening in the wall. A point-to-point infrared transmitter/receiver pair can serve this purpose and U.S. Pat. No. 3,370,285 describes one such system. Here, an infrared beam is established between a transmitter and receiver placed at either end of the span to be protected. Cessation of the beam reception by the receiver caused by, for example, an intruder constitutes an area violation.

The Tandy Corp., via their Radio Shack line of stores, offers a similar system, however here the transmitter and receiver are contained in a single unit which could be placed at one side of the protected span, while an infrared reflector is placed at the other end, so that the beam travels twice across the span before being detected by the receiver. The operational effect is the same as U.S. Pat. No. 3,370,285, however, the Tandy system has the advantage in that all of the electronics, and thus the powering requirements, are contained in a single unit.

Another point-to-point light beam alarm application is described in U.S. Pat. No. 4,998,093. Here a light beam emitter and separate photoelectric detector are used to protect road workers by detecting when errant vehicles have crossed into the road work area. When the light beam is broken circuitry associated with the photoelectric detector transmits radio frequency warnings to radio receivers worn by each worker in order to communicate a potential danger alert.

A more difficult alarm protection situation occurs when an open area needs to be secured. In the estate example above, for example, if no effective deterrent wall exists, then the single point-to-point detection scheme is inadequate since instead of a short open span to protect, now an entire perimeter must be secured. Other examples of open areas that would be desirable to protect would be for campers in remote areas, or small children in play areas (here the need would be to contain the children within the area, rather than alarm against intrusion from without). A common approach is to use a series of proximity sensors to create a detectable perimeter. U.S. Pat. No. 6,118,375, for example, describes a portable proximity sensing apparatus that could be used as a component in such a system. Here multiple of these devices are placed so as to create a perimeter around the protected area whereby each can sense motion within a circle in its proximity, and the devices are placed so that the series of resulting protected circles overlap and create a complete secure perimeter. Motion above some threshold causes the detecting device to generate a warning by audible alarm, flashing lights, or a combination of the two. The great disadvantages of this type of system are three-fold: firstly, in open areas outdoors proximity sensors are easily susceptible to false triggering due to wild or tame animals, or due to wind causing movement of buses and tree branches; secondly, the very nature of proximity sensing reduces the perimeter usable area since the zone of detection is defined by the inner limit of each detectors range (and additionally disadvantageous since it is difficult for the users to know precisely where this boundary is); and thirdly, the alarm method—audible or visual warnings—would serve to warn an intruder as effectively as the user.

More precisely defined perimeter protection methods have been proposed using wires. U.S. Pat. No. 4,091,367 describes the use of parallel-placed leaky coaxial cables to detect movement of human-sized objects past them via perturbations of RF signals continuously propagated around the cables. Alarming is provided at a base location where RF transmission and reception occur, and can take various forms, including methods that would be undetected by an intruder. Although this scheme solves the proximity detection problems of an ill-defined perimeter and warnings made to the intruder as well as to the user, since it is based on threshold detection of RF energies it remains to some degree susceptible to either false triggering on one hand, or undetected intrusions at the other. Additionally, this scheme could be cumbersome to deploy in remote, temporary situations, such as a camp area.

Another method of precisely defining a secure perimeter involves using a series of point-to-point light beam span protections. U.S. Pat. No. 4,978,942 describes one such system using infrared transmitters and receivers that are enclosed in containers camouflaged to appear as ordinary industrial storage drums. The patent disclosure describes that these units could be placed in series, presumably such that the transmitter of each is associated with the receiver of the next device in the perimeter. Warnings of intrusion are sent via radio frequencies to some base location for alarming. Although this scheme also solves both the problems of the ill-defined perimeter and warnings made to the intruder, it includes the undesirable complexity of radio links which themselves can be prone to unreliability due to natural and manmade interference.

Finally, U.S. Pat. No. 4,998,093 mentioned earlier describes the use of a reflector to create angles in the line of protection. One could imagine a series of reflectors placed in a circle such that the transmitted light beam is carried around a perimeter back to a receiver placed next to the transmitter, however, due to the unavoidable dispersion of light energy the light beam would be either spread or attenuated greatly with each reflector so that such a scheme would be impractical with more than one or two reflectors. A laser source could solve this problem but adds its own level of complexity, and in any case, acquiring precise alignment of multiple mirrors is a relatively difficult task not suited to temporary applications.

What is needed is a method to protect an area which defines a precise breach boundary and which is simple, reliable and inexpensive, and which is not detectable by an intruder.

SUMMARY OF THE INVENTION

Therefore, in accordance with the present invention a method for detecting intrusion into, or exit from, an established continuous perimeter or boundary uses infrared energy to create linking beams between multiple transceiver node devices placed at intervals around the perimeter or along the boundary. For perimeter applications each transceiver node device along the perimeter receives from a neighbor transceiver node device in one direction and transmits to another transceiver node device in the other direction forming a circle of infrared-linked transceiver node devices. One of the transceiver node devices serves as a base unit device to provide indication of perimeter violation, e.g., via an audible alarm or visible light indication. If any infrared beam link is obstructed, as would occur, for example, when an intruder enters the perimeter area, the receiving transceiver node device upon detecting a loss of infrared energy acts to suppress its infrared transmission. Since each transceiver node device operates in the same way, each subsequent transceiver node device around the perimeter will, in turn, detect a loss of its infrared input and consequently suppress its transmission until finally the base unit device detects that its infrared input has been lost in which case it indicates an alarm. In this way a breach anywhere around the perimeter is communicated to the base unit device.

Additionally, the infrared energy comprising the inter-device links can include a signal in order to provide perimeter coordination and to communicate specific information to the base unit device. For example, the transceiver node devices forming a secure perimeter, might include signal patterns unique to each transceiver node device in the perimeter. Each transceiver node device's unique signal pattern is derived from its self-deduced position in the perimeter. By using signal patterns that are unique to each transceiver node device, a receiving transceiver node device is able to distinguish the previous transceiver node device's transmission from others in the perimeter, thus ensuring that perimeter intrusions are detected since otherwise a link break might go undetected if the receiving transceiver node device is still receiving the infra-red transmission from another unit. Also, rather than simply suppressing its infra-red transmission when a transceiver node device detects a perimeter breach via a loss of its infrared input, it could alternatively transmit a unique alarm indication that includes its identity. In this alternative embodiment each subsequent transceiver node device in the perimeter relays this signal so that ultimately the base unit device not only is informed that a perimeter breach has occurred, but is also informed at which infrared link the breach occurred, i.e., the link immediately previous to the transceiver node device associated with the identity included in the alarm signal ultimately reaching the base unit device.

Alternatively, instead of linked nodes arranged in a closed circle, one node provides only the base unit transmission functions and serves as a source of infra-red transmissions. Linked nodes are then strung together as in the perimeter application ending with the base node which in this arrangement provides infra-red reception and alarm functions, but does not provide infra-red transmissions. In this way a non-enclosed boundary can be established and intrusions across the boundary can be detected.

Yet another arrangement uses more than one infra-red transmission source node, each feeding branches of a tree-structure that ends in a single alarm base unit. Nodes located at the tree's branch junctions contain multiple infra-red receivers and any received alarm indication, be it loss of infra-red reception or breach information, is passed on to the next node downstream towards the base unit. In this way complex boundary arrangements can be protected as might be used in a building structure with multiple rooms and hallways.

As an aid to initial setup, the linking node devices are placed into a special calibration mode in which the user is provided visual indication as to the alignment of the transmitted infrared beam from one node with the infrared receiver of another node.

Objects and Advantages

Accordingly, some objects and advantages of the present invention are:

a) to provide a method for securing an area such that entrance into, or exit from the area through a defined perimeter is detected, b) to provide a secure perimeter such that the detection method operates on the precise boundaries of the defined perimeter, c) to provide a secure perimeter using devices that are simple to use and low in cost to manufacture, d) to provide a secure perimeter that does not rely on radio frequency transmissions which could be detected by a potential intruder who would thus be warned to attempt alarm circumvention, e) to provide a secure perimeter that uses devices that receive infrared energy from one direction and transmit infrared energy in a different direction so that such devices can be linked transmit-to-receive in a continuous loop, thus creating the perimeter to be secured, f) to provide a secure perimeter using the aforementioned linked infrared transceiver node devices that upon detecting that their receive infrared link has been lost, indicating a possible perimeter breach, change their infrared transmission such that subsequent devices around the perimeter are informed of the breach, g) to provide a secure perimeter using the aforementioned linked infrared transceiver node devices that includes a base unit device for providing alarm indication, h) to provide a secure perimeter using the aforementioned linked infrared transceiver node devices whereby each device upon detecting that their received infrared energy has been lost suppresses their infrared transmission so that a breach causes all subsequent devices to suppress their transmissions until finally the base unit device is informed of a perimeter breach by the fact that its received infrared energy is lost, i) to provide a secure perimeter using the aforementioned linked infrared transceiver node devices whereby alternately a device upon detecting that its received infrared energy has been lost changes its infrared transmission such that it now includes a perimeter breach indication, and subsequent devices around the perimeter change their infrared transmission accordingly so that a perimeter breach indication is again carried around to the base unit device, j) to provide a secure perimeter using the aforementioned linked infrared transceiver node devices whereby alternately a device upon detecting a perimeter breach due to loss of received infrared energy includes in its infrared transmission both a breach indication as well as an indication of its position in the perimeter, and that this position indication is transmitted around the perimeter to the base unit device, k) to provide a secure perimeter using the aforementioned linked infrared transceiver node devices whereby each device comprising the secure perimeter automatically detects its position in the perimeter, l) to provide a secure perimeter using the aforementioned linked infrared transceiver node devices whereby each device distinguishes between the unique transmission of the previous device in the perimeter and those of other devices, m) to provide a secure perimeter using the aforementioned linked infrared transceiver node devices whereby each device includes a means to aid in adjusting the transmit/receive alignment of two adjacent devices in order to optimally establish an infrared link.

n) to use a source node that provides initiation of infra-red transmission separate from the alarm-function base node so that breaches of non-enclosed boundaries can be detected, o) to use a multiple of such source nodes so that multiple boundary branches can be protected, converging on an alarm-function base node.

DETAILED DESCRIPTION OF THE INVENTION

Inventive Principles, FIGS. 1–5

Figure 1:
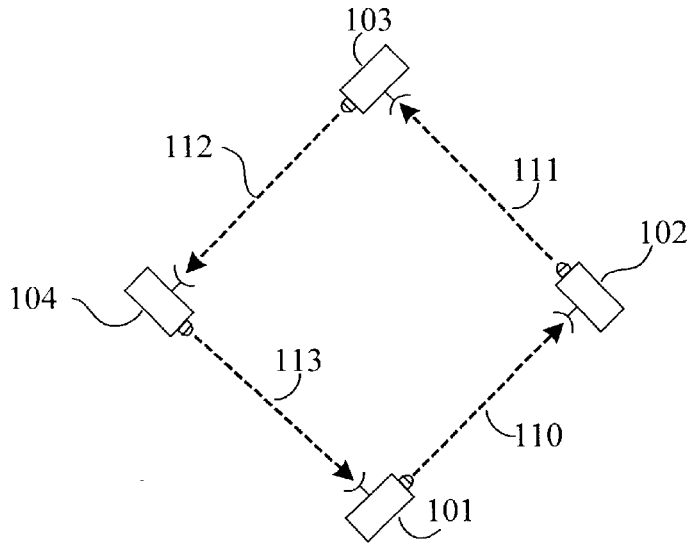
FIG. 1 shows a basic configuration of inventive transceiver node devices forming a protected perimeter.

FIG. 1 shows a basic concept of the invention whereby inter-connected and inter-dependant infra-red links 110, 111, 112, and 113 are arranged to create a perimeter boundary. Each end of each link consists of either Link Unit perimeter transceiver node devices 102, 103, or 104, or Base Unit device 101 that each transmit infra-red energy in one direction and receive infra-red energy from a different direction. Each of links 110, 111, 112, and 113 are created by the transmitted infra-red energy of one unit.

Figure 2:
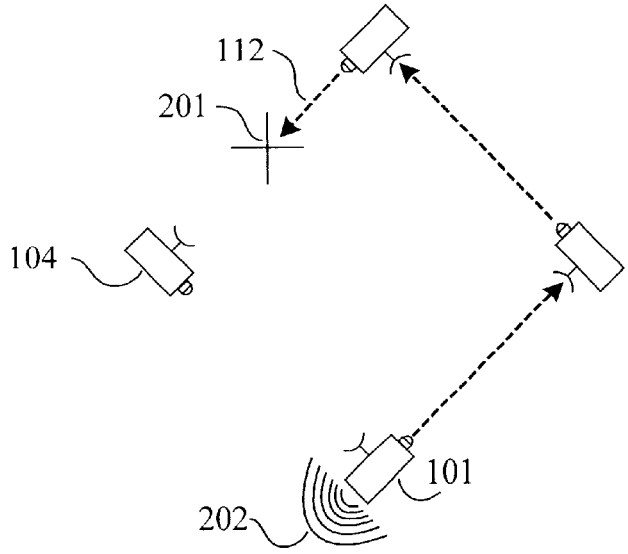
FIG. 2 shows one embodiment whereby a break of one infrared link results in the suppression of the next device's transmission, thus communicating a perimeter breach to the base unit device which sounds an alarm.

For a first preferred embodiment a key aspect is that each Link Unit transceiver node device only transmits its infra-red energy to the next unit in the perimeter of links if it receives recognizable infra-red energy from the previous unit. FIG. 2 shows that, for example, if link 112 is blocked by obstruction 201, the following unit 104 in the perimeter inhibits the transmission of its infra-red energy. In this way any obstruction of one of the links, such as might occur if the perimeter were breached by an intruder, would be detected by Base Unit 101 when it fails to receive the expected infra-red energy on its receiving link. Upon detecting a possible breach of the perimeter, as evidenced by a loss of its received infrared energy, Base Unit 101 could provide an indication, shown in FIG. 2, for example, as audible alarm 202. The Base Unit's alarm indication could, of course, consist of many other possible forms including, but not limited to, visual indications, alert indication to adjoining equipment, or electronic communications to another location.

Figure 3:
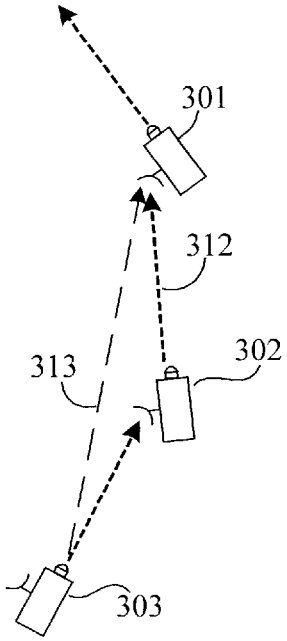
FIG. 3 illustrates how in the security of the perimeter arrangements of the previous Fig.s could be compromised if one transceiver node device were to inadvertently receive the transmission of an earlier, non-neighbor device, FIG. 4 then illustrates how an inventive enhancement prevents this by including in each device's transmission an identity indication so that a receiving device can distinguish between its neighbor and other devices.

FIG. 3 shows how the security of the perimeter might be jeopardized if all units use the same form of infra-red link and if two units are placed nearly in line with each other. Peripheral infrared energy 313 from Link Unit 303, for example, could be received by Link Unit 301 so that even if link 312 between units 301 and 302 were obstructed, Link Unit 301 might not detect this since Link Unit 301 would continue to receive its expected infrared energy. An intruder, for example, could pass, one after the other, through the infrared link beams between units 301 and 302, and then units 301 and 303, without Link Unit 301 experiencing a loss of received infra-red energy.

Figure 4:
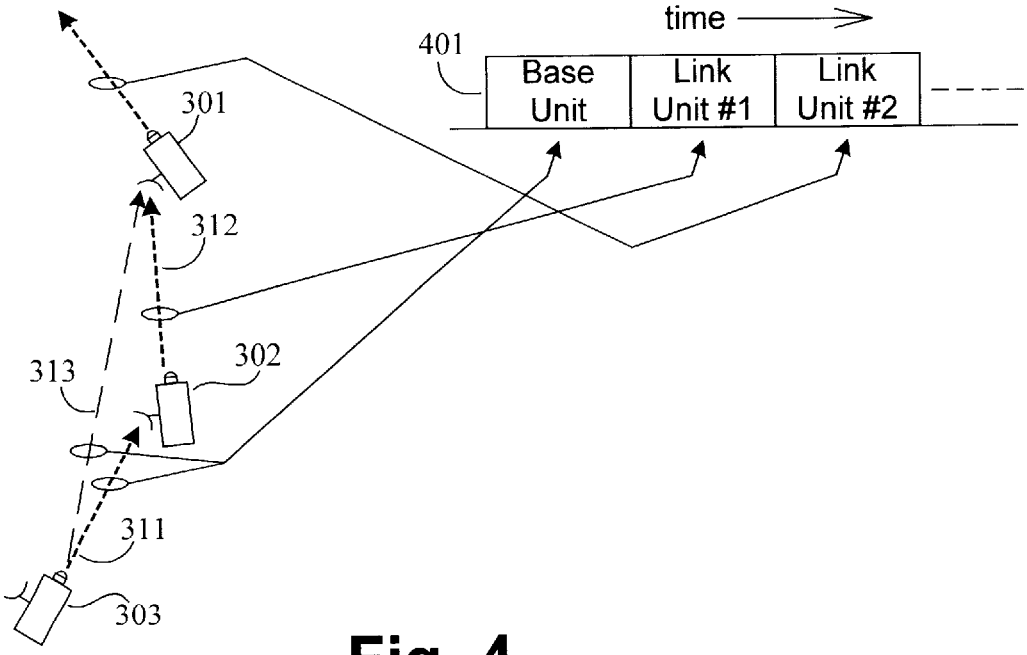

FIG. 4 shows how this problem is solved in this invention by using signature signals that are unique to each unit. In this way an obstruction of the infrared link between units 301 and 302 would be detected by unit 301 even if it were receiving infrared energy transmitted by unit 303 since now unit 301 can distinguish between infrared energy transmitted by unit 302 and 303. The preferred type of infrared signal signature, 401, is also shown in FIG. 4. The signature signal for each unit is an indicator that corresponds to that unit's location in the perimeter. This example assumes a counter-clockwise sequence, however, a clock-wise orientation would work equally well. Further, each unit transmits its perimeter location indicator only after it has received the location indicator of the previous unit. In this way the units transmit their signature location indicators in sequence and do not interfere with each other, i.e., each Link Unit transmits in turn starting at the Base Unit and proceeding counter-clockwise, in this example, around the ring. If the Base Unit does not detect the position indicator of the last Link Unit in a prescribed period of time it declares a perimeter break.

Figure 5:
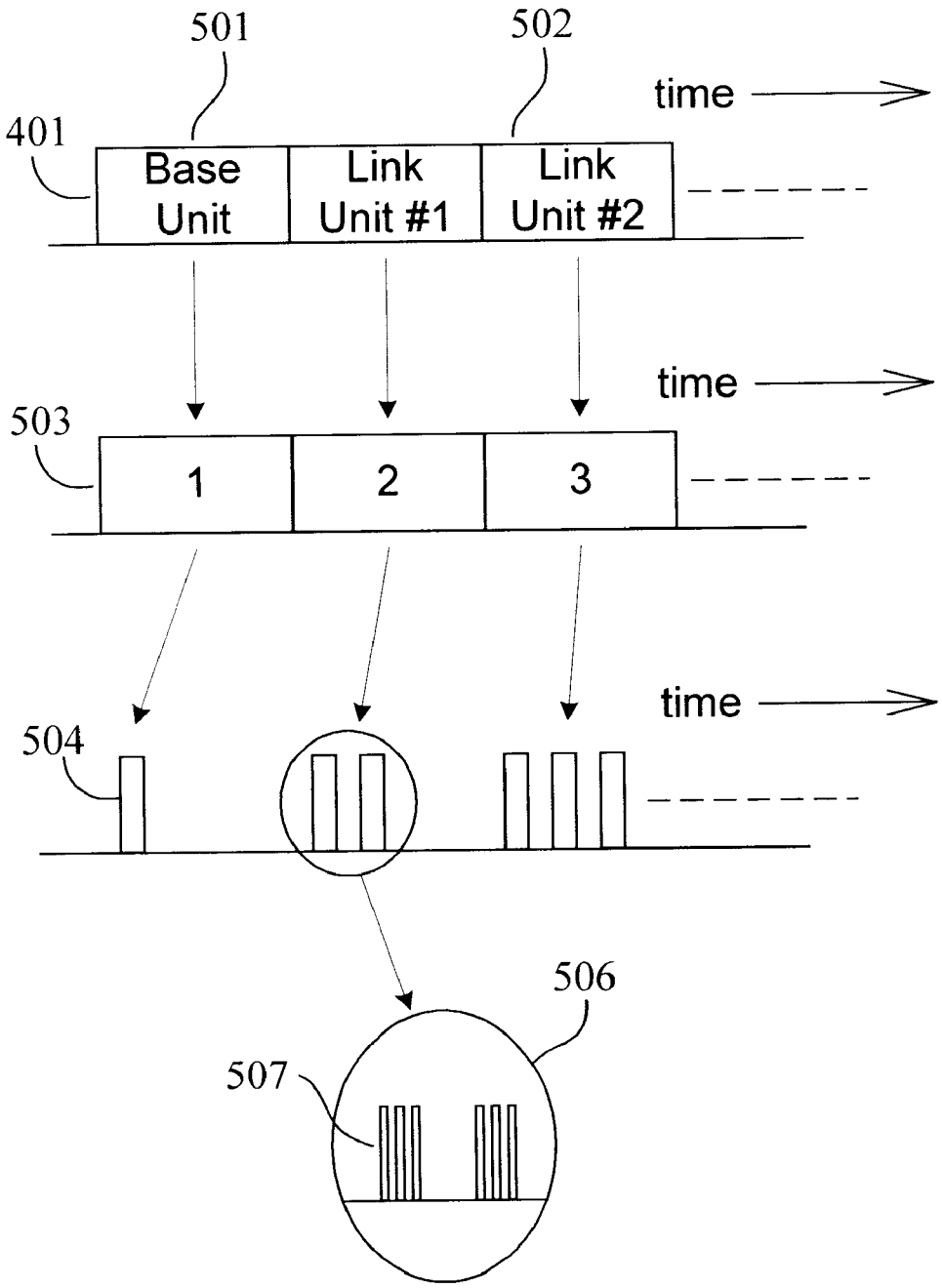
FIG. 5 illustrates the form of the identity indication introduced in FIG. 4.

FIG. 5 illustrates, in increasing levels of detail, the form of the perimeter location indicators 401 shown previously in FIG. 4. The perimeter location indication of each unit, as already explained, is associated with that unit's sequential position around the perimeter. The indicators themselves consist simply of numbers corresponding to the locations of the associated units in the perimeter. Thus, the unit's indication numbers 503 are 'one' for the Base Unit—always the first unit of the perimeter, 'two' for the first Link Unit in the perimeter, etc. These indication numbers, as will be explained later, are established when the perimeter is initially constructed and activated. The indication numbers are encoded as corresponding quantities of transmitter signal marks, to be described shortly, so that the 'one' indication of the Base Unit is encoded as a single transmitter signal mark 504, whereas the 'two' indication of the first Link Unit in the perimeter is encoded as two such transmitter signal marks, etc. Finally, each transmitter signal mark consists of three pulses of infrared energy, called a Pulse Group, so that, as can be seen in the expanded section shown within circle 506, the two transmitter signal marks of the first Link Unit's location indication consist of two Pulse Groups 507 consisting of three infrared energy pulses each. One Pulse Group within a perimeter location number is delineated from the next Pulse Group by an absence of pulses for a predetermined period.

Perimeter location numbers are communicated by an associated quantity of Pulse Groups since, as will be seen, the example of this preferred embodiment includes a maximum of six units (five Link Units plus one Base Unit). However, the reader will understand that an embodiment that includes more units might use an encoded version of the perimeter location number, such as, for example, binary representations.

Figure 6:
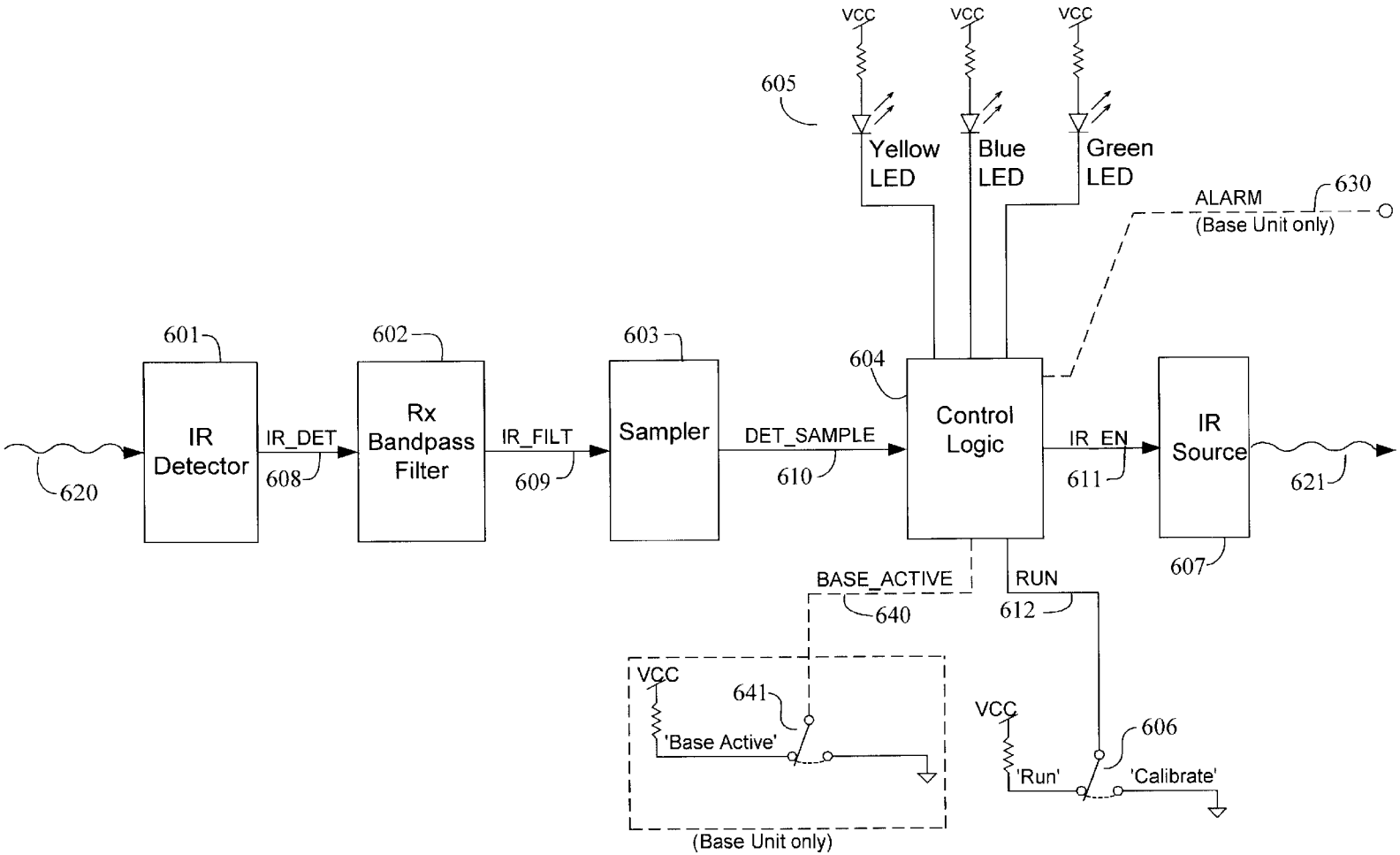
FIG. 6 is a block diagram of the first preferred embodiment of the invention.

Block Diagram of the First Preferred Embodiment, FIG. 6

FIG. 6 shows a functional breakdown of a device unit according to a first preferred embodiment. Base Units are the same as Link Units except for a small number of additional functions indicated and identified in the Figs. FIG. 6 shows, for example, that a Base Unit contains an alarm signal output 630, called ALARM. A Base Unit also has a second switch 641, in addition to switch 606, which activates BASE_ ACTIVE signal 640.

Infrared energy 620 arrives at the left of FIG. 6 and transmit infrared energy 621 exits on the right. IR Detector 601 converts arriving infrared energy into electrical signal IR_DET 608 and is described in more detail later. Rx Bandpass Filter 602 is tuned to the same frequency as the pulse occurrences described in the previous FIG. 5. This helps to reject interference noise from the incoming signal that might otherwise complicate signature recognition. In the preferred embodiments the pulse occurrence period is nominally 100 micro-seconds, and, therefore, the Rx Bandpass Filter center frequency, is 10 kHz. Additionally, the Rx Bandpass Filter of the preferred embodiments provides an overall gain of approximately 100 and exhibits a signal polarity inversion, i.e., positive-going pulses at the input result in negative-going pulses at the output. Bandpass filters are common in the field of electronics and, therefore, this instance will not be described further as one skilled in the art will understand its operation and design. For reference, however, a common multiple-feedback filter using an op amp is described in Op-Amps and Liner Integrated Circuit Technology by Ramakant A. Gayakwad, Prentice-Hall, Inc., Englewood Cliffs, N.J. 07632, pp. 302–304, 1983.

The output of Rx Bandpass Filter 602, signal IR_FILT 609, is provided to Sampler 603. This function, described in more detail later, serves to determine when a pulse is present on the IR_FILT signal 609. The output signal 610 called DET_SAMPLE is a digital signal; DET_SAMPLE is a logic one when a pulse is present and a logic zero when no pulse is present.

The DET_SAMPLE signal 610 is provided from the Sampler to the Control Logic function 604. The Control Logic function performs all the decisions associated with the Unit's operation. The Control Logic function illuminates LEDs 605, three in the preferred embodiments, in combinations as associated with various modes of operation. It also accepts an indication, RUN signal 612, from switch 606 which defines whether the Unit is operating in manually set RUN or CALIBRATE modes. Additionally Base Units have an additional manually set switch 641 which determines the state of signal BASE_AVTIVE 640. These modes, along with the LED uses as well as overall Control Logic operation are described in later sections. The output signal 611, labeled IR_EN, comprises the signature output of this Unit. When IR_EN 611 is a logic high the Unit outputs infrared energy, when IR_EN 611 is a logic low no output occurs. For Base Units only ALARM signal 630 provides an indication that an intrusion into the secure perimeter has been detected. Uses of this signal could include, but would not be limited to, activating audible or visual alarms, alerting adjoining equipment, or initiating electronic communications to another location.

IR Source function 607 performs the reverse function of IR Detector 601. The IR Source function converts the digital signal IR_EN 611 into infrared energy and is described in detail later.

Figure 7:
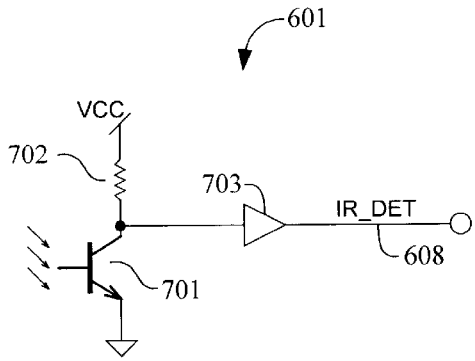
FIG. 7 illustrates the IR detector of FIG. 6.

IR Detector, FIG. 7

FIG. 7 shows that IR Detector 601 as used in the preferred embodiment is a commonly available photo-transistor 701. Received infrared energy produces base-emitter electron flow which is amplified by photo-transistor 701 and resistor 702 and further buffered by high-impedance amplifier 703, which may optionally also provide additional gain, to generate the output signal IR_DET 608. The reader should note that a pulse of infrared energy causes photo-transistor 701 to turn on, causing, in turn, the $V_{CE}$ voltage to be reduced, and, thus, output signal IR_DET 608 to be a negative-going pulse. However, since, as was previously explained, Rx Bandpass Filter 602 of FIG. 6 exhibits an inverting operation, its output, IR_FILT 609, is a corresponding positive-going pulse.

Figure 8:
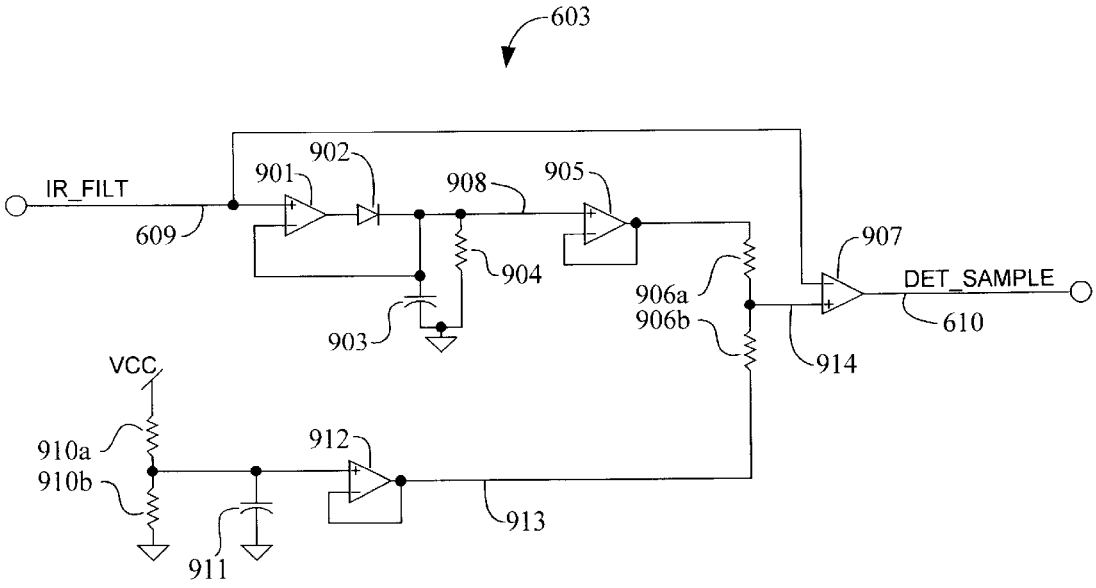
FIG. 8 illustrates the Sampler of FIG. 6.

Sampler, FIG. 8

The Sampler circuit for the preferred embodiments is shown in FIG. 8. As described earlier, this circuit outputs a high logic level on signal 610, labeled DET_SAMPLE, when the analog input signal 609, labeled IR_FILT, contains a pulse. Since the input signal level of the unit can vary over a large range depending on the transmitting and receiving units' distance from each other, among other factors, this circuit must be able to detect the difference between pulses and non-pulses for input pulses of varying amplitudes. This is accomplished by generating an average peak level 908 of the Sampler input signal and comparing this with the current input level. A Sampler input signal with an amplitude greater than half of the average peak is determined to be a pulse, while any Sampler input signal with an amplitude less than half of the average peak is determined to be a non-pulse. This is accomplished in the following way. Begin by assuming that capacitor 903 is discharged so that the average peak level signal 908 is near ground. As pulses arrive they pass through op amp 901 and diode 902 and charge capacitor 903. As the average peak level signal 908 rises, non-pulse Sampler inputs will cause op amp 901 to output a level near ground, but diode 902 will prevent op amp 901 from discharging capacitor 903. On the other hand when the Sampler input is a pulse higher than the average peak level signal 908, signal op amp 901 outputs a level near VCC which passes through diode 902 and further charges capacitor 903. In this way capacitor 903 will continue to charge as long as pulses are present until the average peak level signal 908 reaches the peak level of the Sampler input pulses. Resistor 904 slowly discharges capacitor 903 so that the average peak level signal 908 signal can fall to follow an input signal that are reduced in amplitude. Unity gain op amplifier 905 provides an impedance buffer for the average peak level signal 908 and its output is at the same level as average peak level signal 908.

Reference level signal 913 lies half-way between VCC and ground since resistors 910*a* and 910*b* are of approximately equal value and buffer op amp 912 is configured for a non-inverting gain of one. Capacitor 911 provides filtering against spurious induced noise. Resistors 906*a* and 906*b*, which are of approximately equal value, then divide the output of op amp 905, which represents the peak level of the Sampler input, by half relative to the half-level reference signal 913 to produce sample reference signal 914. For example, if VCC is+5 Volts, and if the peak voltage of the Sampler input is 3.7 Volts (i.e., the amplitude of the received pulse on Sampler input IR_FILT 609 is 1.2V since the quiescent output level of the Rx Bandpass Filter is half of VCC, or 2.5 Volts), then sample reference signal 914 will be halfway between that of the reference 913 and the average peak level signal 908. Since reference 913 will be half of VCC, or 2.5 Volts, and average peak level signal 908 will be equal to the input peak level, or 3.7 Volts, then sample reference signal 914 will be [2.5V+(0.5×(3.7V−2.5V))], or 3.1 Volts.

Finally, sample reference signal 914 is used to compare with the Sampler input signal IR_FILT 609 via comparitor 907. Thus, if the Sampler input IR_FILT 609 is greater in amplitude than halfway between the average peak level signal 908 level and reference 913, Sampler output DET_SAMPLE 610 is at a logic high, while if the Sampler input IR_FILT 609 is less than halfway between the average peak level signal 908 level and reference 913, Sampler output DET_SAMPLE 610 is at a logic low.

Figure 9:
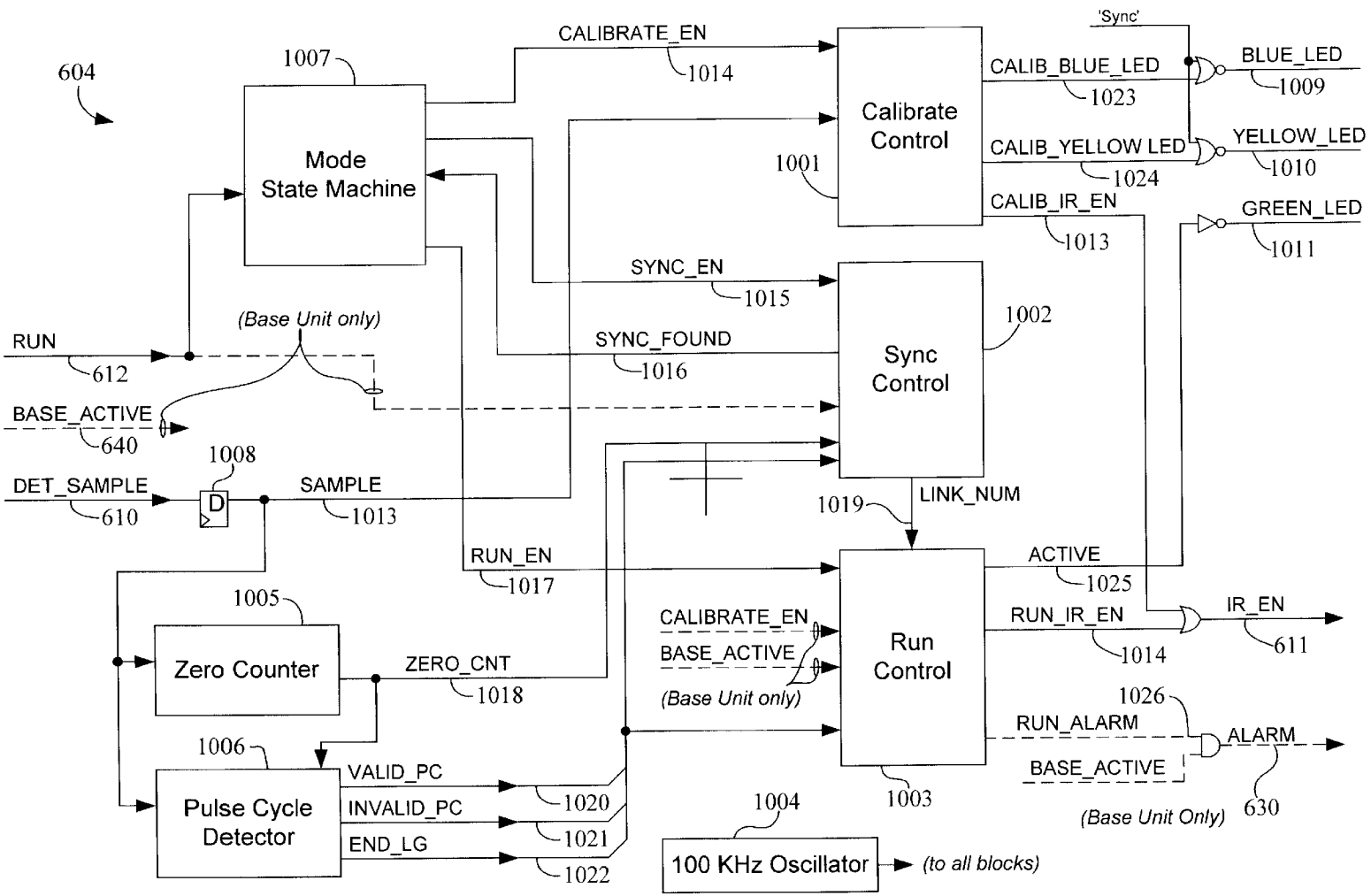
FIG. 9 is a block diagram of the Control Logic of FIG. 6.
Figure 10:
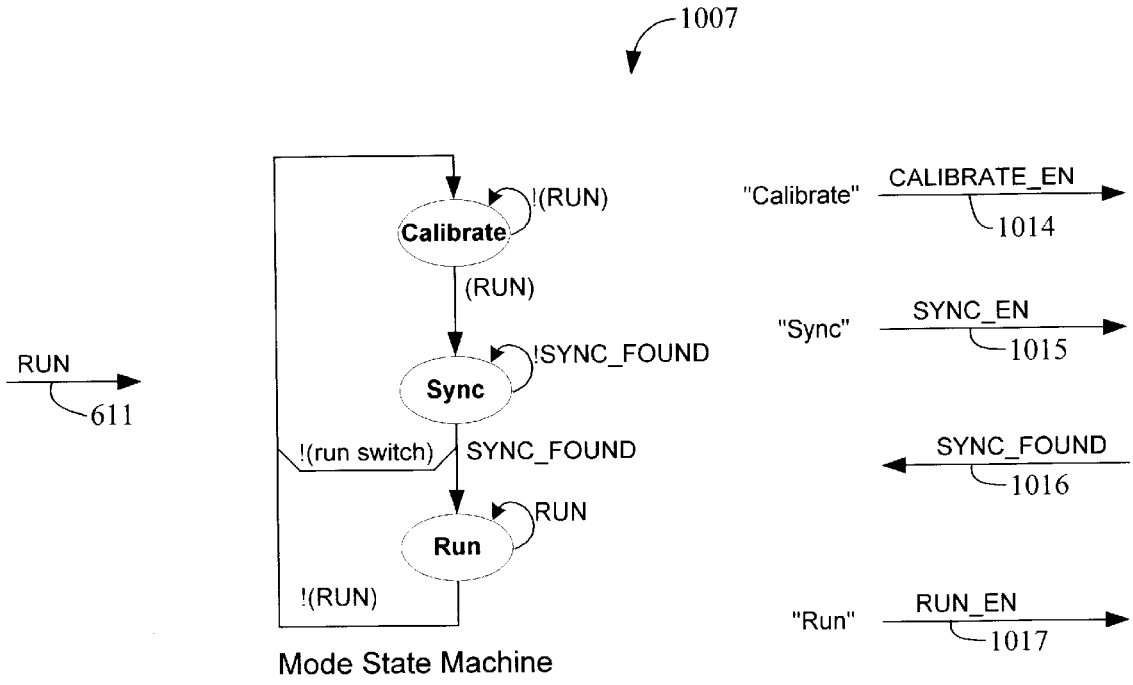
FIG. 10 illustrates the Mode State Machine of FIG. 9.

Control Logic, FIGS. 9 and 10

FIG. 9 shows block level functions of the logic control section 604 shown previously in FIG. 6. All functions shown as boxes are, with the exception of 100 KHz Oscillator 1004, described in more detail later. Calibrate Control section 1001 provides user aid for positioning the units when initially setting up the perimeter. Sync Control 1002 serves to determine the unit's node location in the perimeter once the calibration process is complete. Run Control 1003 provides control for transmitting infrared energy when the Units are operating to provide perimeter security. 100 KHz Oscillator 1004 is a simple 100 KHz free-running oscillator which provides a common control clock for the entire Control Logic section. Since this is the only clock operating in the entire unit, the reader will understand that it is not shown explicitly, but, rather, anywhere a clock is operating, including the clocking of all state machines, then the clock from this oscillator is assumed. Register 1008 samples the Rx Filter output signal DET_SAMPLE 610, and provides the sampled signal SAMPLE 1013, to function blocks 1001, 1005, and 1006. This is the first example of a use of the 100 KHz clock generated by oscillator 1004. Its specific occurrence is now assumed in the rest of this description anywhere a clock is used by logic functions. Zero Counter 1005 provides a count value 1018 of consecutive non-pulse input samples. This zero count value is used by Sync Control 1002 and Pulse Cycle Detector 1006. Pulse Cycle Detector 1006 determines: 1) when a valid group of pulses comprising a portion of a unit's perimeter number has been received, indicated by VALID_PC signal 1020, 2) when an invalid pulse form has been received as indicated by INVALID_PC signal 1021, and 3) when a quantity of valid pulse groups comprising a complete perimeter location number has been received as indicated by END_LG signal 1022. Details of these pulse group forms and of the operation of Pulse Cycle Detector 1006 follows later.

FIG. 10 shows Mode State Machine 1007 that controls which of three function blocks, Calibration Control 1001, Sync Control 1002, or Run Control 1003, is currently active. The discussion that follows will refer to both FIGS. 9 and 10. When power is first applied to a unit, whether a Base Unit or a Link Unit, the default operational functional block is Calibrate Control 1001 as enabled by CALIBRATE_EN signal 1014. Calibration Control function 1001 is used by the user to adjust the alignment of unit's infrared transmitters and receivers. When enabled, Calibration Control 1001 function provides a unique calibration pulse form, the structure of which is explained later, via CALIB_IR_EN signal 1013 which in turn is placed on IR_EN signal 611 to drive the transmit IR Source 607 as shown in FIG. 6. Calibration Control 1001 function also activates CALIB_BLUE_LED signal 1023 and CALIB_YELLOW_LED signal 1024 in distinctive manners which in turn activate BLUE_LED signal 1009 and YELLOW_LED signal 1010, respectively, which in turn illuminate the blue and yellow LEDs shown in FIG. 6. In this way visible indication is provided to the user regarding the quality of the calibration signal being received, about which more will be understood later when the Calibrate Control block 1001 is explained.

Calibration Control 1001 function remains operational until a user sets Run/Calibrate switch 606, shown previously in FIG. 6, to the 'run' position, activating RUN signal 612. Mode State Machine 1007 then progresses to the 'Sync' State. From here Sync Control function 1002 is enabled via SYNC_EN signal 1015 until it finds its perimeter link location number and activates SYNC_FOUND signal 1016. When SYNC_FOUND 1016 is active indicating that Sync Control function 1002 has found its perimeter link location number, LINK_NUM signal 1019 indicates that number via a three-bit binary value. An active SYNC_FOUND signal 1016 then causes Mode State Machine 1007 to progress to the 'Run' state where Run Control function 1003 is enabled via RUN_EN signal 1017. Mode State Machine 1007 then remains in the 'Run' mode until the unit is either de-powered, or the user sets switch 606 shown in FIG. 6 back to the 'Calibrate' position. While activated via the 'Run' mode Run Control function 1003 monitors the information received on the infrared signal via Pulse Cycle Detector block 1006 signals 1020 (VALID_PC), 1021 (INVALID_PC), and 1022 (END_LG), and, as long as an infrared link break is not detected, outputs this unit's encoded serial link location number on RUN_IR_EN signal 1014 which in turn is placed on IR_EN signal 611 to drive the transmit IR Source as shown in FIG. 6. Details about the encoded serial link location number will be understood when Run Control block 1003 is explained later. Additionally, as long as an infrared link break is not detected ACTIVE signal 1025 is high, causing GREEN_LED signal 1011 to be low, and thus illuminating the green LED shown previously in FIG. 6. This provides a visual indication of proper operation of the received link at this node. ALARM_RUN signal 1026 and associated ALARM signal 630 are only used by a Base Unit, as selected by BASE_ACTIVE signal 640, and indicate that the Base Unit has detected that its infrared input signal is missing, indicating an apparent intrusion of the perimeter. Generation of ALARM_RLN signal 1026 is explained later when Run Control block 1003 is explained in detail, and it will be seen that ALARM_RUN signal 1026 and ACTIVE signal 1025 are never activated (made high) at the same time.

Figure 11:
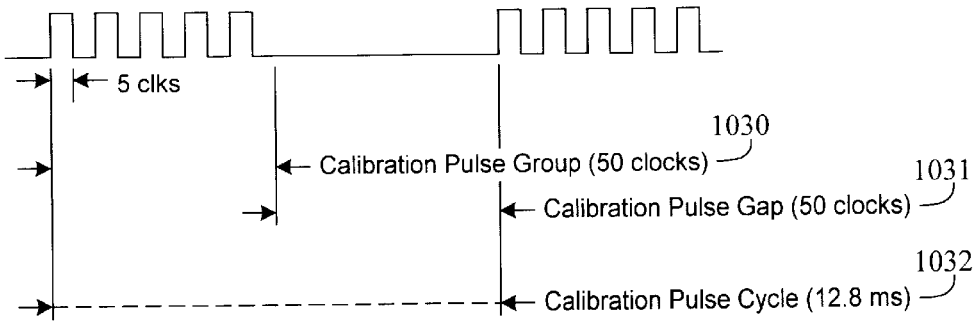
FIG. 11 illustrates the form of the calibration signal.
Figure 12:
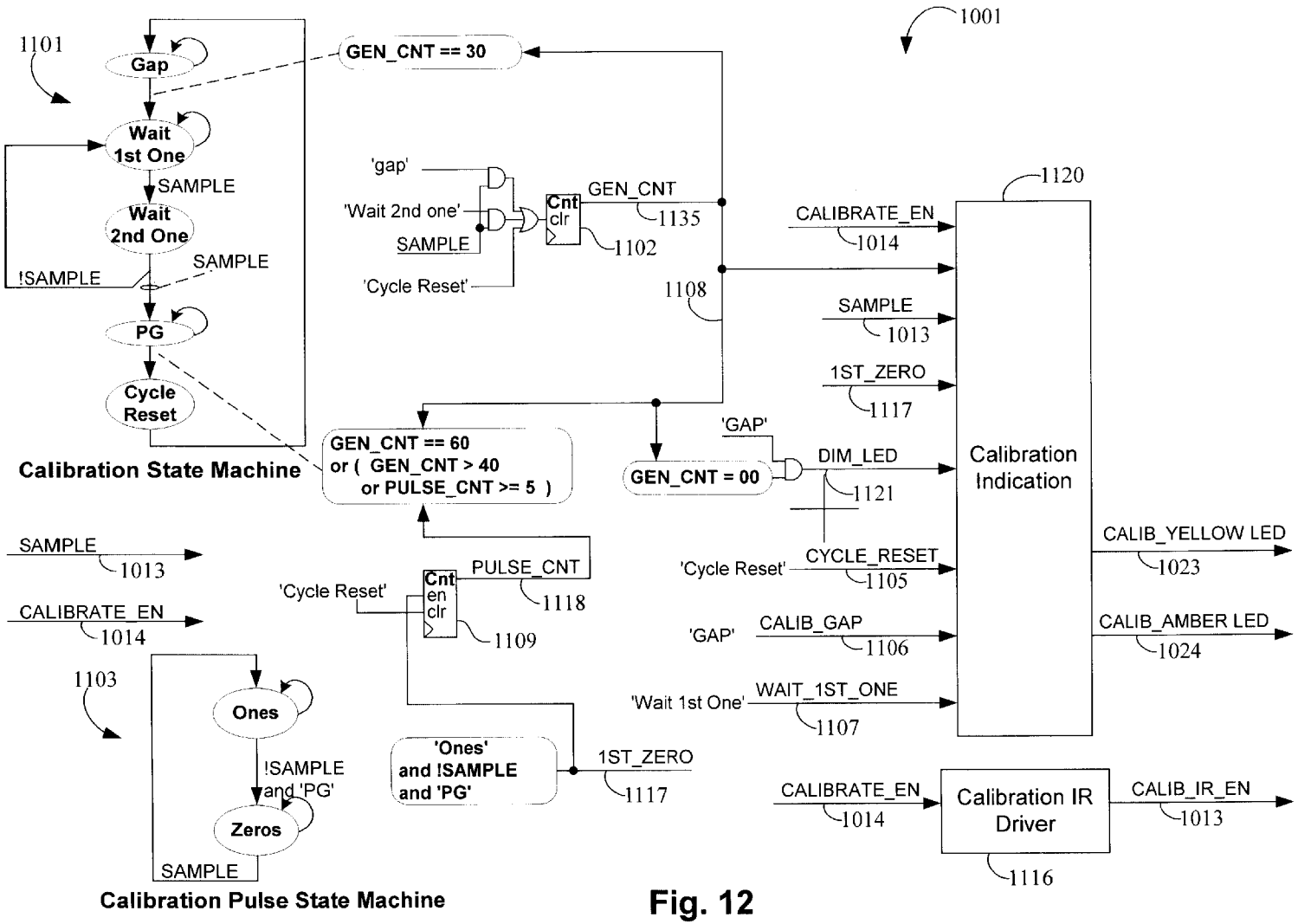
FIG. 12 illustrates the operation of the Calibrate Control block of FIG. 9.

Calibration Control, FIGS. 11 and 12

This mode is used to adjust the alignment of the infrared transmitter of one unit in a perimeter with the receive detector of the next. In this mode each unit's infrared transmitter and detector operates independently of each other.

FIG. 11 shows the form of pulses used for the Calibration Mode. The Pulse repetition rate is 10 KHz. Since the clock oscillator used for the logic control is 100 KHz, each pulse period is 10 clocks in duration: 5 clocks of pulse duration, and 5 clocks of inter-pulse space when no infrared energy is transmitted. Pulses are grouped into 5 pulses, followed by an equal period of time of no pulses. As shown in FIG. 11, the groups of 5 pulses are called Calibration Pulse Groups 1030, the inactive times between Calibration Pulse Groups are called Calibration Pulse Group Gaps 1031, and the times between the beginnings of one Calibration Pulse Group and the next are called Calibration Pulse Cycles 1032.

When in the calibration mode each unit, via Calibration Control block 1001 to be explained shortly, continuously transmits Calibration Pulse Cycles on its infrared output. Coincidentally Calibration Control block 1001 measures the accuracy of received Calibration Pulse Cycles and displays visual indications. The visual indications used in these preferred embodiments consist of a blue LED and a yellow LED. A nearly perfect reception of Calibration Pulse Cycles results in a continuous illumination of the blue LED, and progressively more degraded receptions result in presentations of a dimmed blue LED, a continuously illuminated yellow LED, a dimmed yellow LED, and finally neither LEDs illuminated at all. In this way a user could, for example, observe the calibration LEDs while adjusting the orientation of the receiver of a unit in the perimeter, assuming that the previous unit in the perimeter is also operating in the calibration mode and that its infrared transmitter has already been placed in this unit's general direction.

FIG. 12 shows control and block functions of Calibrate Control block 1001 shown previously in FIG. 9. Calibration State Machine 1101 controls the basic Calibration transmit portion of the Calibration function. Starting from the 'Gap' state, counter 1102 is cleared any time input single SAMPLE 1013 is high indicting that a pulse is being received. Calibration State Machine 1101 moves from the 'Gap' state to the 'Wait $1^{st}$ One' state when counter 1102 reaches a count of thirty indicating that thirty consecutive clocks have occurred with no pulses, which, in turn, indicates that a Calibration Pulse Group Gap has occurred. Once in the 'Wait $1^{st}$ One' state the state machine moves on to the 'Wait $2^{nd}$ One' state upon the first occurrence of signal SAMPLE 1013. This indicates the beginning of a Calibration Pulse Group. From the 'Wait 2nd One' state the state machine moves to the 'PG' state if the SAMPLE input 1013 is again high on the next clock cycle. Since this now indicates that two consecutive high SAMPLE inputs 1013 have occurred there is a good probability that the high SAMPLE inputs 1013 are due to a pulse transmitted by the previous node. If, on the other hand, SAMPLE input 1013 is low, the state machine moves from the 'Wait $2^{nd}$ One' state back to the 'Wait $1^{st}$ One' state since the first high SAMPLE input 1013 was probably due to induced noise rather than a result of a previous node's transmitted pulse. Once in the 'PG' state, the state machine remains there until the Calibrate Pulse Group is complete. This is indicated by the first occurrence of either five pulses as counted by counter 1109, described later, or the passage of sixty clocks as counted by counter 1102 in the event that not all five pulses were received by this unit. Upon leaving the 'PG' state Calibration State Machine 1101 passes through the 'Cycle Reset' state for one clock before returning to the 'GAP' state to wait for the next recognized Calibration Pulse Group Gap. As will be seen, CALIBRATE_EN signal 1014 is a general enable for the calibration operation and, as such, when inactive the Calibrate Cycle State Machine is forced to the 'GAP' state.

Calibration Pulse State Machine 1103 is used in conjunction with other functions, described later, in determining the width and quantity of pulses during the 'PG' state of the Calibration Cycle State Machine just described. Calibration Pulse State Machine 1103 defaults to the 'Ones' state. Calibration Pulse State Machine 1103 only leaves the 'Ones' state when, as one condition, the Calibration Cycle State Machine is in the PG state. The reader should remember that the Calibration Cycle State Machine enters the 'PG' state at the beginning of the first pulse of a Calibration Pulse Group. Calibration Pulse State Machine 1103 transitions from the 'Ones' state to the 'Zeros' state upon the first non-zero SAMPLE 1013 of each pulse of the Pulse Group, i.e., upon the end of each pulse encountered. This transition then represents the beginning of a Pulse Gap occurrence and produces 1ST_ZERO signal 1117. 1ST_ZERO signal 1117 enables counter 1109. Since 1ST_ZERO signal 1117 is high for one clock period after each pulse, counter 1109 therefore counts the number of pulses that have been encountered during a Pulse Group. The output of counter 1109, PULSE_CNT 1118, is used by the Calibration Cycle State Machine as described earlier. Counter 1109 is cleared by the 'Cycle Reset' state of the Calibration Cycle State Machine in preparation for the next Pulse Group.

Figure 13:
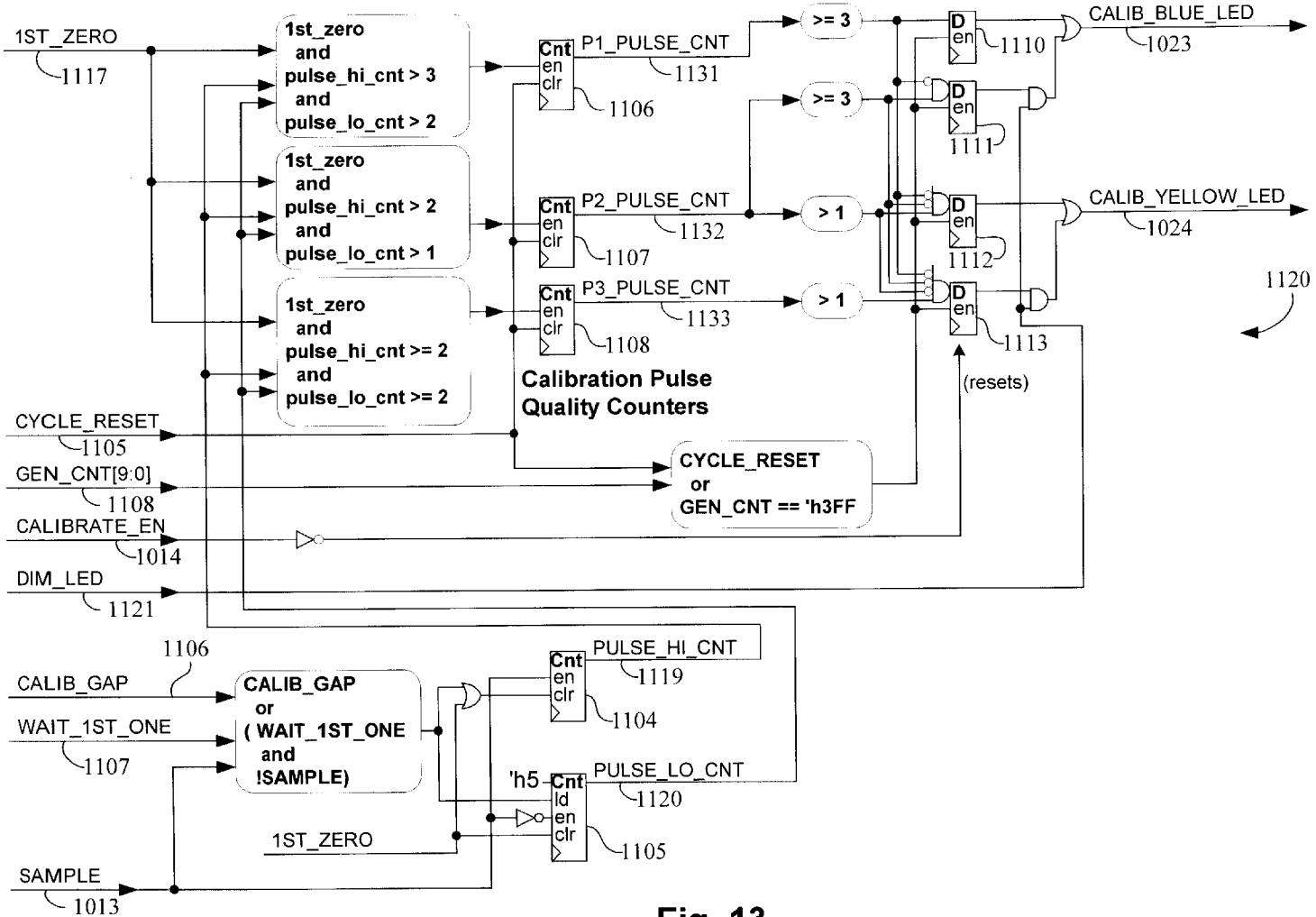
FIG. 13 illustrates the details of the Calibration Indication block of FIG. 12.

Calibration Indication, FIG. 13

The calibration operation described so far has shown how the two state machines of FIG. 12 track, Calibration Pulse Cycle-by-Calibration Pulse Cycle and pulse-by-pulse, the calibration mode transmission of a previous perimeter unit in a perimeter. Calibration Indication block 1120 of FIG. 12 uses various results of these state machine flows in addition to SAMPLE input 1013 to measure the quality of the received infrared energy by measuring the accuracy of the received infrared calibration mode pulses and indicates this accuracy via the LED signal outputs 1023 and 1024 as explained earlier. FIG. 13 shows the operation of Calibration Indication block 1120. Counter 1104 and counter 1105 count the number of clocks occurring during pulses and the number of clocks of non-pulses occurring between pulses respectively. Counter 1104 is held cleared during the 'GAP' state of Calibration State Machine 1101 as indicated by an active CALIB_GAP signal 1106 and also during the 'Wait $1^{st}$ One' state as indicated by an active WAIT_$1^{ST}$_ONE signal 1107 while waiting for the first high SAMPLE input 1013, i.e., while SAMPLE signal 1013 is low. When the SAMPLE input 1013 goes high, i.e., the beginning of a pulse, counter 1104 is no longer cleared and is enabled to count as long as SAMPLE 1013 is high. In this way counter 1104 counts the number of clocks in the first pulse. Counter 1104 is then cleared by 1ST_ZERO signal 1117 which indicates the end of the pulse, but as will be seen later, the output of counter 1104 is used by Calibration Pulse Quality Counters 1106, 1107, and 1108 during the same clock period that counter 1104 is synchronously cleared. Counter 1104 then counts the number of clock periods of each subsequent pulse of the Pulse Group in the same way, cleared by each occurrence of 1ST_ZERO signal 1117, then enabled for counting when the high SAMPLE inputs 1013 occur when the next pulse arrives. Counter 1105 operates in a similar fashion as counter 1104, except that counter 1105 is enabled when SAMPLE input 1013 is low rather than high, thus counting the number of clocks in the gaps between pulses. Also, counter 1105 is loaded with a value of five when the Calibration Cycle State Machine is in the 'Gap' state or, 'Wait $1^{st}$ One' state and SAMPLE input 1013 is low; this effects a pre-loading of five into counter 1105 and is necessary since the quality of each pulse is captured in the Calibration Pulse Quality Counters at the end of each pulse by 1ST_ZERO signal 1117 and the first pulse of the Pulse Group has not yet had an inter-pulse gap to be counted. Additionally, counter 1105 actually begins counting non-pulse SAMPLE inputs 1013 on the second non-pulse clock occurrence since 1ST_ZERO signal 1117 which clears the counter is the first non-pulse clock occurrence. This is taken into account in the Calibration Pulse Quality Counters as will be seen later.

Calibration Pulse Quality Counters, 1106, 1107, and 1108, track the quantity of pulses in a Calibration Pulse Cycle categorized by pulse quality. The quality of each pulse determines which of the three Calibration Pulse Quality Counters is incremented. A pulse's quality is measured by how many clocks wide it is, since a degraded transmission of infrared energy will generally result in an attenuated pulse with resulting loss of width. The final values at the end of each Calibration Pulse Cycle for the three pulse quality counters then determines how the Calibration mode LEDs are displayed. The LED processing is described in a later section. Each of the three counters counts progressively degraded pulses. The first counter, 1106, increments when the number of clocks in a pulse were four or higher and the number of clocks preceding the pulse were at least four (noting, as was explained previously, that the number of non-pulse clocks is actually one more than indicated by the pulse_lo_cnt). This indicates a nearly perfect pulse. Note that the inclusion of 1ST_ZERO signal 1117 delineates one pulse period, consisting of a Calibration Pulse Gap and a Calibration Pulse, from the next. The second counter, 1107, increments when the number of clocks in a pulse were three or higher and the number of clocks preceding the pulse were at least three. This indicates a slightly degraded pulse. Finally, the third counter, 1108, increments when the number of clocks in a pulse were two or higher and the number of clocks preceding the pulse were at least three. This indicates a significantly degraded pulse. The three Calibration Pulse Quality Counters are cleared at the end of each Calibration Pulse Group Cycle via CYCLE_RESET signal 1105 which indicates that Calibration State Machine 1101 is passing through the 'Cycle Reset' state, at which time their final values are used to set the state of the Calibration mode LEDs as described in the next section.

The 'Cycle Reset' state of Calibration State Machine 1101 which synchronously clears Calibration Pulse Quality Counters 1106, 1107, and 1108 via the CYCLE_RESET signal 1105 also synchronously enables the four registers 1110, 1111, 1112, and 1113 associated with the Calibration LED indication outputs. The outputs of Calibration Pulse Quality Counters 1106, 1107, and 1108 are logically combined to form the inputs of registers 1110, 1111, 1112, and 1113 in the following way:

- o if P1_PULSE_CNT 1131 is greater than or equal to three then register 1110's output is made active—this corresponds to an occurrence of three or more nearly perfect pulses during the previous Calibration Pulse Cycle, else o if P2_PULSE_CNT 1132 is greater than or equal to three then register 1111's output is made active—this corresponds to an occurrence of three or more pulses that each contain at least three clocks during the previous Calibration Pulse Cycle, else
- o if P2_PULSE_CNT 1132 is greater than one then register 1112's output is made active—this corresponds to an occurrence of at least one pulse that contains at least three clocks during the previous Calibration Pulse Cycle, else
- o if P3_PULSE_CNT 1133 is greater than one then register 1113's output is made active—this corresponds to an occurrence of at least one pulse that contains at least two clocks during the previous Calibration Pulse Cycle.

In this way these four registers correspond to increasingly degraded infrared reception and that only one signal will be active at any time since whichever one is active will disable those of higher degradation. While the output of register 1110 is active CALEB_BLUE_LED signal 1023 is continuously active. While the output of register 1111 is active CALEB_BLUE_LED 1023 is active approximately one eighth of the time due to a gating with DIM_LED signal 1121, as is explained below. While the output of register 1112 is active CALEB_YELLOW_LED signal 1024, is continuously active. While the output of register 1113 is active CALEB_YELLOW_LED 1024 is active approximately one eighth of the time due again to a gating with DIM_LED 1121.

DIM_LED signal 1121 serves as a gating function to only enable CALEB_BLUE_LED 1023 and CALEB_YELLOW_LED 1024 signals only a small portion of the time. This causes their respective LEDs to be lit at a dimmed level while they are active. The generation of DIM_LED signal 1121 was shown on FIG. 12 and is only active during the 'Gap' state of Calibration State Machine 1101 (representing about half of the Calibration Pulse Cycle), and then only when the most significant two bits of GEN_CNT 1135 are low, which occurs for one fourth of the count values. Thus, one fourth of the GEN_CNT count 1135 values for one half of a Calibration Pulse Cycle results in DIM_LED 1121 being active for about one eighth of each Calibration Pulse Cycle.

So it can be seen that the four conditions of increasingly degraded infrared reception results in LED indications of: first, the blue LED being illuminated continuously while at least three perfect pulses are detected each Calibration Pulse Cycle, second, the blue LED being illuminated in a dimmed fashion while only at least three pulses only three clocks in duration are detected each Calibration Pulse Cycle, third, the yellow LED being illuminated continuously while only at least one pulse only three clocks in duration is detected each Calibration Pulse Cycle, and finally, the yellow LED being illuminated in a dimmed fashion while only at least one pulse only two clocks in duration are detected each Calibration Pulse Cycle. When the pulses are degraded beyond the fourth level no LEDs are illuminated.

Figure 14:
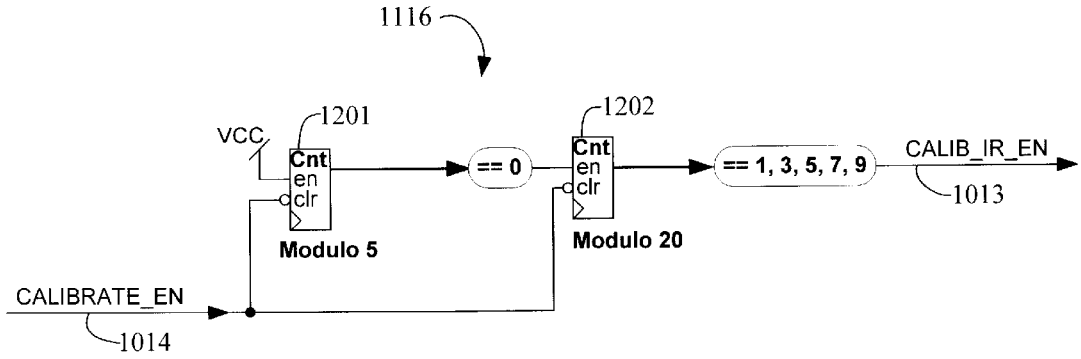
FIG. 14 illustrates the details of the Calibration IR Driver block of FIG. 12.

Calibration IR Driver, FIG. 14

As was explained earlier, the generation of infrared signals for transmission is done independently of the receive functions just described. As long as CALIBRATE_EN signal 1014 is active, which is the case when the unit is in the Calibration mode, function block 1116, labeled Calibration IR Driver and shown in FIG. 12, will generate on CALIB_IR_EN signal 1013 pulses as was shown previously in FIG. 11. A description of the operation of Calibration IR Driver 1116 follows.

FIG. 14 shows the operation of Calibration IR Driver block 1116. As long as CALIBRATE_EN signal 1014, is high counter 1201 and counter 1202 will operate to create calibrate pulse signals on output CALIB_IR_EN signal 1013. When CALIBRATE_EN signal 1014 is low these two counters are held cleared and output CALIB_IR_EN signal 1013 is inactive. When CALIBRATE_EN 1014 is high counter 1201 continuously increments in a modulo 5 fashion, meaning that it produces values that start at zero and proceed incrementally through four, then start over again at zero. Every five clocks when the output of counter 1201 is a zero value counter 1202 increments once. Counter 1202 operates in a modulo 20 fashion, meaning that it produces values that start at zero and proceed incrementally through nineteen, then start over again at zero. Output signal CALIB_IR_EN 1013 then goes high whenever the output of counter 1202 is a value of either 1, 3, 5, 7, or 9. This results in a signal of the form shown in FIG. 11 for CALIB_IR_EN 1013 in the following way:

1) counter 1202 output values of 1, 3, 5, 7, and 9 each result in a high CALIB_IR_EN signal 1013 for five clocks as already explained—these correspond to the calibration pulses of a Calibration Pulse Group,
2) each of these high output values are separated by a counter 1202 output (values 2, 4, 6, and 10, respectively) which result in a low CALIB_IR_EN signal 1013 for five clocks—these correspond to the inactive periods between the calibration pulses of a Calibration Pulse Group and together with the five high pulses comprise the Calibration Pulse Group, and
3) the subsequent counter 1202 output values of 11 through 0 are all low resulting in a low CALIB_IR_EN signal 1013 for a continuous period of 50 clocks—this corresponds to the Calibration Pulse Gap.

Figure 15:
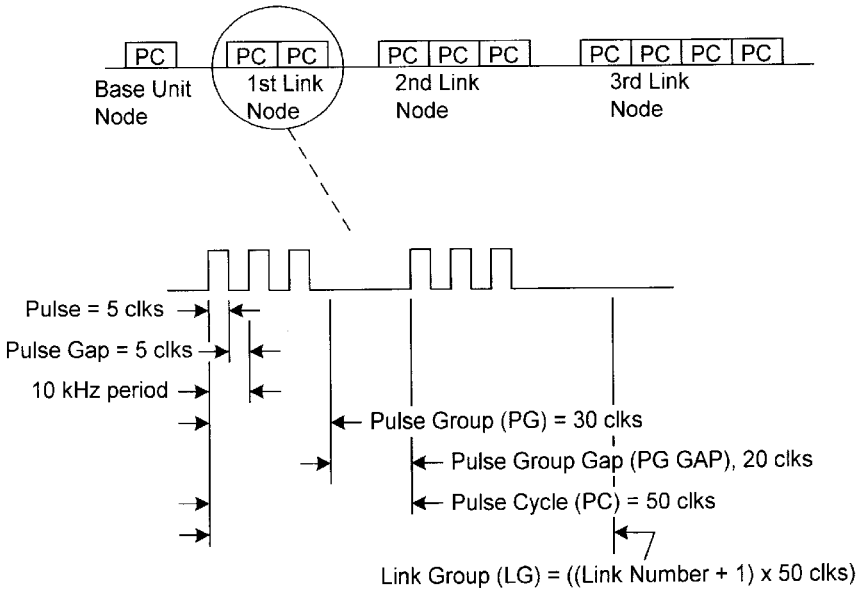
FIG. 15 illustrates the form of the non-breached transmission signal for normal operation.

Sync and Run Modes Pulse Forms, FIG. 15

Before continuing with descriptions of the operations of the Sync and Run modes, the form of the normal operating infrared signals will be described. FIG. 15 shows the structure of the pulses transmitted by individual units. First is shown, as was first described in FIG. 5, how each node in the perimeter transmits a numerical code associated with it's perimeter location, where the basic unit of counting is shown as a signature signal set labeled as 'PC'. In these preferred embodiments the Base Unit transmits a single 'PC' signal set, the first Link Unit transmits two 'PC' signal sets, the second Link Unit transmits three 'PC' signal sets, and so on. As an example, the two 'PC' signal sets transmitted by the first Link Unit are then shown expanded for more detail. Here it is shown that each 'PC' signal set consists of three individual Pulses. Each Pulse is five clocks in duration, with an inactive period of five clocks between Pulses called a Pulse Gap. As shown, three Pulses and three Pulse Gaps comprise a Pulse Group for a total of thirty clocks, while a Pulse Group and the twenty clocks of inactivity that follows comprise a Pulse Cycle (from which is derived the 'PC' label). Finally, all of the Pulse Cycles transmitted by any one unit comprise a Link Group.

Figures 16, 17:
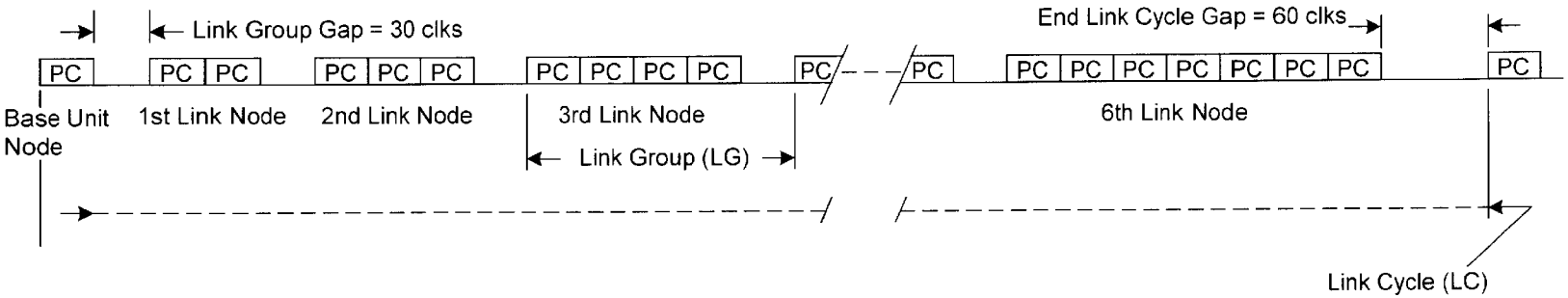
FIG. 16 illustrates further the form of the non-breached transmission signal for normal operation.
FIG. 17 is a table showing relationships between the time periods of Link Cycles versus the number of nodes in the perimeter.

Link Cycle with Six Link Nodes, FIG. 16

FIG. 16 shows the form of transmitted infrared signals when the perimeter is constructed with one Base Unit and six Link Units. The period from the beginning of a Link Group transmitted by the Base Unit (which always consists of one Pulse Cycle) until the beginning of the next Link Group transmitted by the Base Unit is called a Link Cycle, and includes the Link Groups transmitted by all the Link Units comprising the secure perimeter. As shown, the inactive period between Link Groups, called a Link Group Gap, is 30 clocks, while the inactive period between the last Link Group in the perimeter and the Base Unit Link Group for the next Link Cycle, called an End Link Cycle Gap, is 60 clocks. As will be seen later, this extended time of inactivity at the end of each Link Cycle is used to identify the end of a Link Cycle.

Link Cycle Rates per Number of Link Nodes, FIG. 17

The total duration of a Link Cycle is, as explained, dependant on the number of Link Units comprising the perimeter. FIG. 16 illustrated a Link Cycle for a perimeter consisting of six Link Units. With a total of twenty-eight Pulse Cycles consisting of 50 clocks each, six Inter Link Group Gaps consisting of 30 clocks each, and an End Link Cycle Gap consisting of 60 clocks, the reader can understand that the total duration of the Link Cycle in FIG. 16 includes 1640 clocks. FIG. 17 shows the number of clocks comprising Link Cycles of perimeter systems of various quantities of Link Units. FIG. 17 also shows the corresponding number of Link Cycles (abbreviated as "LCs" in the table) that occurs each second for perimeter systems of various quantities of Link Units. The number of Link Cycles per second affects the security of the perimeter since this defines a maximum amount of time that an infrared link could be interrupted and possibly not be detected (i.e., any infrared link could be obstructed for a portion of a Link Cycle as long as the link is re-established when the Link Group for that particular infrared link occurs). For example, for a perimeter that consists of six Link Units there are 6.1 Link Cycles per second. This means that a perimeter intrusion could be guaranteed to be detected if the perimeter obstruction lasts for at least 1/6.1 LCs per second, or 164 milliseconds (the maximum amount of time is actually somewhat less than this since, as already stated, an undetected obstruction cannot last for an entire Link Cycle since the obstructed link would need to be clear during at least its Link Group). For example, for an obstruction two feet in width, approximately the visible width of an upright human, the obstruction would need to be traveling more than 6.1×2 feet per second through a six-Link Unit perimeter to avoid a guaranteed detection. This corresponds to about 8 miles per hour, or the speed of a fast run. But, passage through the infrared link is not likely to occur at these precisely timed instances and detection of a human in this extreme example is almost assured. Perimeters of less than six Link Nodes have correspondingly shorter Link Cycle times with associated increased security. Note that the Link Cycle times could be shortened by using a clock oscillator with a frequency higher than 100 KHz. This results in somewhat more expensive infrared components and would require modifications of the Rx Filter since pulse frequencies would change accordingly.

Figure 18:
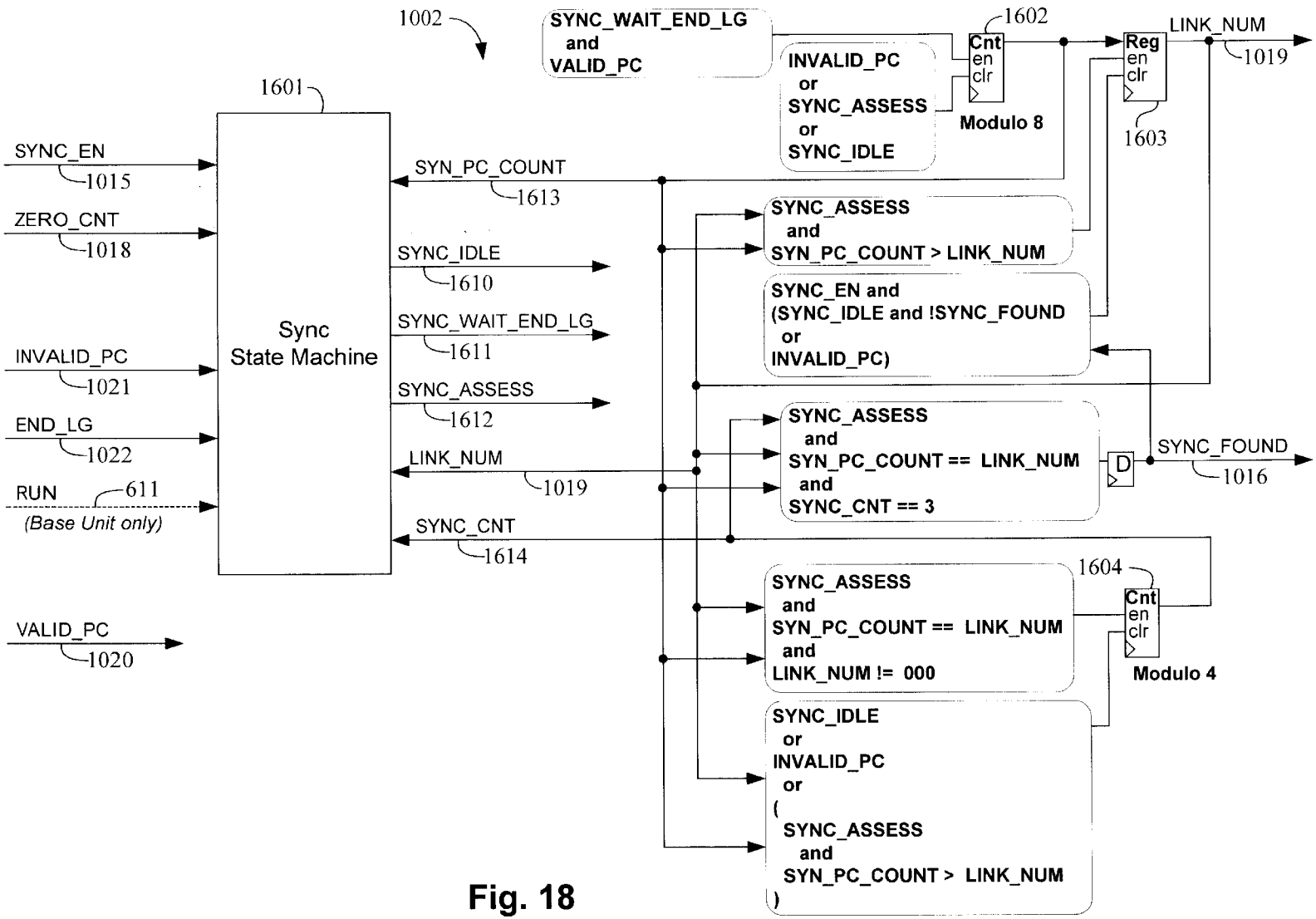
FIG. 18 illustrates the operation of the Sync Control block of FIG. 9.
Figure 19:
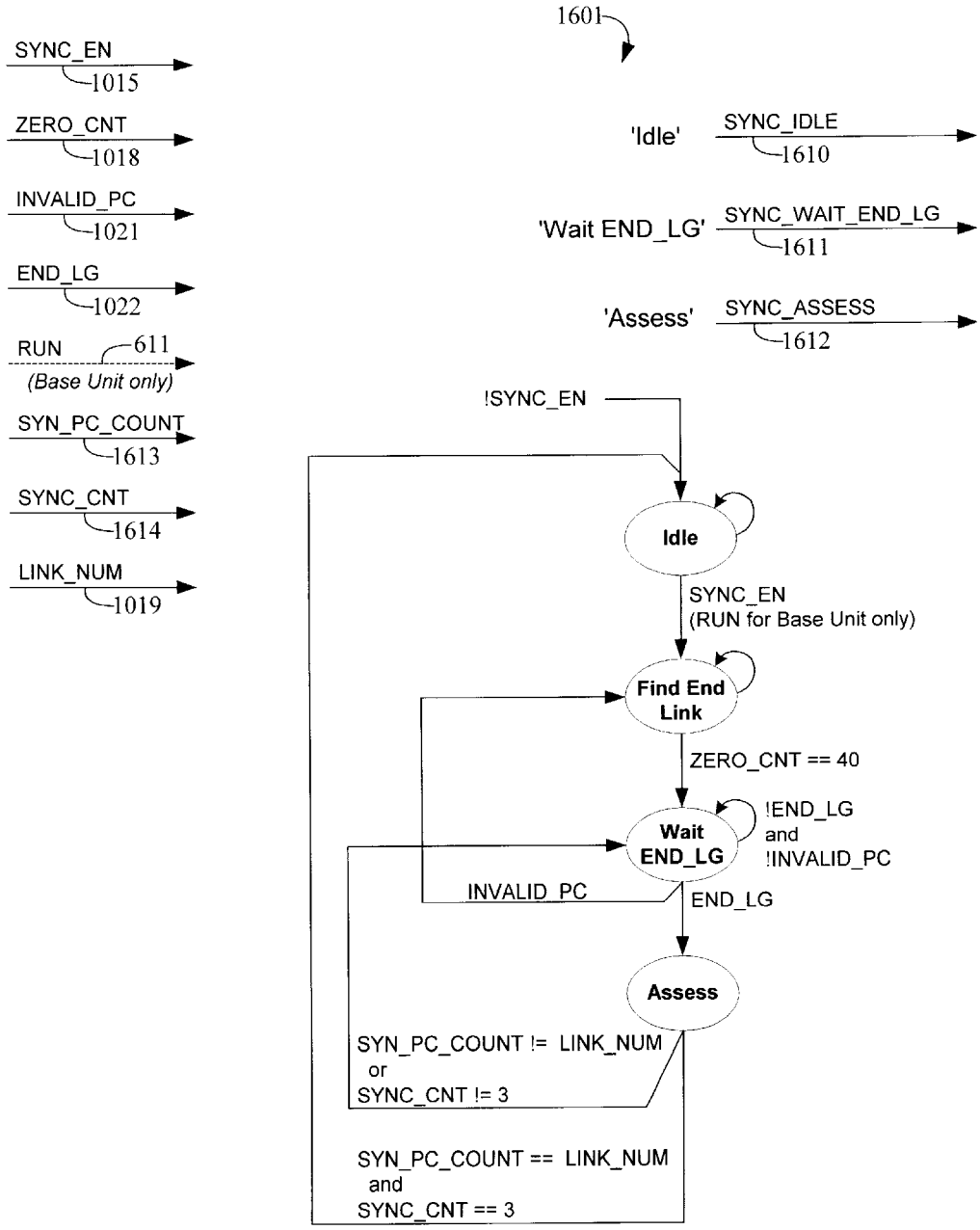
FIG. 19 illustrates the Sync State Machine of FIG. 18.

Sync Control, FIGS. 18 and 19

When initially setting up a secure perimeter using inventive devices of the preferred embodiments, once the user is satisfied that all of the node's infrared transmitters and receivers in the perimeter are adjusted correctly using the Calibration mode previously described, the user then changes the position of mode switches of each of the units from "Calibrate" to "Run". However, before the units can enter an operational run mode and establish a secure perimeter, each unit must determine its position in the perimeter. Each unit accomplishes this by first entering a Sync mode after its mode switch is moved to the "Run" position. This was shown previously as the 'Sync' state in Mode State Machine 1007 of FIG. 10. When Mode State Machine 1007 enters the 'Sync' state SYNC_EN signal 1015 is made activate and provided to Sync Control block 1002 as was previously shown in FIG. 9. Once Sync Control block 1002 determines this unit's perimeter location it activates SYNC_FOUND signal 1016 back to Mode State Machine 1007 which then proceeds to the 'Run' mode. While in the 'Sync' mode, each Link Unit's infrared transmitter is inactive, transmitting its particular Link Group—found during the 'Sync' mode—only after the unit proceeds from the 'Sync' mode to the 'Run' mode. In this way each node in the perimeter, starting with the Base Unit, in turn determines its perimeter location. The user changes each unit's mode switch from 'Calibrate' to 'Run' starting with the first Link Unit of the perimeter and proceeding until finally the Base Unit is changed to 'Run' as well. In this way, each unit can determine its location on the perimeter since the previous unit's Link Group value is the largest that this unit now receives. Unlike the Link Units, the Base Unit continually transmits its single-PC infrared signal while in the 'Sync' mode. This is necessary in order for the synchronization process to begin around the perimeter. In fact, as will be seen later, unlike the Link Units, the Base Unit always transmits its single-PC infrared signal when not in the Calibrate mode.

FIG. 18 shows the operation of Sync Control function 1002. There are five signals that are provided to this function from other functions previously shown in FIG. 9: SYNC_EN signal 1015, which indicates that this unit's mode has changed to 'Sync', ZERO_CNT signal 1018 which indicates the number of clock occurrences of consecutive non-pulse infrared reception, VALID_PC signal 1020 which indicates the occurrence of a valid Pulse Cycle, INVALID_PC signal 1021 which indicates the occurrence of an invalid PC, e.g., an occurrence of a pulse consisting of an incorrect amount of clocks, END_LG signal 1022 which indicates detection of an Inter-Link Group gap at the end of a Link Group, and finally, RUN signal 611, only used on the Base Unit, which indicates that the user mode switch has been moved to the 'Run' position. Explanations of the generation of these signals are provided in a later section.

Sync State Machine, 1601, is shown in FIG. 19. The following discussion will now refer to both FIGS. 18 and 19. Sync State Machine 1601 remains in the 'Idle' state and its associated SYNC_IDLE signal 1610 remains active as long as SYNC_EN 1015, is inactive. Once SYNC_EN signal 1015 goes active, indicating that this unit's mode has changed to 'Sync', Sync State Machine 1601 proceeds to the 'Find End Link' state. Sync State Machine 1601 remains in this state until the unit receives no pulses from its infrared receiver for at least 40 clocks as indicated by ZERO_CNT signal 1018 value (the generation of which is explained later). This ensures that the sync process will begin at the start of a Link Group since the maximum non-pulse clock occurrences between Pulse Groups within a Link Group is 25 clocks, whereas the number of non-pulse clock occurrences between Link Groups is 55 clocks. Once at least 40 non-pulse clock periods have occurred Sync State Machine 1601 proceeds to the 'Wait END_LG' state. The state machine remains here until the end of a Link Group is detected as indicated by END_LG signal 1022. While in this state SYNC_WAIT_END_LG signal 1611 enables counter 1602 to count the number of Pulse Cycle occurrences via VALID_PC signal 1020. The value of counter 1602 is contained in SYN_PC_COUNT signal 1613. By the end of a Link Group the reader can understand that this counter, and thus signal SYN_PC_COUNT 1613, will contain a value equal to the number of Pulse Cycles in that Link Group, which in turn represents the location of the transmitting unit in the perimeter. Should an INVALID_PC signal 1021 occur before an END_LG signal 1022 occurrence the state machine returns to the 'Find End Link' state and counter 1602 is cleared to start over.

Once the end of a Link Group is detected as indicated by END_LG signal 1022 the state machine proceeds to the 'Assess' state where it remains for only one clock period. While in the 'Assess' state SYNC_ASSESS signal 1612 is active resulting in several decisions being made with the registers and counters associated with the Sync block. If the value stored in register 1603 (LINK_NUM 1019) is less than that of counter 1602 then the value in register 1603 is replaced with that in counter. In this way register 1603 always contains the maximum Link Group value, i.e., the number of Pulse Cycles comprising the Link Group which has been received. This value is contained in LINK_NUM signal 1019. However, any occurrence of INVALID_PC signal 1021 clears register 1603 as the sync process starts over. Simultaneous with the transfer of the value of the counter 1602 to register 1603, counter 1602 is cleared so that counter 1602 is ready to begin counting the Pulse Cycles of the next Pulse Group. Also during the 'Assess'0 state counter 1604 is incremented if LINK_NUM value 1019 is equal to SYN_PC_COUNT 1613 of counter 1602, as long as LINK_NUM value 1019 is not zero. In this way counter 1604 counts the number of times that a maximum sized Link Group number has been received. The value of counter 1604 is contained in SYNC_CNT signal 1614. The reader will understand again that this maximum sized Link Group number represents the location of the most previous unit in the perimeter since no units after this one in the perimeter is yet transmitting. Thus, counter 1604 counts the number of error-free Link Groups transmitted by the most previous unit in the perimeter. Finally, during the 'Assess' state if LINK_NUM 1019 is equal to that of SYN_PC_COUNT 1613 from counter 1602 and SYNC_CNT from counter 1604 is three, then SYNC_FOUND signal 1016 is made active for one clock period indicating the successful completion of the Sync mode operation. The reader will understand that since three successful maximum Link Group occurrences had to occur before the one in which SYNC_FOUND 1016 is made active, a total of four successful maximum Link Groups must occur in order for SYNC_FOUND signal 1016 to go active. The reader will also understand that after SYNC_FOUND signal 1016 goes active causing Mode State Machine 1007 to proceed to the 'Run' state, LINK_NUM signal 1019 contains the Link Number value of the most previous unit in the perimeter, i.e., that this unit's Link Number is now one more than the value presented by LINK_NUM 1019.

From the 'Assess' state Sync State Machine 1601 proceeds back to the 'Wait END_LG' state if the value in the Sync Counter, SYN_CNT 1614, is not yet three, indicating that sufficient successful maximum Link Groups have not yet occurred, or the value in counter 1602, SYN_PC_COUNT 1613, is not equal to that of LINK_NUM 1019 indicating that the just-received Pulse Group is not a maximum-sized one, i.e., not that of the most previous unit in the perimeter. If, on the other hand, SYN_CNT 1614 is three, indicating that sufficient successful maximum Link Groups have occurred, and SYN_PC_COUNT 1613 is equal to that of LINK_NUM 1019 then Sync State Machine 1601 proceeds back to the original 'Idle' state since the Sync mode is now complete and SYNC_FOUND signal 1016 is made active. The reader will understand that an active SYNC_FOUND signal 1016 will cause Mode State Machine 1007 shown previously in FIG. 10 to proceed to the 'Run' mode which will in turn make input signal SYNC_EN 1015 inactive preventing Sync State Machine 1601 from leaving the 'Idle' state.

For the Base Unit only, Sync State Machine 1601 is made to proceed from the 'Idle' state to the 'Find End Link' state when RUN signal 611 is active, rather than SYNC_EN signal 1015. This allows a Base Unit to continue to acquire new values for LINK_NUM signal 1019 even when initial synchronization has been found and Mode State Machine 1007 shown previously in FIG. 10 proceeds from the 'Sync' state to the 'Run' state. This in turn allows the Base Unit to be removed from the Calibrate mode so that it will initiate Link Cycles via its single-Pulse Cycle Pulse Group, yet continue to monitor and acquire LINK_NUM 1019 values via this Sync Function as just described. Thus, each successive Link Unit around the perimeter in turn can be synchronized (the Base Unit must be initiating a Link Cycle for this to operate), yet the Base Unit can acquire the Link Number of the last Link Unit before the perimeter becomes completely operational. This is further described later.

Figure 20:
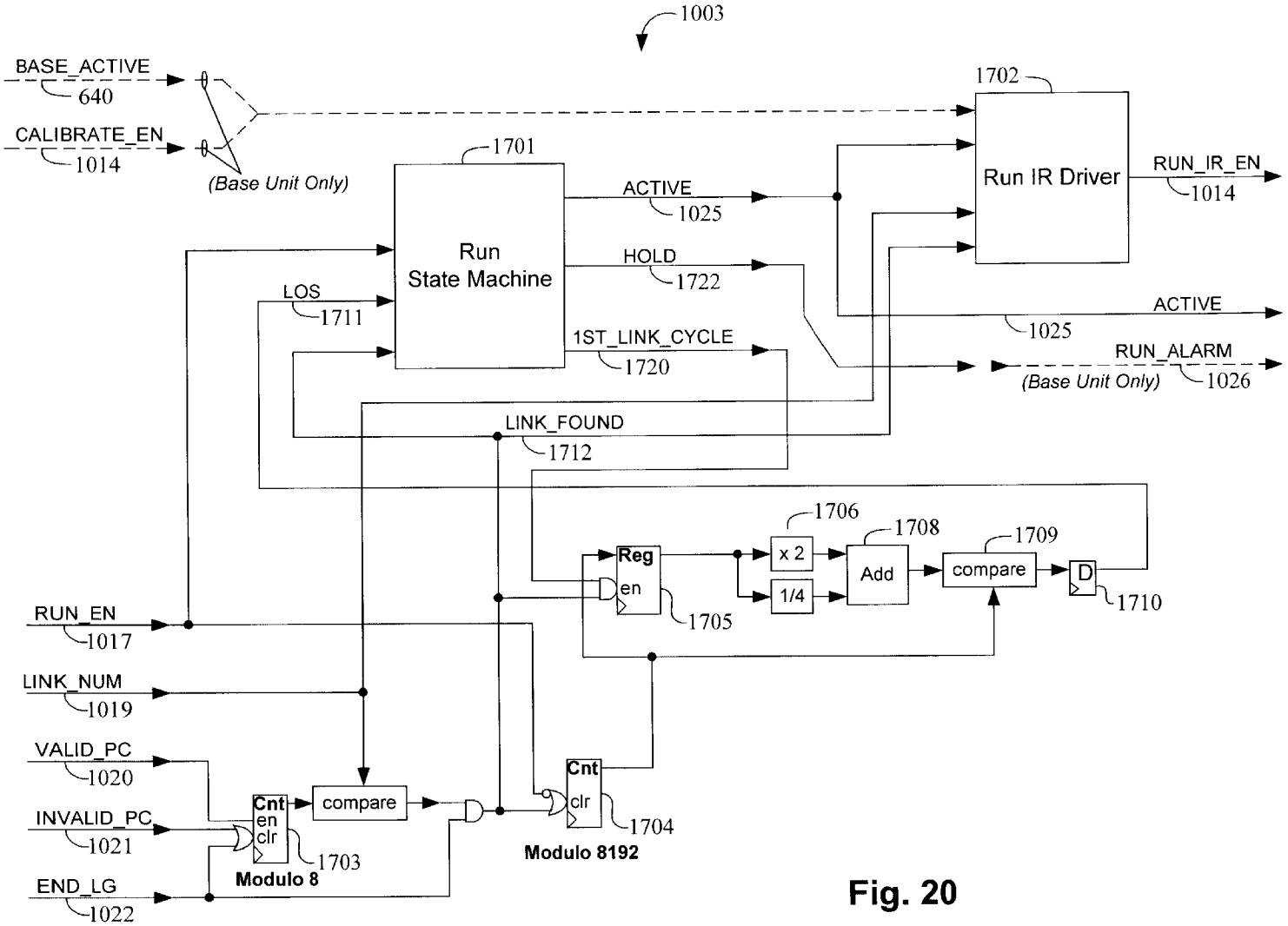
FIG. 20 illustrates the operation of the Run Control block of FIG. 9.

Run Control, FIG. 20

Figure 21:
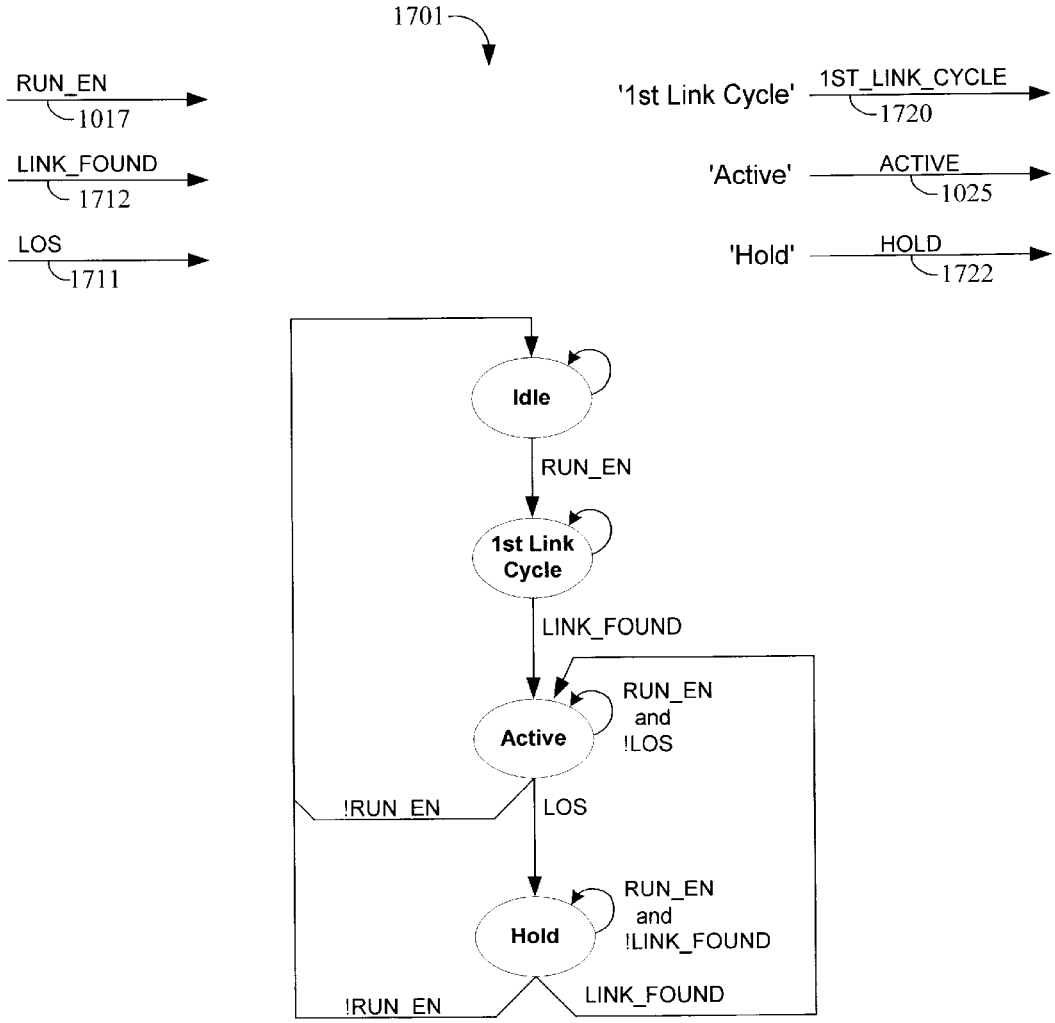
FIG. 21 illustrates the Run State Machine of FIG. 20.

As was just explained, once a unit finds its location in the perimeter, as indicated by a value of one more than the value present on LINK_NUM signal 1019 shown previously in FIG. 9, Sync Control function 1002 activates SYNC_FOUND signal 1016 for one clock period. This, in turn, causes Mode state machine 1007 shown previously in FIG. 10 to advance to the 'Run' state. RUN_EN signal 1017 is then made active and enables Run Control block function 1003 to operate to maintain a secure perimeter as will now be explained. FIG. 20 shows the operation of Run Control block 1003, and FIG. 21 shows the operation of Run State Machine 1701 sub-block. Both of these Figures will be used in the following explanation. The basic operation of Run Control function 1003 will be first explained, and then the generation of the associated control signals, signals LINK_

FOUND 1712 and LOS 1711, will be described. Upon receiving RUN_EN signal 1017, indicating that normal run operation has commenced, Run State Machine 1701 proceeds from the initial 'Idle' state to the '1st Link Cycle' state. The state machine remains in the '1st Link Cycle' state until LINK_FOUND signal 1712 goes active causing Run State Machine 1701 to then proceed to the 'Active' state. As will be explained shortly, an active LINK_FOUND signal 1712 indicates that a complete Link Group value associated with the previous perimeter unit has been received. The 'Active' state represents the normal operation of the unit; in this state ACTIVATE signal 1025 is made active which, as will be explained later, enables Run IR Driver 1702 to generate transmit infrared signal RUN_IR_EN 1014 which in turn, as was shown in previous FIG. 9, is placed on IR_EN signal 611 to drive the transmit LED as was shown in FIG. 6. As will be explained later, RUN_IR_EN signal 1014 includes this unit's Link Group number and its generation comprises normal operation of the infrared transmission for maintaining a secure perimeter. Run State Machine 1701 remains in the operational 'Active' state unless signal LOS 1711 goes active. As will be seen shortly, LOS 1711 indicates that the unit has failed to receive the previous unit's Link Group for two Link Cycles, indicating that the infrared link with the previous node has been disrupted. If an active LOS signal 1711 occurs, then Run State Machine 1701 advances to the 'Hold' state. In the 'Hold' state ACTIVE signal 1025 is no longer active which causes the secession of infrared transmission of this unit's Link Group number since RUN_IR_EN signal 1014 is disabled. Also, if this unit is a Base Node Unit, then the 'Hold' state also causes RUN_ALARM signal 1026 to be active via HOLD signal 1722, which in turn activates ALARM signal 630 shown previously in FIG. 9 to be active, comprising an alarm indication alerting, for example, external devices. Run State Machine 1701 remains in the 'Hold' state until LINK_FOUND signal 1712 again goes active indicating the reception of the previous unit's Link Group number and, therefore, restoration of the infrared link with the previous perimeter unit, in which case Run State Machine 1701 returns to the 'Active' state resuming normal operation. The reader will note that a deactivation of RUN_EN signal 1017 causes the state machine to transition out of either the 'Active' or 'Hold' states back to the 'Idle' state since this indicates that the user has moved mode switch 606 shown previously in FIG. 6 from the 'Run' position back to the 'Calibrate' position, thus ending the run mode of operation.

The generation of LINK_FOUND signal 1712 will now be explained. As explained earlier, LINK_FOUND signal 1712 indicates that a Link Group has been received that has a value equal to that of the previous unit's position in the perimeter. LINK_FOUND 1712 is generated by comparing LINK_NUM signal 1019, that, as was already explained, comprises the previous unit's Link Group number, with the output of counter 1703 which tracks infrared signal Link Group values received by this unit. Counter 1703 is cleared by END_LG signal 1022 which, as will be explained later, indicates that a complete Link Group has been received on the infrared input. Counter 1703 then is enabled by subsequent VALID_PC signal 1020 occurrences, thus maintaining a count of Pulse Cycles of the next Link Group. Eventually END_LG signal 1022 goes active again indicating that the end of the Link Group has occurred and END_LG signal 1022 not only clears counter 1703 again for the next Link Group, but also gates the comparison of counter 1703 output and LINK_NUM 1019. Thus, LINK_FOUND signal 1712 is active for only one clock period each Link Group occurrence, the duration of END_LG 1022. Counter 1703 is also cleared by INVALID_PC signal 1021 since this represents an errored reception.

LOS signal 1711 indicates a "Loss Of Signal" condition which is defined as a failure to detect the previous unit's Link Group number within a Link Cycle duration. Counter 1704 is cleared with each occurring LINK_FOUND signal 1712, but otherwise increments continuously each clock period, as long as RUN_EN enabling signal 1017 is active. Thus, counter 1704 represents the number of clocks that have occurred since the last occurrence of LINK_FOUND 1712 (or since the RUN_EN signal 1017 first went active). Register 1705 stores the output value of counter 1704 when Run State Machine 1701 is in the '1st Link Cycle' state, as indicated by 1ST_LINK_CYCLE signal 1720 being active, and LINK_FOUND signal 1712 is active. Since at this time counter 1704 began counting when RUN_EN 1017 first went active, and since RUN_EN 1017 was made to go active when the Link Cycle just finished had begun, i.e., by SYNC_FOUND 1016 from Sync Control function 1002, then it can be seen that the value stored in register 1705 represents the number of clocks of the just-finished Link Cycle. Further, since Run State Machine 1701 only passes through the '1st Link Cycle' state once after the unit goes into 'run' mode operation, the reader can see that the value stored in register 1705 remains unchanged for the duration of the 'run' mode of the unit. Subsequently, the value of counter 1704 is compared with 2.25 times the value of register 1705 and LOS signal 1711 goes active if they are equal. Thus, LOS 1711 is made active any time a LINK_FOUND 1712 has not occurred for more than two Link Cycle periods (two and a half Link Cycle periods, in fact). The arithmetic manipulation of the value of register 1705 to create the 2.25 multiplied amount for comparing with counter 1704 in comparitor 1709 is done by adding via adder 1708 an amount that is two times the value of register 1705 with an amount that is ¼ times the value of register 1705. The "two times" multiplication and "¼" division of the value of register 1705 are chosen since they can be implemented with simple one-position shift left and two-position shift right operations 1706 respectively. Register 1710 serves to de-glitch the relatively long combinatorial settling associated with the comparison of comparitor 1709.

Figure 22:
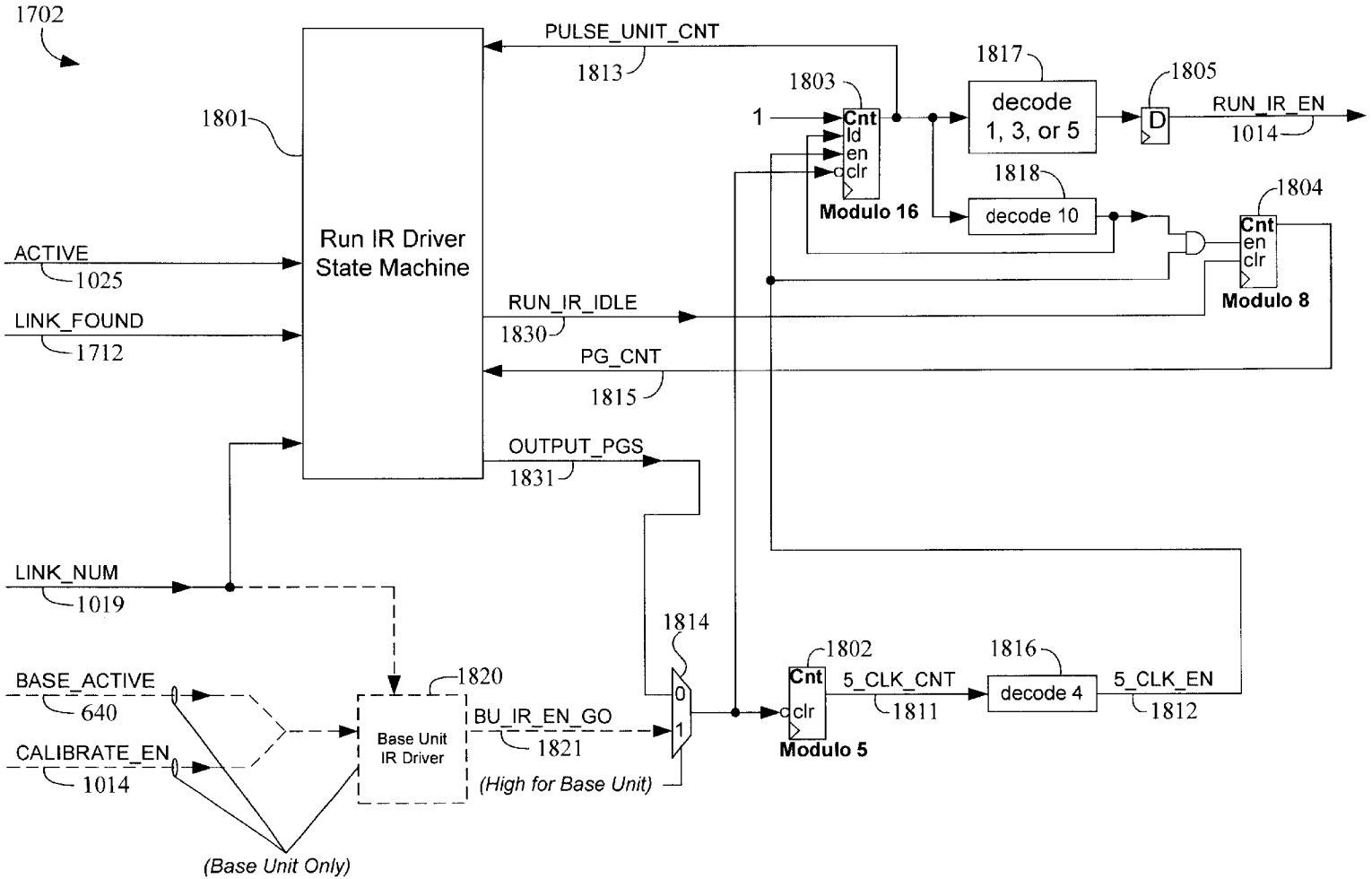
FIG. 22 illustrates the operation of the Run IR Driver block of FIG. 20.
Figure 23:
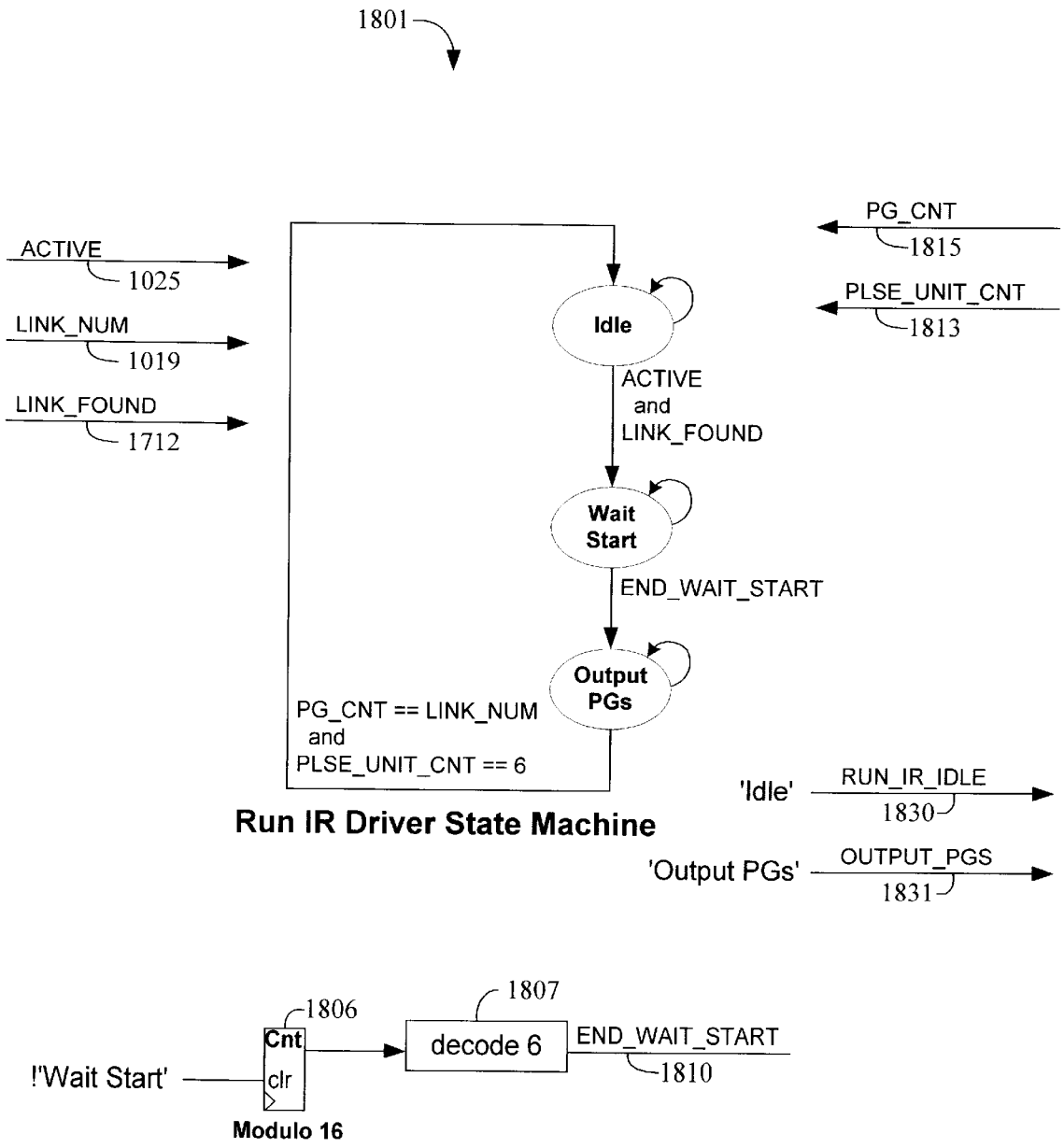
FIG. 23 illustrates the Run IR Driver State Machine of FIG. 22.
Figure 24:
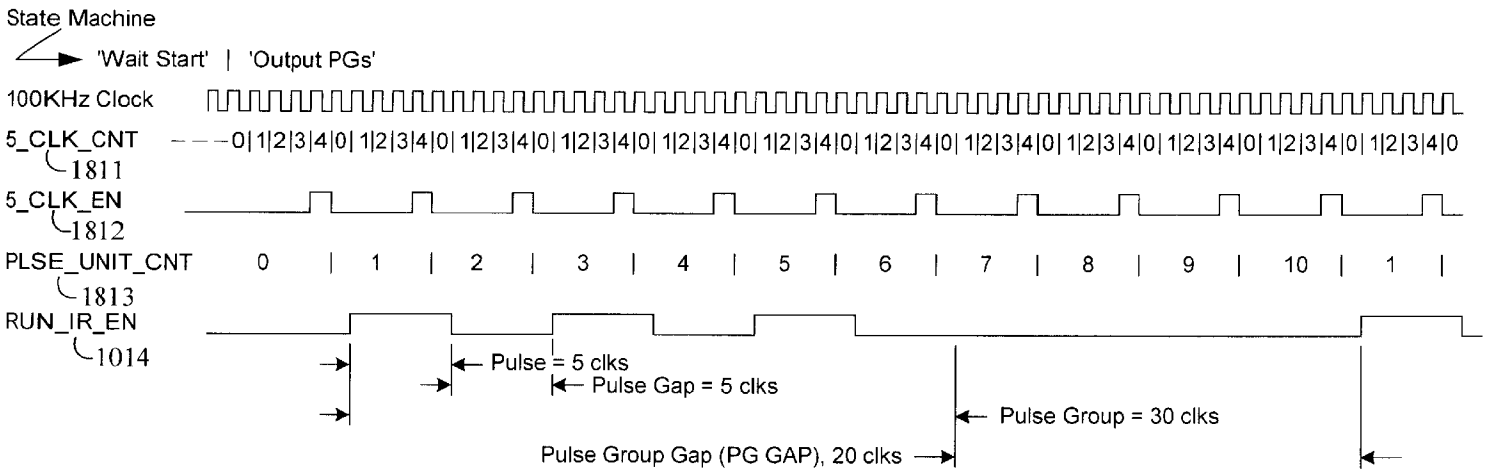
FIG. 24 illustrates yet further the form of the non-breached transmission signal for normal operation.

Run IR Driver, FIGS. 22, 23, and 24

Still referring to FIG. 20, when enabled by ACTIVE signal 1025 Run IR Driver function 1702 operates to generate RUN_IR_EN signal 1014 for infrared transmission for normal operation of this unit. This output signal consists of this unit's Pulse Group and is generated after the detection of the reception of the previous unit's Pulse Group as indicated by LINK_FOUND signal 1712. This unit's Pulse Group, in turn, is comprised of the encoded location of this unit in the perimeter as described during the discussion of FIGS. 5, 15, and 16, and is indicated by LINK_NUM signal 1019. FIG. 22 shows the operation of Run Control function 1003, FIG. 23 shows the operation of Run IR State Machine 1801, and FIG. 24 shows timing of associated control signals and the resulting RUN_IR_EN output signal 1014. Referring first to FIG. 23, when ACTIVE input signal 1025 goes active, Run IR Driver State Machine 1801 proceeds from the 'Idle' state to the 'Wait Start' state. The 'Wait Start' state allows counter 1806 to begin incrementing and six clocks later decoder 1807 causes END_WAIT_START signal 1810 to go active. These ten clocks are needed in order to complete the Inter-Pulse Cycle Gap. The total number of clocks between the last pulse of a Link Group and the first pulse of the next Link Group should be:

(5 clocks to finish the last Pulse Group)

+

(20 clocks for the last Pulse Group Gap)

+

(30 clocks for the Inter-Pulse Cycle Gap)

- - - total=55 clocks.

Since LINK_FOUND 1712 occurs 40 clocks after the last pulse of the last Pulse Group, and there are 5 clocks of delay before the first pulse of this unit's first Pulse Group, as will be explained shortly, and approximately four clocks of miscellaneous logic operation delay, Run IR Driver State Machine 1801 must wait 6 clocks before proceeding.

END_WAIT_START signal 1810 going active allows Run IR Driver State Machine 1801 to proceed to the 'Output PGs' state which marks the beginning of the generation of pulses for this unit's infrared transmission.

Now referring to FIG. 24, RUN_IR_EN signal 1014 can be divided into five-clock segments as indicated by 5_CLK_EN signal 1812, which, as will be explained shortly, is generated from a modulo-five count shown as 5_CLK_CNT signal 1811. PLSE_UNIT_CNT signal 1813, as will be explained shortly, increments each 5_CLK_EN signal 1812 occurrence and is then decoded during counts one, three, and five to produce the pulses for one Pulse Group.

Now referring to FIG. 22 it can be seen that the 'Output PGs' state of Run IR Driver State Machine 1801, as indicated by an active OUTPUT_PGS signal 1831, removes the clear input of both modulo-5 counter 1802 and modulo-16 counter Pulse Unit Counter 1803 via multiplexer 1814 which is passing the '0' input since this is not a Base Unit. This allows counter 1802 to immediately begin incrementing and a decode of its 'four' value via decoder 1816 produces 5_CLK_EN signal 1812 already identified in FIG. 24. Each occurrence of 5_CLK_EN signal 1812 then enables counter 1803 to increment by one. Counter 1803's output is then decoded via decoder 1817 for values of 1, 3, or 5, and registered by register 1805 to produce RUN_IR_EN 1014 output signal as shown in FIG. 24. When counter 1803 reaches a value of ten decoder 1818 causes it to be re-loaded with a value of one to begin a new Pulse Group generation. Additionally, when counter 1803 reaches a value of ten decoder 1818 causes modulo-8 counter 1804 to be incremented once since its count enable is gated with 5_CLK_EN signal 1812 which occurs for a duration of only one clock. Thus, counter 1804 tracks the number of Pulse Groups generated. LINK_NUM signal 1019, as explained earlier, indicates the Link Number of this unit. When counter 1804's output, PG_CNT signal 1815, matches LINK_NUM signal 1019, and counter 1803 has reached a value of six indicating that all three Pulses of this Pulse Group have been completed, Run IR Driver State Machine 1801 shown in FIG. 23 proceeds back to the 'Idle' state marking the completion of generation of this Pulse Group Cycle's pulses. The reader will understand that since counter 1804 starts at zero each time Run IR State Machine 1801 returns to the 'Idle' state as indicated by RUN_IR_IDLE signal 1830, the number of Pulse Groups output by this unit is one more than LINK_NUM value 1019 which, as has been previously explained, indicates the Link Number of the previous unit in the perimeter. Thus, the encoded perimeter position transmitted by this unit is one more than that of the previous unit as required.

When this unit is operating as a Base Unit the pulse generation circuitry of Run IR Driver block 1702 shown in FIG. 22 is not controlled by Run IR Driver State Machine 1801, but rather, by Base Unit IR Driver block 1820 since when the unit is operating as a Base Unit multiplexer 1814 is selecting BU_IR_EN_GO signal 1821. Base Unit IR Driver block 1820 is described later.

Figure 25:
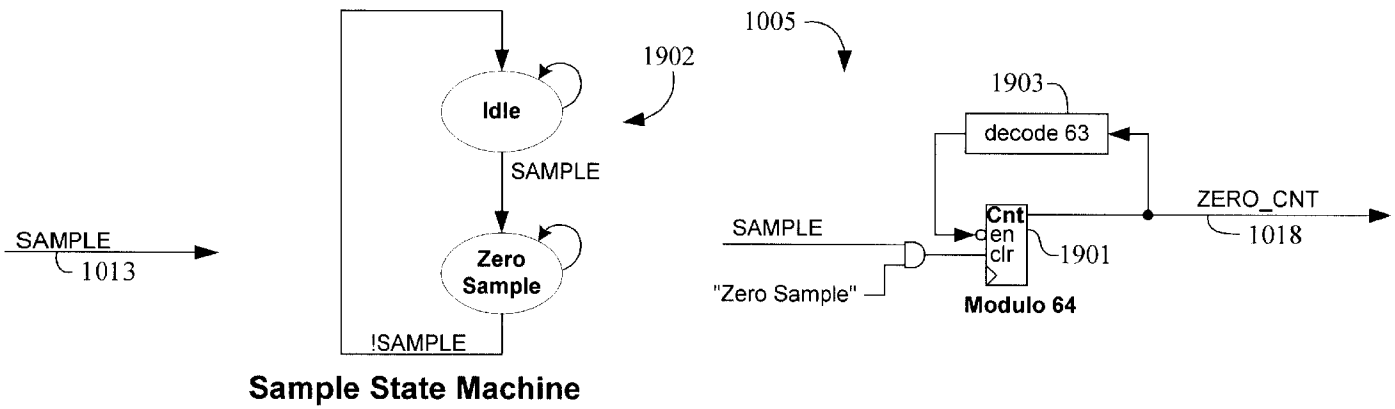
FIG. 25 illustrates the operation of the Zero Counter block of FIG. 9.

Zero Counter, FIG. 25

As was explained when describing the operations of Control Logic block 604 shown previously in FIG. 9, Zero Counter block 1005 provides a count value of consecutive non-pulse input samples and is used by Sync Control block 1002, and Pulse Cycle Detector 1006 blocks, all shown previously in FIG. 9. The operation of Zero Counter block 1005 is shown in FIG. 25. Modulo-64 counter 1901 increments as long as two consecutive active samples are not encountered, as will now be explained. Isolated active samples could be caused by spurious noise and may not indicate a pulse occurrence. Sample State Machine 1902 proceeds from the 'Idle' state to the 'Zero Sample' state whenever input SAMPLE signal 1013 is active and remains there until the SAMPLE signal goes inactive, whereby the state machine proceeds back to the 'Idle' state. Counter 1901 is cleared anytime the SAMPLE signal 1013 is active and Sample State Machine 1902 is in the 'Sample' state. Thus, counter 1901 is cleared any time two consecutive active SAMPLE signals 1013 are encountered. Since the size of counter 1901 must be practically limited, it is disabled by decoder 1903 when reaching a count of sixty-three, where it remains until cleared by two consecutive active SAMPLE signal 1013 occurrences.

Figure 26:
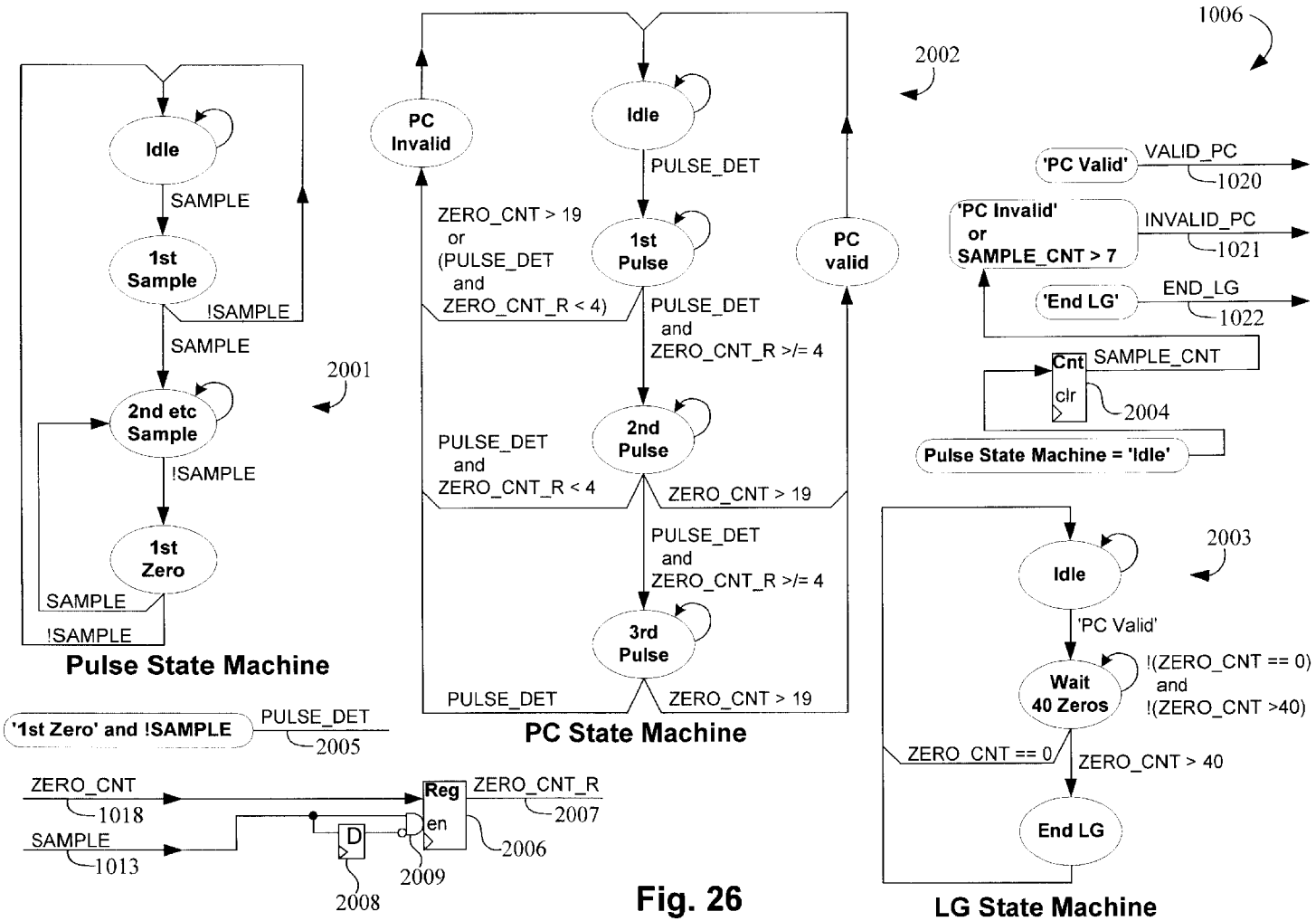
FIG. 26 illustrates the operation of the Pulse Cycle Detector block of FIG. 9.

Pulse Cycle Detector, FIG. 26

As was explained when describing the operations of Control Logic block 604 shown previously in FIG. 9, Pulse Cycle Detector block 1006 determines: 1) when a valid Pulse Cycle has been received, 2) when an invalid Pulse Cycle has been received, and 3) when the end of a Link Group has been received. FIG. 26 shows the operation of Pulse Cycle Detector block 1006. Pulse State Machine 2001 along with counter 2004 serves to identify individual valid pulse occurrences. A valid pulse is defined as beginning with two consecutive active SAMPLE signal 1013 inputs, ending with two consecutive inactive SAMPLE signal 1013 inputs, and containing no more than five clocks between and including the first and last active SAMPLE signals 1013. On the occurrence of an active SAMPLE signal 1013 Pulse State Machine 2001 proceeds from the 'Idle' state to the '$1^{st}$ Sample' state. If the next SAMPLE 1013 occurrence is not active then Pulse State Machine 2001 reverts back to the 'Idle' state since the first valid pulse criteria was not met. If, on the other hand, the next SAMPLE 1013 occurrence is active then Pulse State Machine 2001 proceeds to the '$2^{nd}$ etc Sample' state, where it remains as long as succeeding SAMPLE signal 1013 inputs are active. Upon the first occurrence of an inactive SAMPLE signal 1013 input Pulse State Machine 2001 proceeds to the '$1^{st}$ Zero' state. From here Pulse State Machine 2001 then proceeds either back to the '$2^{nd}$ etc Sample' state if the next SAMPLE signal 1013 input is active indicating a spuriously occurring non-pulse sample, or proceeds on to the original 'Idle' state if the next SAMPLE signal 1013 input is inactive since this indicates that two consecutive non-pulse samples have occurred and is defined as the end of a pulse. When Pulse State Machine 2001 is in state '$1^{st}$ Zero' and a non-active SAMPLE input 1013 occurs signal PULSE_DET signal 2005 is also made active indicating the end of a pulse.

PC State Machine 2002 identifies valid Pulse Cycles. A valid Pulse Cycle is defined as at least two valid pulses with more than three, but less than twenty consecutive inactive samples in between (representing the Pulse Group pulses), followed by twenty or more inactive samples (representing the Pulse Group Gap). PC State Machine 2002 proceeds from the 'Idle' state to the '1$^{st}$ Pulse' state when PULSE_DET signal 2005 just described is activated from Pulse State Machine 2001 indicating the occurrence of a valid pulse. PC State Machine 2002 proceeds to the 'PC Invalid' state and then back to the 'Idle' state if ZERO_CNT signal 1018 has a value greater than nineteen indicating an inactive period greater than is expected even if the middle of the three pulses of a Pulse Group were missing, or PULSE_DET signal 2005 goes active but the latched zero count ZERO_CNT_R signal 2007, to be explained shortly, has a value less than four indicating an inactive period less than is expected between any two pulses of a Pulse Group. Otherwise PC State Machine 2002 remains in the '1$^{st}$ Pulse' state until the PULSE_DET signal 2005 goes active and ZERO_CNT_R signal 2007 has a value greater than three indicating that a complete first pulse of a Pulse Group has occurred. In this case PC State Machine 2002 proceeds to the '2$^{nd}$ Pulse' state. From the '2$^{nd}$ Pulse' state PC State Machine 2002 proceeds back to the 'PC Invalid' and then the 'Idle' state if PULSE_DET signal 2005 goes active and ZERO_CNT_R signal 2007 has a value less than four indicating, again, an inactive period less than is expected between any two pulses of a Pulse Group. If, however, PULSE_DET signal 2005 goes active and ZERO_CNT_R signal 2007 has a value greater than three indicating the end of a second valid Pulse Group pulse PC State Machine 2002 proceeds to the '3$^{rd}$ Pulse' state. Finally from the '2$^{nd}$ Pulse' state, if ZERO_CNT signal 1018 has a value greater than nineteen indicating the end of the Pulse Cycle, PC State Machine 2002 proceeds to the 'PC Valid' state and then proceeds back to the 'Idle' state. This occurs if only two of the three pulses of this Pulse Group were received, the third presumably being lost in transmission. From the '3$^{rd}$ Pulse' state PC State Machine 2002 proceeds again to the 'PC Valid' state if ZERO_CNT signal 1018 has a value greater than nineteen indicating the end of the Pulse Cycle. Otherwise, if PULSE_DET signal 2005 goes active PC State Machine 2002 proceeds to the 'PC Invalid' state since this indicates four pulses, one too many for a valid Pulse Group of a Pulse Cycle.

ZERO_CNT_R signal 2007 referred to in the previous paragraph consists of ZERO_CNT signal 1018 latched at the first active occurrence of SAMPLE signal 1013 since this same active SAMPLE signal will clear ZERO_CNT signal 1018 value, yet PC State Machine 2002 requires its use at a later time (when PULSE_DET signal 2005 goes active). Register 2008 and AND gate 2009 serve to enable latch 2006 during the first clock period when SAMPLE signal 1013 is high since, as has just been explained, ZERO_CNT signal 1018 will be cleared to zero on the next clock period after that.

Whereas PC State Machine 2002 detected valid Pulse Cycles, LG State Machine 2003 identifies the ends of Link Groups. This is done by identifying more than forty inactive samples after a valid Pulse Cycle has occurred since the gap between Pulse Groups (i.e., Pulse Group Gaps) is approximately twenty-five clock periods in duration, whereas the gap between Link Groups (i.e., Link Group Gaps) is approximately fifty-five clock periods. From the 'Idle' state LG State Machine 2003 proceeds to the 'Wait 40 Zeros' state if PC State Machine 2002 passes through the 'PC Valid' state, indicating that a valid Pulse Cycle has been detected. From the 'Wait 40 Zeros' state LG State Machine 2003 proceeds back to the 'Idle' state if the value of ZERO_CNT signal 1018 becomes zero, indicating that sample activity has been detected, presumably due to the beginning of another Pulse Cycle. Otherwise when ZERO_CNT signal 1018 value reaches more than forty LG State Machine 2003 proceeds to the 'End LG' state for one clock period, indicating the identification of the end of a Link Group, then back to the 'Idle' state to wait for new Pulse Cycle occurrences.

VALID_PC signal 1020 goes active when PC State Machine 2002 passes through the 'PC Valid' state indicating the identification of a valid Pulse Cycle. INVALID_PC signal 1021 goes active when PC State Machine 2002 passes through the 'PC Invalid' state, or counter 2004 reaches a value greater than seven, both conditions indicating pulse activity that does not meet the requirements for a valid Pulse Cycle. Finally, END_LG signal 1022 goes active when LG State Machine 2003 passes through the 'End LG' state indicating the identification of the end of a Link Group.

Figure 27:
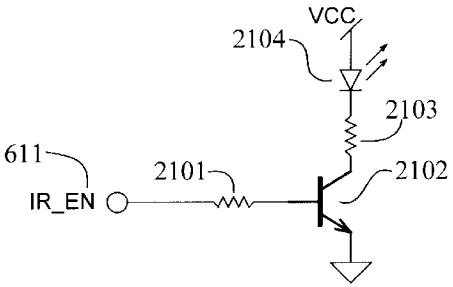
FIG. 27 illustrates details of the IR Source block of FIG. 6.

IR Source, FIG. 27

In FIG. 9 it was shown previously that CALIB_IR_EN signal 1013 generated by the Calibration Control block 1001 or RUN_IR_EN signal 1014 generated by the Run Control block 1003 will activate IR_EN signal 611 which, as was seen in FIG. 6, is provided to IR Source function 607 for translation into infrared transmission energy. FIG. 27 shows how IR Source block 607 achieves this. When IR_EN signal 611 goes active, i.e., when its voltage is near VCC, transistor 2102 is turned on and saturated. Resistor 2101 limits the transistor's base current in order to avoid damaging it. When IR_EN signal 611 saturates transistor 2102 current is drawn through forward-biased IR LED 2104 causing the IR LED to emit infrared energy. Resistor 2103 limits the collector current of the transistor and the IR LED in order to avoid damaging either. In these preferred embodiments resistor 2103 is minimized in order to maximize the IR energy emitted by the unit, and therefore also maximizing the distance that units in the link can be separated from each other. The reader will understand that other embodiments might increase the value of resistor 2103 in order to lengthen battery life of portable perimeter units at the possible expense of maximum distance between them.

Figure 28:
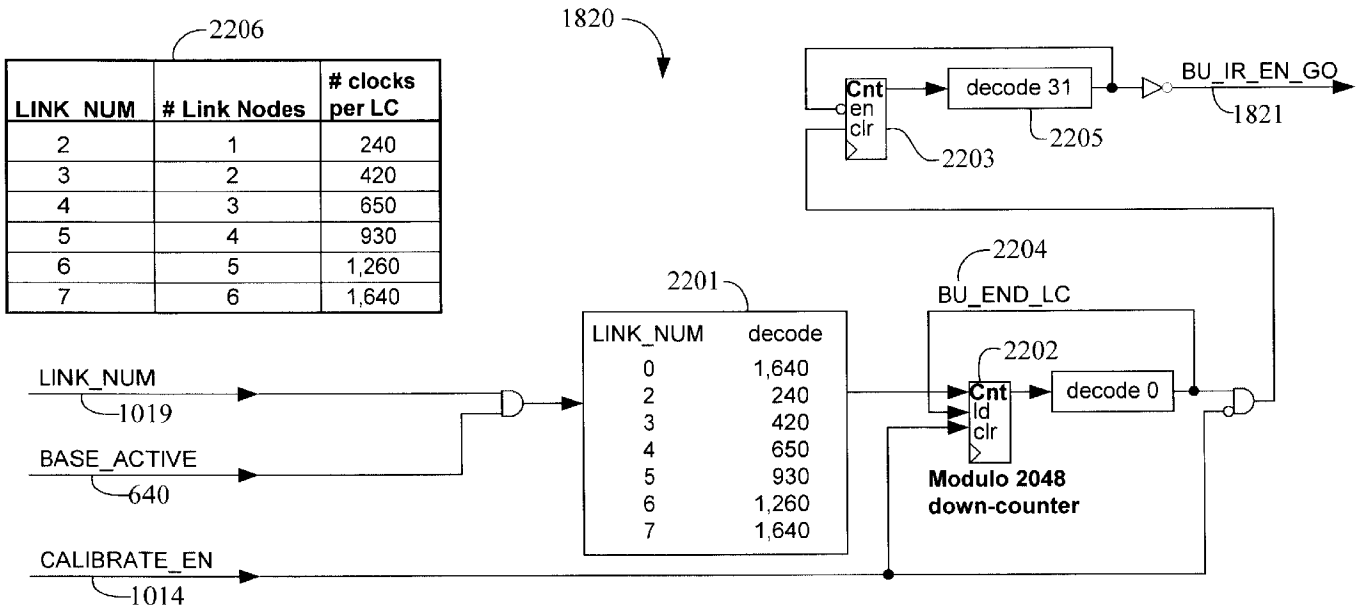
FIG. 28 illustrates the operation of the Base Unit IR Driver block of FIG. 22.

Base Unit IR Driver, FIG. 28

In FIG. 22 it was previously shown that the control of RUN_IR_EN signal 1014 generation in Base Units was done by Base Unit IR Driver function 1820 rather than Run IR Driver State Machine 1801 which is used in Link Units. Base Unit IR Driver block 1820 produces the first Link Group (consisting of a single Pulse Cycle) of a Link Cycle whenever it is operating in the Sync or Run modes, and regardless of whether a link has been recognized from any Link Unit in the perimeter. As was previously explained, this is required for proper operation of the security perimeter since a starting source of Link Cycles is always needed whether Link Units are in the Run or Sync modes—for initiating the perimeter Sync mode process, for starting the perimeter after transition from the Sync mode to the Run mode, and to re-establish the perimeter after a link break has been restored. Since Base Unit IR Driver block 1820 must generate Link Groups in both the Sync and Run modes, Base Unit IR Driver block 1820 is disabled during the Calibrate mode, but otherwise is always enabled. For this reason CALIBRATE_EN signal 1014 is provided to Base Unit IR Driver block 1820. CALIBRATE_EN signal 1014, as was previously explained, is generated by Mode State Machine 1007 and when active indicates that the unit has not yet been taken out of the Calibration mode. As will be explained in the next paragraph, when CALIBRATE_EN signal 1014 is inactive, indicating that the Base Unit has been taken out of Calibration mode, Base Unit IR Driver block 1820 generates Link Cycles of maximum length (i.e., as though there are six Link Units comprising the perimeter) until BASE_ACTIVE signal 640 goes active, at which time Base Unit IR Driver block 1820 then generates a Link Cycle of a length appropriate to LINK_NUM signal 1019, which indicates the link position of the last Link Unit of the perimeter since the user will presumably activate BASE_ACTIVE signal 640 via the switch shown in FIG. 6 after all the Link Units in the perimeter have found synchronization. In this way the Base Unit provides a maximal length Link Cycle for clear perimeter Link Unit synchronization, yet generates the minimum length Link Cycle during normal operation to minimize the time for which a link break will be guaranteed to be detected.

BASE_ACTIVE signal 640 also enables the generation of ALARM signal 630 for Base Units, shown in FIG. 9. This is necessary since otherwise an alarm indication might be unnecessarily generated while the perimeter synchronization process is occurring.

The reader is now referred to FIG. 28 which shows the operation of Base Unit IR Driver block 1820. When CALIBRATE_EN signal 1014 is inactive, indicating that the user has moved the device mode switch from the 'calibrate' to the 'sync' position, and when BASE_ACTIVE signal 640 is also inactive, indicating that the user has not yet moved_the Base Unit-specific mode switch to the 'run' position, counter 2202 decrements freely, loading a value of 1640 when it reaches zero, since an inactive BASE_ACTIVE signal 640 forces a zero value for LINK_NUM 1019 in lookup table 2201. Thus, in this mode counter 2202 functions as a modulo 1641 counter with BU_END_LC signal 2204 going active one clock period every 1641 as the zero value is decoded prior to a new counter load. Each time BU_END_LC signal 2204 goes active counter 2203 is cleared which allows it to increment thirty-one times until it is disabled by decode function 2205. Thus, once each 1640 clock periods BU_IR_EN_GO signal 1821 goes active for thirty-one clocks, i.e., when counter 2203 is counting between the values of zero and thirty. As was described earlier, BU_IR_EN_GO signal 1821 enables the generation of Pulse signals as shown in FIG. 22. From FIG. 24 it was seen that if BU_IR_EN_GO signal 1821 enables the circuitry for thirty-one clocks one complete Pulse Group is generated. This corresponds to the Base Unit's Link Group and comprises the beginning of the perimeter Link Cycle that is 1641 clocks long.

When the user moves the Base Unit's mode switch from the 'sync' to the 'run' position, presumably after the last Link Unit in the perimeter and the Base Unit have both acquired sync, counter 2202 is loaded by a count that is determined by LINK_NUM signal 1019. Thus, when the Base Unit is placed into its 'run' mode it generates a Link Cycle of a length as shown in table 2201. In this way the Base Unit generates Link Cycles that are only as long as is needed for the number of Link Units in the perimeter, as is shown in table 2206.

Second Preferred Embodiment

Whereas the first preferred embodiment operates such that a break of any link in the secure perimeter causes the transmission of all subsequent links in the perimeter to be inhibited thus altering the Base Unit of a perimeter break, the second preferred embodiment operates to not only alert the Base Unit of a perimeter break, but to also communicate to the Base Unit which link has been breached. Operation of the second preferred embodiment is the same as the first embodiment for the initial phases comprising calibration, node synchronization, and un-breached operation of the perimeter as was explained previously. Upon a link of the secure perimeter being broken in the second preferred embodiment, however, rather than suppressing subsequent links in a breached perimeter, each perimeter node subsequent to the broken link transmits a unique alarm flag along with the perimeter location of the node immediately following the broken link. As will be explained in more detail shortly, a node, upon detecting a broken link via a loss of received infrared energy from the previous node in the perimeter, operates to cease its transmission of its perimeter location indication as was previously described in the first embodiment, and, instead, transmits a unique alarm indication signal, referred to herein as an Alarm Flag, along with its perimeter location indication signal which has the same form as in the first preferred embodiment, i.e., consisting of a Link Group comprised of a quantity of Pulse Groups equal to the node's position in the perimeter. Upon detecting an Alarm Flag signal, each subsequent node in the perimeter stores the subsequent perimeter location indication signal and then itself operates to transmit to the next node in the perimeter an Alarm Flag followed by the same perimeter location indication signal which it had received from the node and stored. In this way communication of both the fact that the perimeter has been breached, as well as the breach location is carried around the perimeter to the Base Unit. Reception of an Alarm Flag signal by the Base Unit is then interpreted as a perimeter breach, and the subsequent perimeter location indication signal is used to present an identification of the breach location.

As will be understood from the explanations of the following paragraphs, the second preferred embodiment operates much the same as the first preferred embodiment, but with some additional functions associated with perimeter breaches.

Figure 29:
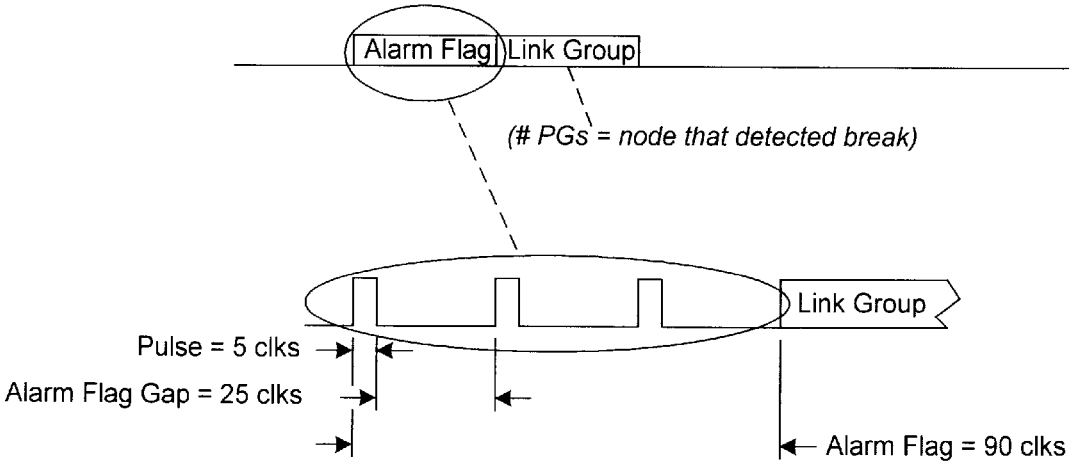
FIG. 29 illustrates the alarm signal as used in a second preferred embodiment.

Alarm Signal of the Second Preferred Embodiment, FIG. 29

FIG. 29 shows the form of the alarm signal transmitted by each node subsequent to a perimeter breach. As can be seen, the alarm signal is comprised of two parts: an Alarm Flag, followed immediately by a Link Group which has the same form as described previously in the explanation of the first preferred embodiment. Here the Link Group consists of a quantity of Pulse Groups which matches the perimeter location of the node detecting the perimeter breach. The reader should note that this Link Group is the same as is transmitted by the node subsequent to the breach when the perimeter is operating normally with no breaches.

FIG. 29 also shows the composition of an Alarm Flag signal, the details of which are broken out in the circled area. Whereas the pulses of both the calibration signal and the Pulse Groups shown previously in FIGS. 11 and FIG. 15, respectively, are separated by five clocks, as can be seen in FIG. 29, the pulses of an Alarm Flag are separated by twenty-five clocks. Thus, an Alarm Flag will not be mistaken for regular Pulse Groups since, as was seen previously in FIG. 26, detection of a Pulse Group requires consecutive pulses separated by no more than nineteen clocks. Since an Alarm Flag consists of three pulses each followed by twenty-five clock periods of inactivity, an Alarm Flag is a total of ninety clock periods in length.

Figure 30:
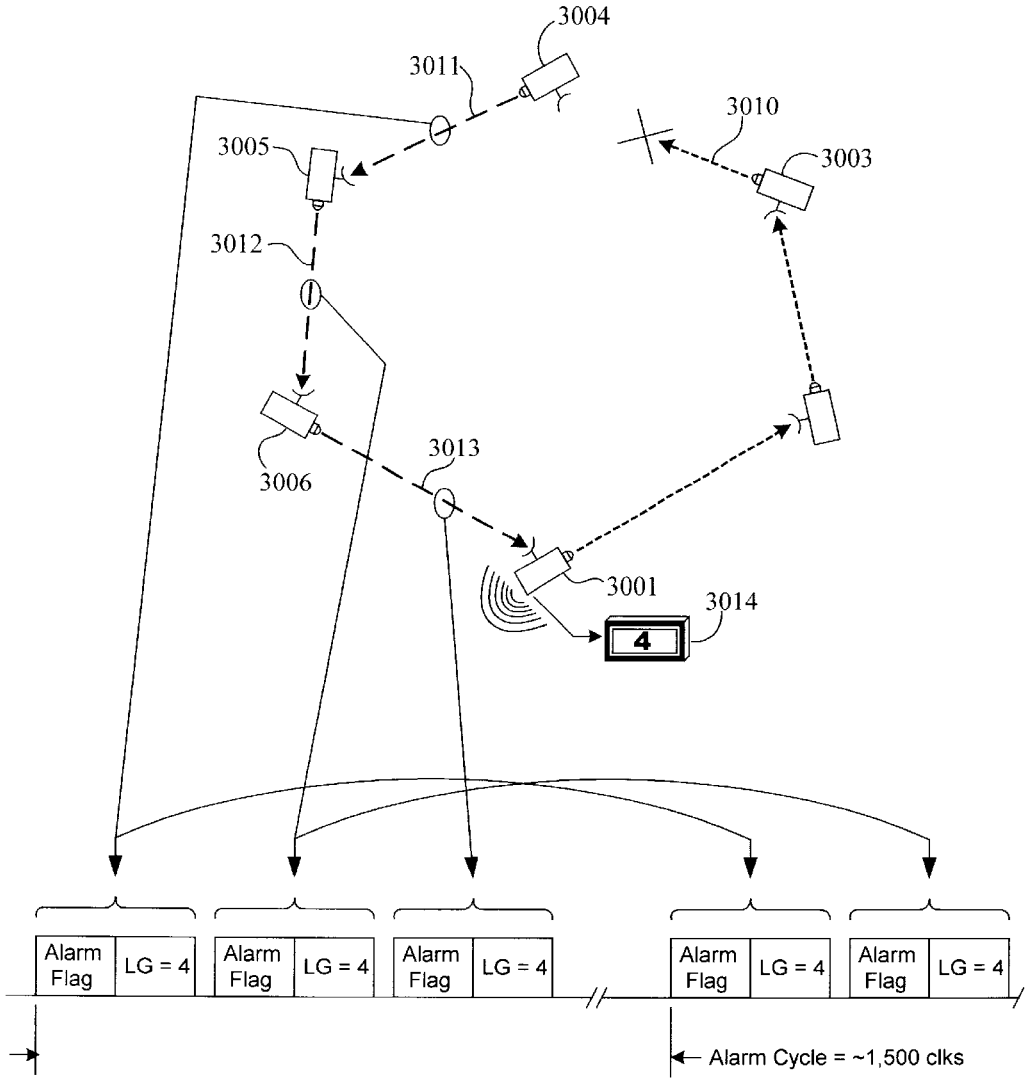
FIG. 30 illustrates the operation of the second preferred embodiment.

Breached Perimeter Operation of the Second Preferred Embodiment, FIG. 30

FIG. 30 shows an example of the operation of the perimeter of the second preferred embodiment when a breach occurs. In this example the perimeter is comprised of six nodes and the breach occurs between the third node, 3003, and the fourth node, 3004, disrupting node 3003's infrared transmission 3010. Node unit 3004, upon detecting a broken link in the same fashion as was described in the previous explanation of the first preferred embodiment, transmits alarm signal 3011 which consists of an Alarm Flag and Link Group as was just described and shown in FIG. 29. The Link Group in this example consists of four Pulse Groups since node 3004 holds the fourth position in the perimeter, where the Base Unit is the first. After the fifth node, 3005, detects alarm signal 3011 transmitted by node 3004, it then also transmits a similar alarm signal 3012 consisting of an Alarm flag and the same Link Group which it had stored when received from node 3004. Similarly, when node 3006 detects alarm signal 3012 transmitted by node 3005 it too then transmits a similar alarm signal 3013 consisting of an Alarm flag and the same Link Group. Finally, when Base Unit 3001 detects alarm signal 3013 transmitted by node 3006 it provides, as in the first preferred embodiment, an alarm indication of a perimeter breach, in this example again an audible alarm, as well as presents a hexadecimal visual indication, 3014, of the binary four representation, '100', i.e., the numeral '4', which matches the node location of the detecting breach node 3004 and is also the Link Group value passed around the perimeter to the Base Unit. The reader will understand that although this example of the second preferred embodiment presents the node breach location via a visual display, the node breach location information could be used in other ways as well, such as being transferred, along with the alarm indication, to a central control area where general surveillance might be made over a wider area, of which this secure perimeter would be only one part.

Node 3004 continues to transmit an alarm signal at approximately 1,500 clock period intervals, consequently causing each subsequent node to do the same, as long as it continues to detect a broken link. In this way an indication of a perimeter breach is passed to the Base Unit until the link is restored, at which time node 3004 resumes its normal transmission and all the nodes of the entire perimeter in turn revert back to their normal, un-breached operation as described previously in the first preferred embodiment. A quantity of approximately 1,500 clock periods is chosen since this is long enough to allow the consecutive transmission of alarm flags by nodes for all possible link break locations (noting that an early perimeter break contains a shorter duration Link Group, but a greater quantity of propagated alarm signals, whereas a later perimeter break contains a longer duration Link Group, but a lesser quantity of propagated alarm signals), yet not so long so as to cause the Base Unit to erroneously declare a link loss due to un-received infrared transmission.

Figure 31:
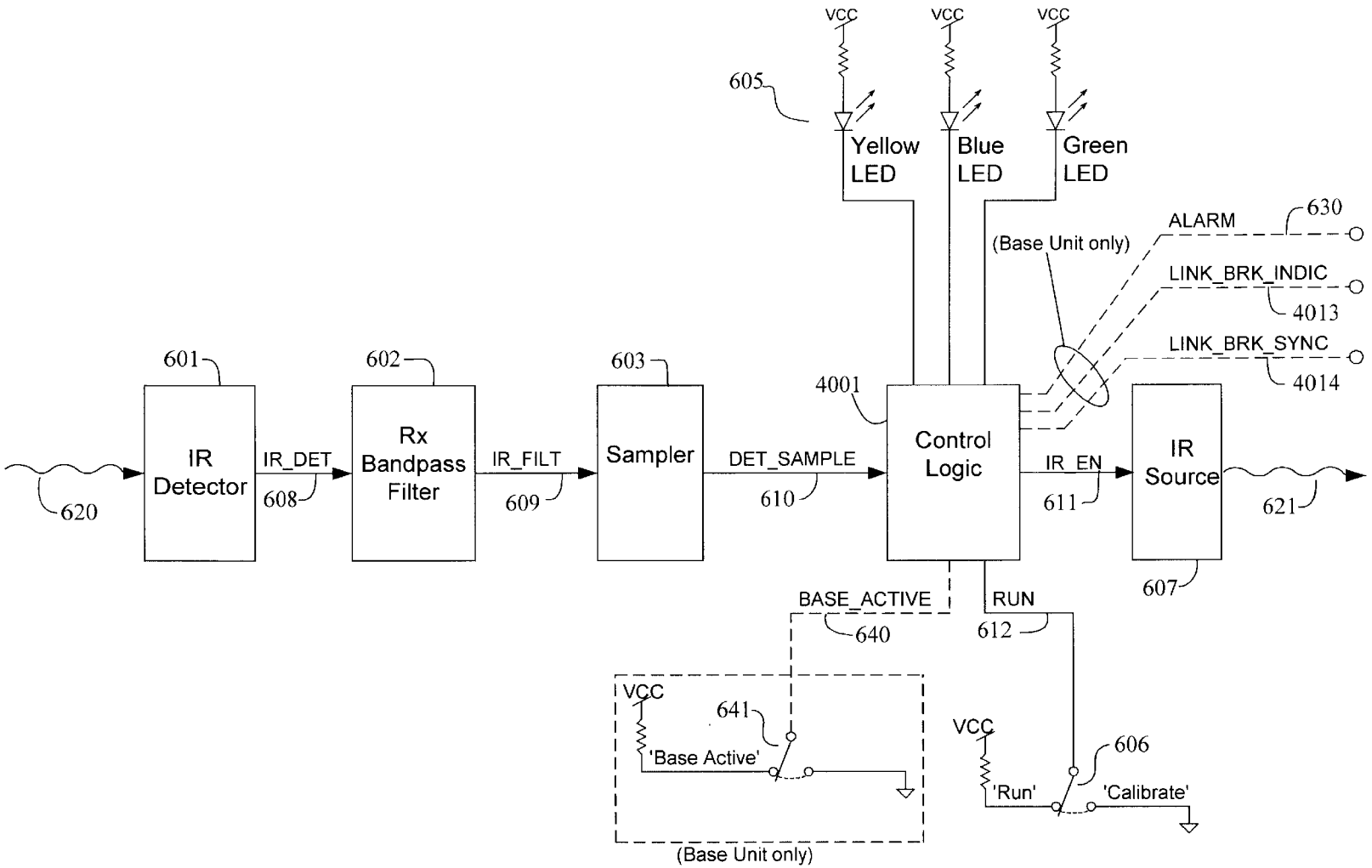
FIG. 31 is a block diagram of the second preferred embodiment of the invention.

Block Diagram of the Second Preferred Embodiment, FIG. 31

FIG. 31 shows a functional breakdown of a device unit according to a second preferred embodiment. The reader will note that this block diagram is the same as the functional block diagram of the first preferred embodiment previously shown in FIG. 6 with the exception that there is a different Control Logic block 4001 from which is generated, for Base Unit devices, link break indication LINK_BRK_INDIC signal 4013 and its associated enable signal LINK_BRK_SYNC 4014. Since all the other block functions operate the same as the first embodiment which has already been explained, only the new block, Control Logic 4001, will now be described.

Figure 32:
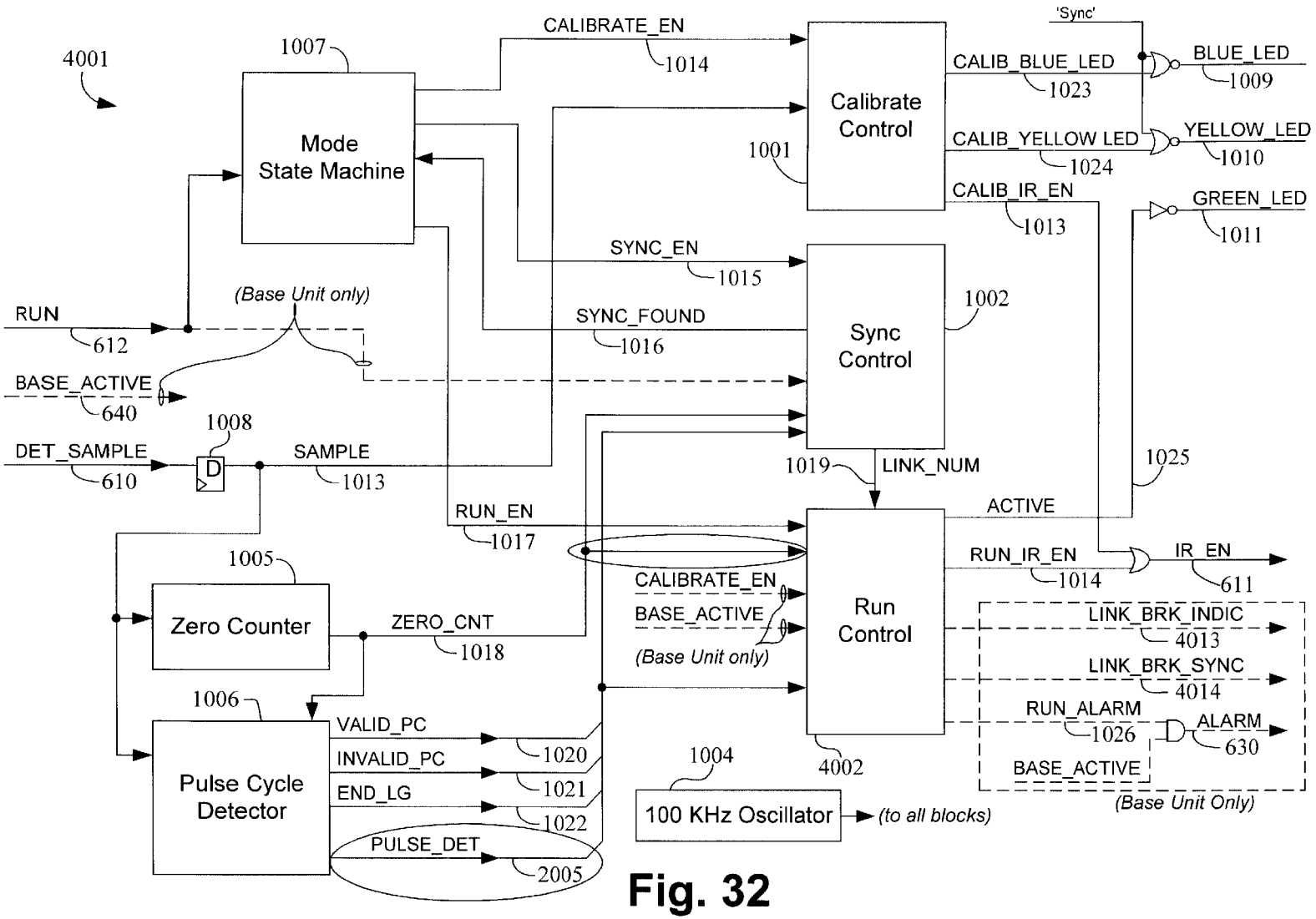
FIG. 32 is a block diagram of the Control Logic of FIG. 31.

Control Logic Block Diagram of the Second Preferred Embodiment, FIG. 32

FIG. 32 shows a functional breakdown of Control Logic block 4001 of the second preferred embodiment. The reader will note that this block diagram is the same as Control Logic block 604 of the first preferred embodiment previously shown in FIG. 9 with the exception that there is a different Run Control block 4002 from which is generated, for Base Unit devices, link break indication LINK_BRK_INDIC signal 4013 and its associated enable signal LINK_BRK_SYNC 4014. Run Control block 4002 additionally has two signals presented to it which were not presented to Run Control block 1003 of the first embodiment. These are ZERO_CNT 1018, and PULSE_DET 2005 which is generated in Pulse Cycle Detector block 1006. Since all the other block functions operate the same as the first embodiment which has already been explained, only the new block, Run Control block 4002, will now be described.

Figure 33:
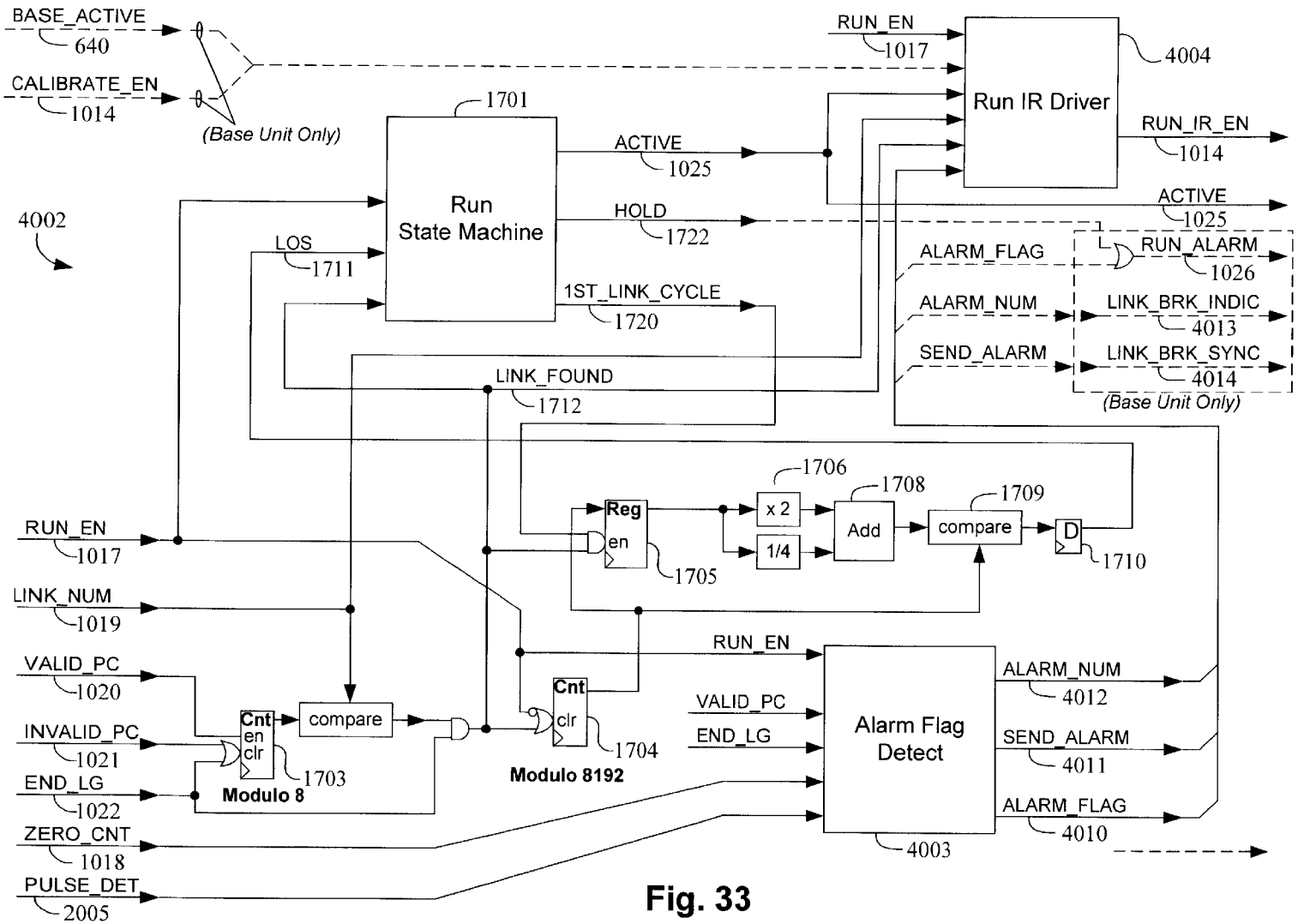
FIG. 33 is a block diagram of the Run Control of FIG. 32.

Run Control Block Diagram of the Second Preferred Embodiment, FIG. 33

FIG. 33 shows the functional operation of Run Control block 4002 of the second preferred embodiment. Comparing this figure with that of FIG. 20 showing the associated function of the first preferred embodiment the reader will understand that the difference between them is that FIG. 33 of the second embodiment contains a different Run IR Driver block 4004 and a new Alarm Flag Detect block 4003. As will be explained shortly, this new Alarm Flag Detect block 4003 uses existing signals RUN_EN 1017, VALID_PC 1020, END_LG 1022, ZERO_CNT 1018, and PULSE_DET 2005 to detect when an Alarm Flag, shown previously in FIG. 29, has been received. In response to a detection of an Alarm Flag, Alarm Flag Detect block 4003 activates three new signals: ALARM_NUM 4012, SEND_ALARM 4011, and ALARM_FLAG 4010, all of which are provided to Run IR Driver block 4004. ALARM_FLAG signal 4010 is made active to indicate that an Alarm Flag has been detected, ALARM_NUM signal 4012 indicates a binary representation of the Link Group number that was received immediately following the received Alarm Flag, i.e., the perimeter location of the node subsequent to the broken link as has already been explained and was shown in FIG. 29, and SEND_ALARM signal 4011 is an indication that the complete alarm signal, consisting of both an Alarm Flag and a Link Group, has been received and that this node's alarm signal can now be generated. Explanations of the generation of all three of these signals follow shortly. These three new signals are provided to Run IR Driver block 4004 which ceases normal generation of this node's perimeter signal when an active ALARM_FLAG 4010 is received, and instead uses the binary value presented by ALARM_NUM 4012 to generate this node's alarm signal when SEND_ALARM signal 4011 is activated. Additionally, as will be explained, Run IR Driver block 4004 uses existing signal RUN_EN 1017 to enable overall generation of the alarm signal.

Since all the other block functions, except for Alarm Flag Detect 4003 and Run IR Driver 4004, operate the same as the first embodiment which has already been explained, only these two exceptional blocks will be described, with Alarm Flag Detect 4003 being the first.

Figure 34:
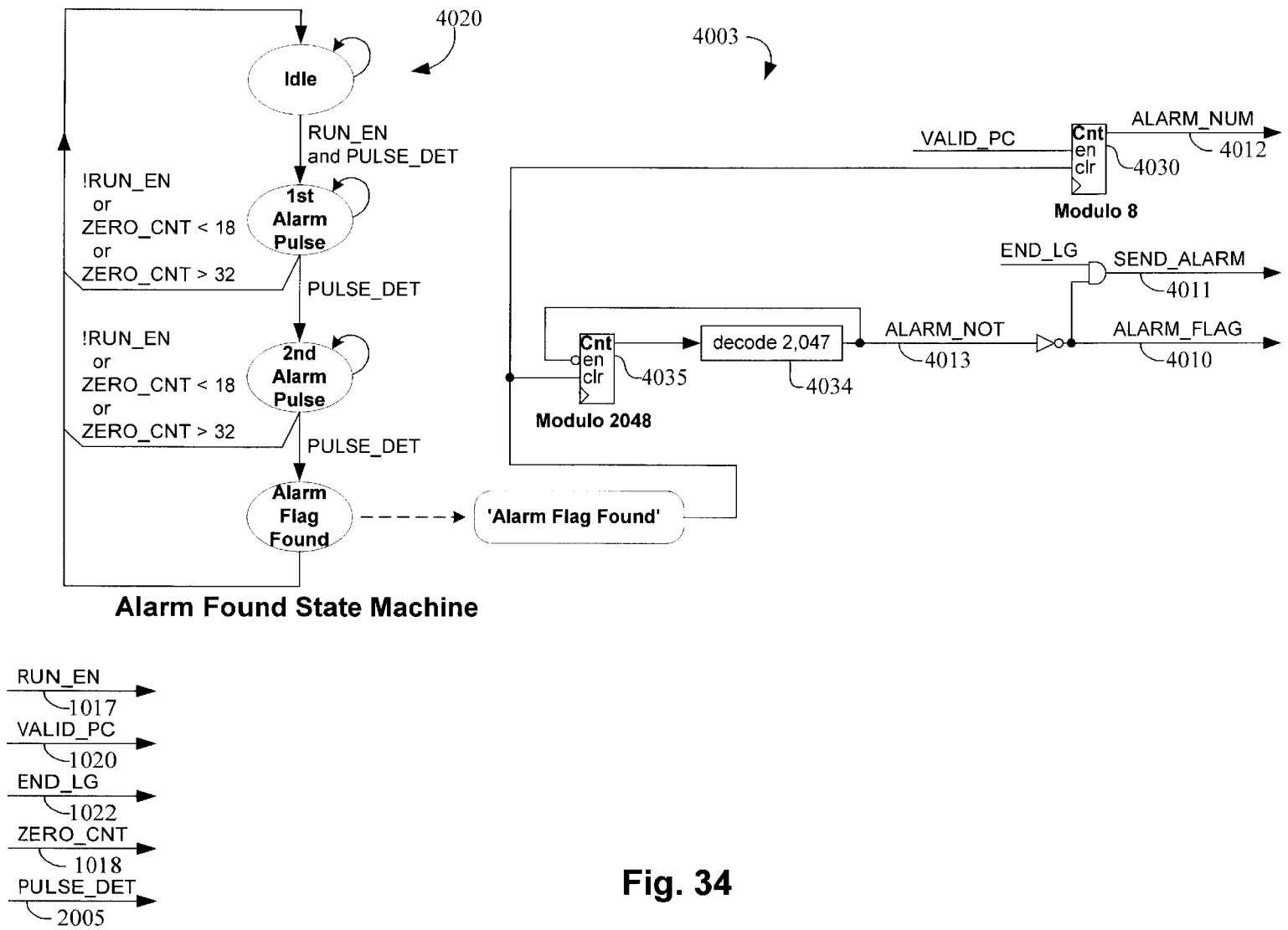
FIG. 34 illustrates the operation of the Alarm Flag Detect block of FIG. 33.

Alarm Flag Detect Block, FIG. 34

As was just explained, Alarm Flag Detect block 4003 detects when an Alarm Flag has been received and, in response, activates ALARM_FLAG signal 4010 to indicate that an Alarm Flag has been detected, presents a binary representation of the Link Group number, via ALARM_NUM signal 4012, which was contained in the received alarm signal, and indicates, via SEND_ALARM signal 4011, that the complete alarm signal has been received and that this node's alarm signal can now be generated. FIG. 34 shows the operation of Alarm Flag Detect block 4003. Alarm Found State Machine 4020 controls the detection of the Alarm Flag portion of the alarm signal. Normally, for example after a period of non-alarm operation, Alarm Found State Machine 4020 is in the 'Idle' state. If RUN_EN signal 1017 is active, indicating that the device has been placed in the run mode, then a first occurrence of a valid pulse, as indicated by PULSE_DET signal 2005 being active, causes Alarm Found State Machine 4020 to transition to the '1$^{st}$ Alarm Pulse' state. From here Alarm Found State Machine 4020 transitions to the '2$^{nd}$ Alarm Pulse' state if a second pulse occurs, again as indicated by RUN_EN signal 1017, in a form as defined for an Alarm Flag as shown previously in FIG. 29, i.e., that the second pulse occurs approximately twenty-five clocks after the end of the first. Thus, if the second pulse occurs less than eighteen clocks after the first pulse, as indicated by ZERO_CNT signal 1018 containing a value less than eighteen, or more than thirty-two clocks, as indicated by ZERO_CNT signal 1018 containing a value greater than thirty-two, then Alarm Found State Machine 4020 transitions back to the 'Idle' state to wait again for the beginning of a first pulse that may be part of a valid Alarm Flag.

From the '2$^{nd}$ Alarm Pulse' state Alarm Found State Machine 4020 then transitions to the last 'Alarm Flag Found' state under similar conditions for which the state machine transitioned from the '1$^{st}$ Alarm Pulse' to the '2$^{nd}$ Alarm Pulse', i.e., because a third pulse has been detected that falls within the Alarm Flag definition as just explained. Otherwise, as with the previous '1$^{st}$ Alarm Pulse' state, Alarm Found State Machine 4020 transitions back to the 'Idle' state. Passage of Alarm Found State Machine 4020 through the 'Alarm Flag Found' indicates that a valid Alarm Flag has been detected since three consecutive pulses have now occurred that fall within the definition of an Alarm Flag as shown previously in FIG. 29.

Passage of Alarm Found State Machine 4020 through the 'Alarm Flag Found', indicating that a valid Alarm Flag has been detected, clears modulo 2048 counter 4035 which then begins counting. Once counter 4035 is cleared and begins counting, ALARM_NOT signal 4013 goes low and remains low until counter 4035 reaches its terminal count of 2,047 and is disabled. Thus, ALARM_NOT signal 4013 is active (low) for 2,047 cocks after an Alarm Flag is detected. The reader will note that subsequent detected Alarm Flags will again clear counter 4035 so that ALARM_NOT signal 4013 will be continually active as long as Alarm Flags are received less than 2,047 clocks apart. Modulo 8 counter 4030 is also cleared when Alarm Found State Machine 4020 passes through the 'Alarm Flag Found' and then is subsequently enabled each time VLAID_PC signal 1020 goes active indicating that a valid Pulse Cycle has been detected. Thus when END_LG signal 1022 goes active, indicating the end of a Link Group occurrence, counter 4030's output, ALARM_NUM signal 4012, indicates the Link Group value that followed the received Alarm Flag, i.e., the quantity of valid pulses following the Alarm Flag. If ALARM_NOT signal 4013 is low, forcing ALARM_FLAG signal 4010 high, when END_LG signal 1022 goes active, SEND_ALARM signal 4011 goes active indicating that an alarm signal Link Group has occurred, and that ALARM_NUM signal 4012 contains the alarm signal Link Group value. ALARM_FLAG signal 4010 goes active (high) after a first Alarm Flag is received and remains active continuously as long as valid alarm signals are received by this node. Thus the reader will understand that ALARM_FLAG signal 4010 defines a general overall alarm state.

Figure 35:
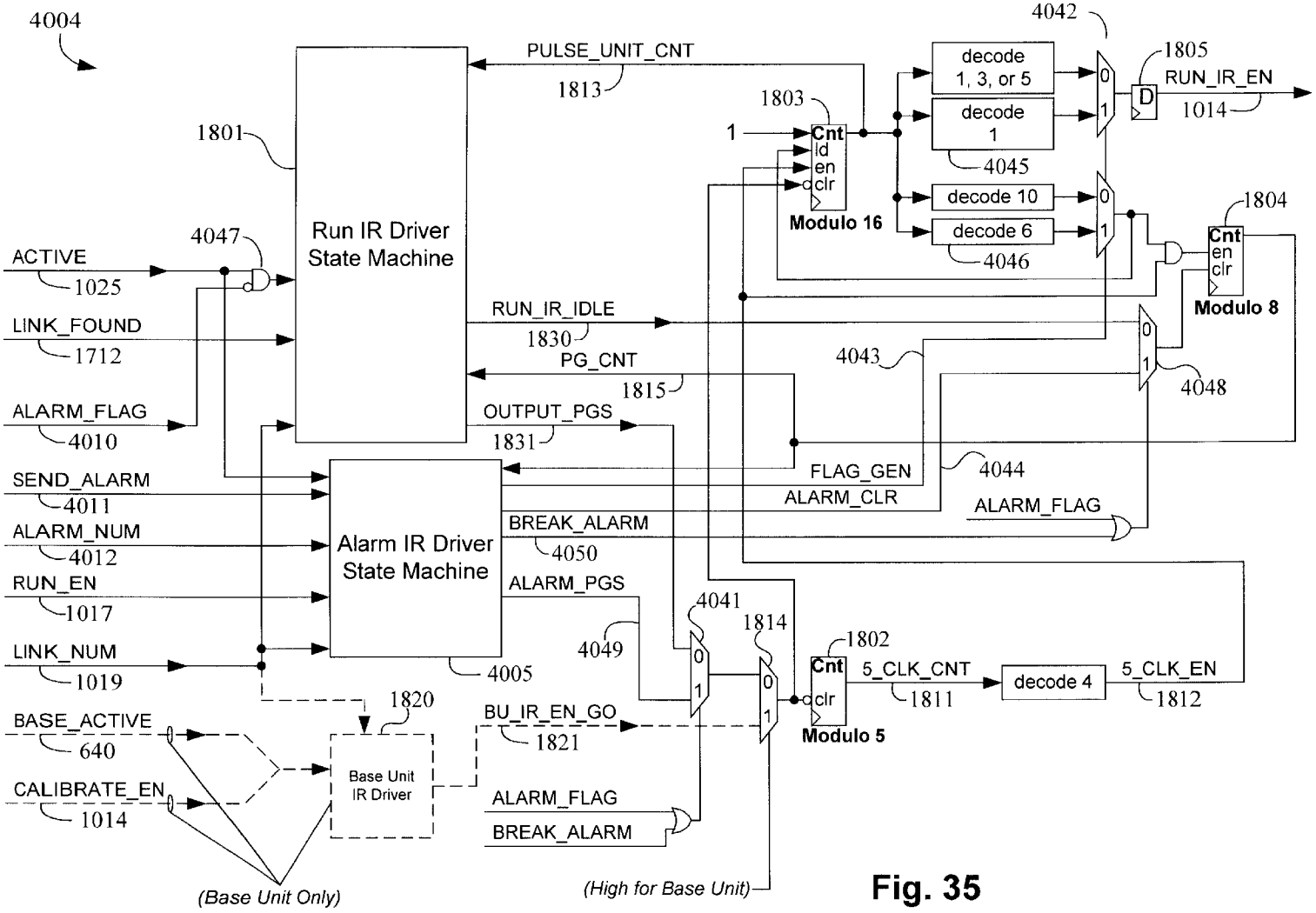
FIG. 35 illustrates the operation of the Run IR Driver block of FIG. 33.

Run IR Driver Block of the Second Preferred Embodiment, FIG. 35

FIG. 35 shows a functional breakdown of Run IR Driver block 4004 of the second preferred embodiment. The reader will note that this block diagram is the same as Run IR Driver block 1702 of the first preferred embodiment previously shown in FIG. 22 with the exception that function block Alarm IR Driver State Machine 4005 and signal multiplexers 4041, 4042, and 4048 have been added. Additionally, ACTIVE signal 1025 is now gated with ALARM_FLAG signal 4010 before being provided to Run IR Driver State Machine function block 1801. Since all the other functions operate the same as the first embodiment which has already been explained, only the new components will be described. When not in an alarm mode function block Run IR Driver 4004 operates the same as was previously described for FIG. 22 of the first embodiment. When in the alarm mode as indicated by either an active ALARM_FLAG signal 4010 or active BREAK_ALARM signal 4050, however, signal multiplexers 4041, 4042, and 4048 select an alarm mode of operation which, as will be explained in the following paragraphs, consists of generating the Alarm Flag and appropriate Link Group for this node's alarm signal. When in an alarm mode all outputs of Run IR Driver State Machine block 1801 are replaced with those of the Alarm IR Driver State Machine block 4005 by the aforementioned multiplexers and, therefore, the reader will understand that Alarm IR Driver State Machine block 4005 replaces the operations performed by Run IR Driver State Machine block 1801.

Alarm IR Driver State Machine block 4005, whose operation is explained later, causes the generation of an alarm signal either when in the Alarm Flag-received mode, as indicated by an active ALARM_FLAG signal 4010 and when SEND_ALARM signal 4011 is made active, indicating that this node has received a complete alarm signal from the previous node in the perimeter, or when ACTIVE signal 1025 goes inactive, indicating that the received infrared link has been broken. The Alarm IR Driver State Machine block 4005 first causes the generation of an Alarm Flag by activating both FLAG_GEN signal 4043 and ALARM_PGS signal 4049. An active ALARM_PGS signal 4049 enables the generation of Pulses in a similar fashion as OUTPUT_PGS signal 1831 does for normal operation, i.e., modulo 5 counter 1802 is allowed to count freely generating an active 5_CLK_EN signal 1812 every five clocks which enables modulo 16 counter 1803 to increment every five clocks as well: FLAG_GEN signal 4043 then selects a decode of one of counter 1803 to generate RUN_IR EN signal 1014, and a decode of six to both clear counter 1803 and enable modulo 8 counter 1804. In this way the reader will understand that RUN_IR_EN signal 1014 will consist of pulses each five clocks long (i.e., when counter 1803's output is decoded as 'one') and repeating every thirty clocks (i.e., five clocks times six counts of counter 1803). The reader will see that this is the form of the Alarm Flag as shown previously in FIG. 29.

When PG_CNT signal 1815 reaches a value of three, indicating that the third Alarm Flag pulse has been sent and, thus, that the Alarm Flag is complete, Alarm IR Driver State Machine block 4005 then de-activates FLAG_GEN signal 4043, leaves ALARM_PGS signal 4049 active, and activates ALARM_CLR signal 4044 for one clock, clearing counter 1804. Since counter 1803's decodes are now the same as during normal operation, pulses are now generated on RUN_IR_EN signal 1014 of a form associated with a normal Link Group as was explained previously when describing FIG. 22. Now, however, the value of the Link Group, i.e., how many three-pulse Pulse Groups are included in the Link Group, is determined by Alarm IR Driver State Machine block 4005, which in turn, as will be explained shortly, equals the value of either LINK_NUM signal 1019 if this is the first node after a link break, or ALARM_NUM signal 4012 if this node has received an alarm signal from a previous node in the perimeter.

Figure 36:
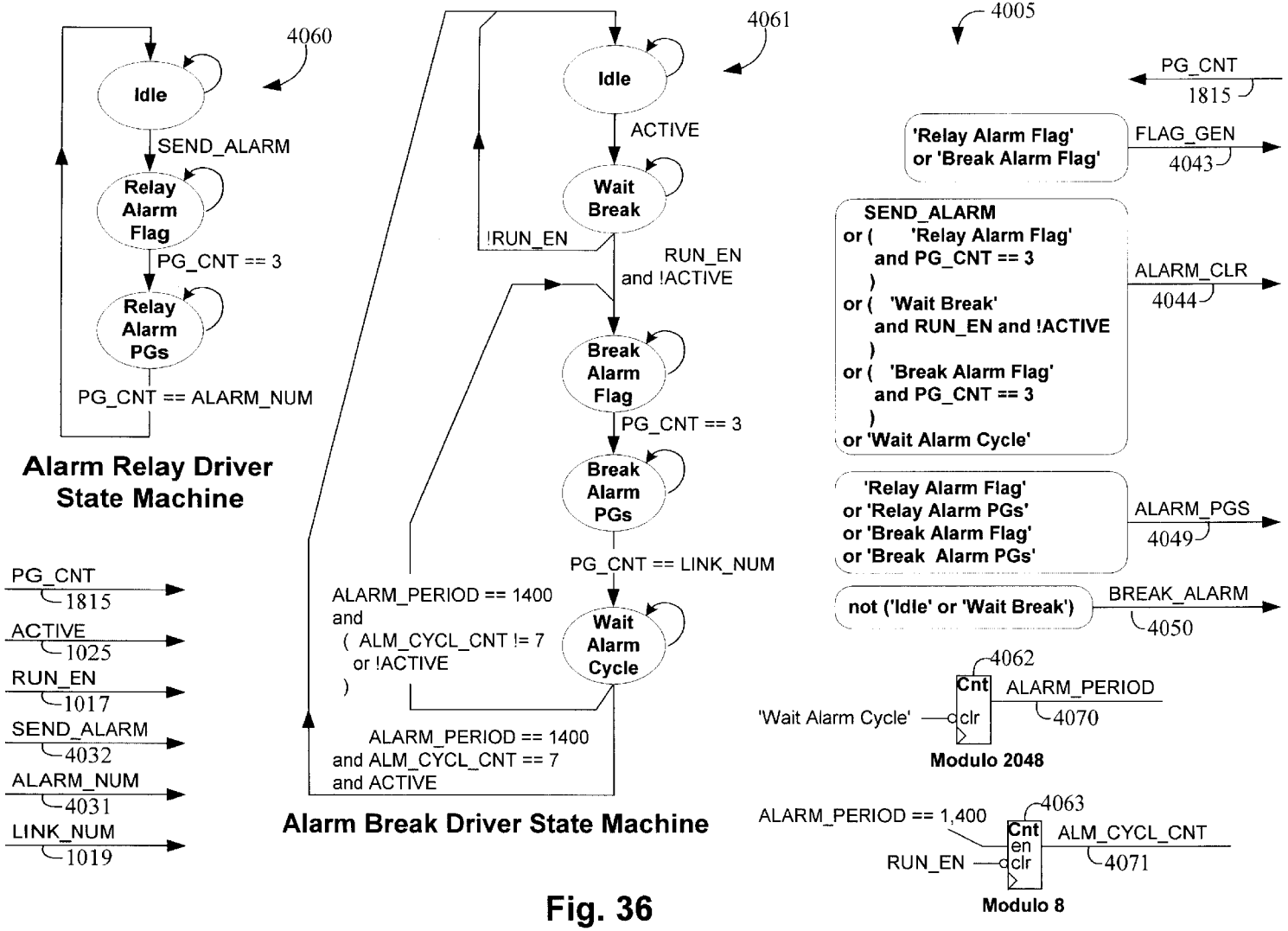
FIG. 36 illustrates the operation of the Run IR Driver State Machine of FIG. 35.

Alarm IR Driver State Machine, FIG. 36

FIG. 36 shows the operation of Alarm IR Driver State Machine block 4005. As was just explained, Alarm IR Driver State Machine block 4005 causes the generation of an alarm signal via circuitry previously shown in FIG. 35 either when SEND_ALARM signal 4011 is made active, indicating that this node has received an alarm signal from the previous node in the perimeter, or when ACTIVE signal 1025 goes inactive, indicating that the received infrared link has been broken. Alarm Relay Driver State Machine 4060 controls the generation of alarm signals in the former case, while Alarm Break Driver state machine 4061 does so in the latter case. Alarm Relay Driver State Machine 4060 will be explained first.

As was previously explained, an active SEND_ALARM signal 4032 indicates that an alarm signal has been received and, therefore, that an equivalent alarm signal should now be generated. An active SEND_ALARM signal 4032 causes Alarm Relay Driver State Machine 4060 to transition from the 'Idle' state where it resides when not generating an alarm signal, to the 'Relay Alarm Flag' state. This state is associated with the generation of the Alarm Flag, and, therefore, as was explained when describing FIG. 35, causes signals FLAG_GEN 4043 and ALARM_PGS 4049 to be active. Once PG_CNT signal 1815 reaches a value of three, indicating that the third and last Alarm Flag pulse has been generated, Alarm Relay Driver State Machine 4060 transitions to the 'Relay Alarm PGs' state. This state is associated with the generation of the alarm Link Group and, as was explained when describing FIG. 35, causes ALARM_PGS signal 4049 to remain active but allows FLAG_GEN signal 4043 to go inactive. Additionally, ALARM_CLR signal 4044 is made active for one clock period when Alarm Relay Driver State Machine 4060 transitions from the 'Relay Alarm Flag' state to the 'Relay Alarm PGs' state (i.e., the simultaneous occurrence of the 'Relay Alarm Flag' state and PG_CNT signal 1815 equal to three). Alarm Link Group generation ends when PG_CNT signal 1815 is equal to ALARM_NUM signal 4031 indicating that a Link Group has been generated that is equal to that received from the previous node in the perimeter, and Alarm Relay Driver State Machine 4060 transitions from the 'Relay Alarm PGs' state back to the 'Idle' state to wait for the receipt of the next alarm signal as indicated by an active SEND_ALARM signal 4032.

As was just explained above, Alarm Break Driver State Machine 4061 causes the generation of an alarm signal when ACTIVE signal 1025 goes inactive, indicating that the received infrared link has been broken. From the 'Idle' state Alarm Break Driver State Machine 4061 transitions to the 'Wait Break' state when ACTIVE signal 1025 goes active indicating that the device has established its place in a secure perimeter, i.e., that the external calibrate/run switch has been placed in the 'run' position and that the device has recognized a valid Link connection from the previous node in the perimeter. From here Alarm Break Driver State Machine 4061 will transition back to the 'Idle' state if RUN_EN signal 1017 goes inactive, indicating that the external calibrate/run switch has been returned to the 'calibrate' position. Otherwise, Alarm Break Driver State Machine 4061 remains in the 'Wait Break' state until ACTIVE signal 1025 goes back inactive indicating that the link with the previous node in the perimeter has been broken, in which case Alarm Break Driver State Machine 4061 transitions to the 'Break Alarm Flag' state. Like the 'Relay Alarm Flag' state of Alarm Relay Driver State Machine 4060, the 'Break Alarm Flag' state is associated with the generation of the Alarm Flag, and, therefore, also causes signals FLAG_GEN 4043 and ALARM_PGS 4049 to be active. When Alarm Break Driver State Machine 4061 transitions from the 'Wait Break' state to the 'Relay Alarm Flag' state, marking the beginning of an Alarm Flag generation, ALARM_CLR signal 4044 is made active for one clock period since counter 1804 shown previously in FIG. 35 may contain a residual value from normal operation. Once PG_CNT signal 1815 reaches a value of three, indicating that the third and last Alarm Flag pulse has been generated, Alarm Break Driver State Machine 4061 transitions to the 'Break Alarm PGs' state. This state is associated with the generation of the alarm Link Group and causes ALARM_PGS signal 4049 to remain active but allows FLAG_GEN signal 4043 to go inactive. Additionally, ALARM_CLR signal 4044 is made active for one clock period when Alarm Break Driver State Machine 4061 transitions from the 'Break Alarm Flag' state to the 'Break Alarm PGs' state (i.e., the simultaneous occurrence of the 'Break Alarm Flag' state and PG_CNT signal equal to three). Alarm Link Group generation ends when PG_CNT signal 1815 is equal to LINK_NUM signal 1019 indicating that a Link Group has been generated that is equal to this node's position in the perimeter, and Alarm Break Driver State Machine 4061 transitions from the 'Break Alarm PGs' state to the 'Wait Alarm Cycle' state.

Since Alarm Break Driver State Machine 4061 is generating alarm signals that are the source of all subsequent alarm signals around the perimeter to the Base Unit, it must generate them at appropriately spaced intervals and, additionally, must include enough repetitions to ensure that the Base Unit receives multiple occurrences in order to guarantee alarm recognition and break location identity. Therefore, when Alarm Break Driver State Machine 4061 transitions to the 'Wait Alarm Cycle' state modulo 2048 counter 4062 is allowed to count and when it's output, ALARM_PERIOD signal 4070, reaches a value of 1,400 modulo 8 counter 4063 is allowed to increment once. Also when counter 4062's ALARM_PERIOD output 4070 reaches a value of 1,400 Alarm Break Driver State Machine 4061 transitions back to the 'Break Alarm Flag' state if ACTIVE signal 1025 is still inactive, or if counter 4063's output, ALM_CYCL_CNT signal 4071, has not yet reached a value of seven, otherwise, i.e., if ACTIVE signal 1025 is again active and ALM_CYCL_CNT signal 4071 has reached a count of seven, then Alarm Break Driver State Machine 4061 transitions back to the 'Idle' state. In this way, Alarm Break Driver State Machine 4061 will cycle through the 'Break Alarm Flag', 'Break Alarm PGS' and 'Wait Alarm Cycle' states seven times, each time generating an alarm signal at a repetition rate of 1,400 clocks. If after seven alarm signals have been generated the link has been restored as indicated by an active ACTIVE signal 1025, Alarm Break Driver State Machine 4061 reverts back to its 'Idle' state and this node resumes generating normal Link Groups to the perimeter. Thus, a break results in a minimum of seven alarm signals propagated around the perimeter at a repetition rate of 1,400 clocks. A repetition rate of 1,400 clocks is long enough to allow a sequential propagation of alarm signals by perimeter nodes no matter where a break occurs in a perimeter, yet is not so long as to cause subsequent nodes, including the Base Unit, to declare a link break due to lack of received previous node Link Groups.

BREAK_ALARM signal 4050 selects alarm operation when in the break alarm mode, as was seen previously when FIG. 35 was explained, and, therefore, is made active any time Alarm Break Driver state machine is not in either the 'Idle' or 'Wait Break' states since this constitutes alarm break operation.

Base Unit operation of the Second Preferred Embodiment

A Base Unit of the second preferred embodiment operates the same as that of the first embodiment with two exceptions: 1) an alarm condition, as indicated by active ALARM signal 630 as was shown in FIG. 31, can be caused by both a loss of received infrared signal, as is the case in the first preferred embodiment, as well as reception of an alarm signal from the previous node in the perimeter, and 2) two new signals, LINK_BRK_INDIC 4013 and LINK_BRK_SYNC 4014 as was shown in FIG. 31, present a binary indication of where in the perimeter a link break has occurred. The additional source for ALARM signal 630, i.e., reception of an alarm signal, will be explained first.

As can be seen in FIG. 32, ALARM signal 630 is gated from RUN_ALARM signal 1026 when the device is operating as a Base Unit. RUN_ALARM signal 1026 is, in turn, generated from Run Control block 4002 which is shown in more detail in FIG. 33. Whereas in the first embodiment RUN_ALARM signal 1026 was generated directly from HOLD signal 1722, for the second embodiment RUN_ALARM signal 1026 is also logically ORed with ALARM_FLAG signal 4010. Thus, since, as was explained earlier, an active ALARM_FLAG signal 4010 is associated with a recognized received Alarm Flag, RUN_ALARM signal 1026, and consequently ALARM signal 630, are now, for the second preferred embodiment, made active both when a received infrared signal is lost and when the last node of the perimeter sends an alarm signal.

The two new signals, LINK_BRK_INDIC 4013 and LINK_BRK_SYNC 4014, will now be explained. FIG. 33 shows that LINK_BRK_INDIC signal 4013 is generated directly from ALARM_NUM signal 4012 which, as has been previously explained, contains a value equal to the perimeter location of the node immediately following a link break, while LINK_BRK_SYNC signal 4014 is generated directly from SEND_ALARM signal 4011 which, as has been previously explained, is made active for one clock each time the Link Group of an alarm signal is received. Thus, when LINK_BRK_SYNC signal 4014 goes active an external device, such as a visual display, could capture LINK_BRK_INDIC signal 4013 and thus acquire information about a link break location. Visual displays, such as hexadecimal LCD displays, are commonly known in the art and are, therefore, not described in detail here.

Alternate Arrangements—Non-enclosed Boundaries

The arrangements described so far use a base unit that includes both the initiation of link infra-red transmissions, i.e., that establishes the beginning of the perimeter links, and the alarm functions, i.e., that establishes the end of the perimeter links. By separating the initiation of link infra-red transmissions to a separate source node, the linked infra-red transmissions can be arranged so as not to completely enclose an area. This could be useful where, for example, an existing obstruction such as a wall or fence obviates the need for intrusion protection for that span, or where a semi-enclosed area is desired to be protected with an un-alarmed entry/exit access point, or where a breach-detected boundary is desired that is not possible to define with a single infra-red beam because of distance or intervening obstacles.

Figure 37:
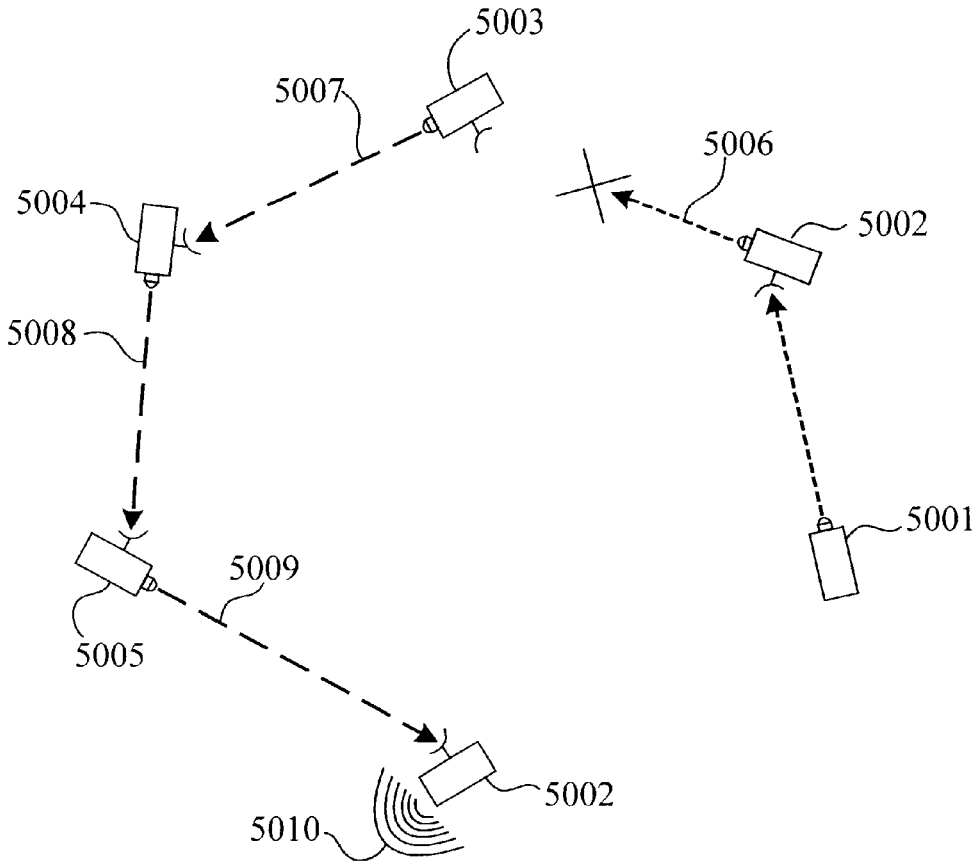
FIG. 37 illustrates an arrangement where the initial infra-red transmission is produced by a source node separate from the alarm-function base unit node creating a protected non-enclosed boundary.

FIG. 37 illustrates an example of a non-enclosed arrangement. Source node 5001 produces the initial infra-red transmission that was included in the base units of previous embodiment descriptions. The reader will understand that source node 5001 could, for example, be another base unit whose alarm functions are disabled. Under normal, non-breached operation source node 5001 transmits to link node 5002, which transmits to link node 5003, which transmits to link node 5004, which transmits to link node 5005, which finally transmits to base unit node 5002. When no breach has occurred, base unit 5002 receives the expected infra-red transmission and no alarm is indicated. FIG. 37 illustrates a breach between link nodes 5002 and 5003 so that infra-red link 5006 is obstructed. Depending on the embodiment operations already described, the nodes subsequent to the breach, i.e., nodes 5003, 5004, and 5005, change their infra-red transmissions 5007, 5008, and 5009 so that base unit node 5002 perceives the breach condition and indicates an alarm, here shown as audible alarm 5010.

Figure 38:
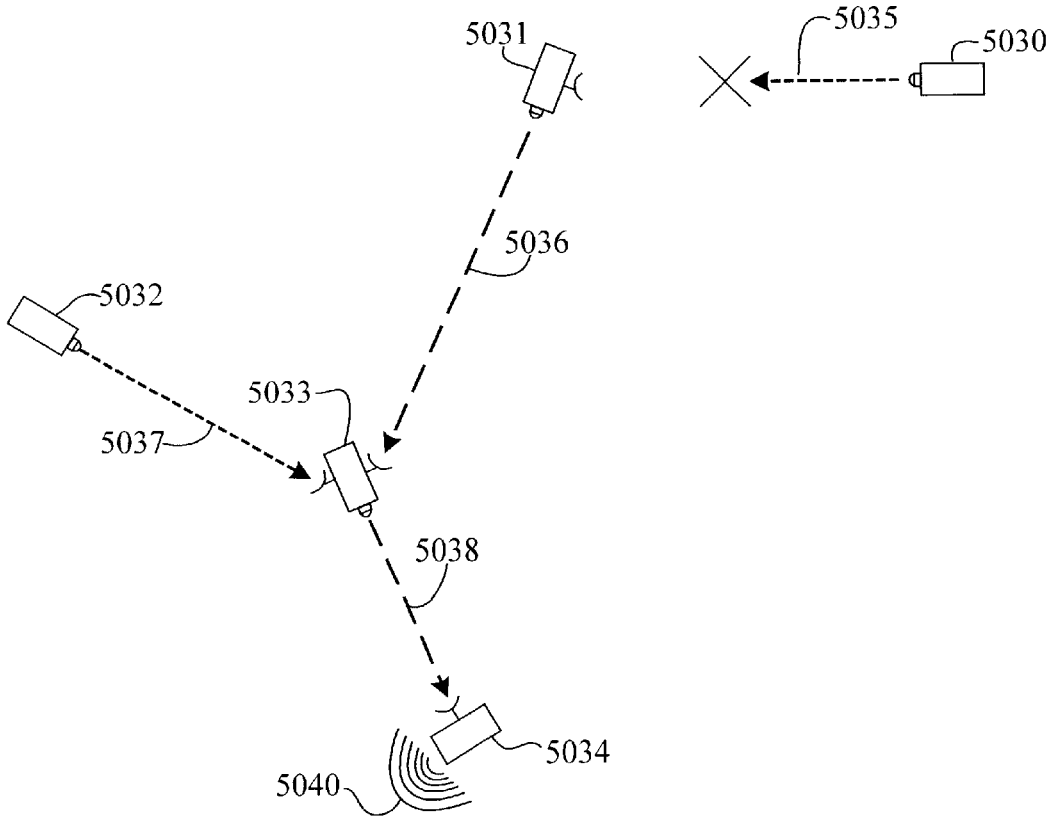
FIG. 38 illustrates yet another arrangement where multiple source nodes and intermediate link nodes with multiple infra-red receivers can create complex tree-structure protected boundaries.

FIG. 38 illustrates how more complex non-enclosed arrangements are possible if more than one source node and link nodes with more than one infra-red receiver are used. When a link node contains more than one infra-red receiver it alters its infra-red transmission to indicate an alarm downstream when an alarm is indicated on any upstream received infra-red link. Under normal, non-breached operation source node 5030 transmits to link node 5031, which transmits to link node 5033. Source node 5032 also transmits to link node 5033 via its second infra-red receiver. As long as link node 5033 receives non-alarmed transmissions from link nodes 5031 and 5032, it transmits a non-alarmed infra-red beam to base unit 5034 which itself remains in a non-alarmed state. FIG. 38 illustrates a breach between source node 5030 and link node 5031. Since infra-red link 5035 is not received by link node 5031 it changes its infra-red link transmission 5036 to indicate an alarm. Even though link node 5033 receives a non-alarmed infra-red link 5037 from source node 5032, it changes its output infra-red link 5038 to indicate an alarm condition in response to the alarm indicated on its received link 5036 from link node 5031. Base unit 5034 upon receiving an alarm indication via infra-red link 5038 indicates an alarm, here shown as audible alarm 5040.

The reader will understand that although FIG. 38 shows just two boundary branches for clarity of illustration, any number of source nodes and subsequent converging branches can be created to produce varying degrees of structure complexity. These types of arrangements could be useful, for example, to detect entry into buildings where the link branches create intrusion boundaries through rooms and inter-connecting hallways.

Alternate Methods of Implementation

Although the preferred embodiments as described use hardware logic to implement various control functions, it will be understood by one skilled in the art that a program-driven micro-processor could be used as an alternate means for some or all of these functions.

Operation

After placing all units, both Link Units and Base Unit, in the 'calibrate' mode via the device switch, the user positions the Base Unit and first perimeter Link Unit, then proceeds to aim the first Link Unit's infrared transmitter towards the Base Unit, observing the yellow and blue LEDs until an optimal alignment is achieved. The user then proceeds around the desired perimeter, placing each newly positioned Link Unit and aligning it with the previous Link Unit until the last Link Unit of the perimeter is placed and the Base Unit's infrared transmitter is aligned with the last perimeter Link Unit. This completes the calibration process.

Next the user places the Base Unit's mode switch to the 'sync' position, then proceeds a second time around the perimeter changing each Link Unit's mode switch from the 'calibrate' position to the 'run' position. At the end of this process all of the Units, both Base and Link, should exhibit illuminated green LEDs indicating that all have acquired synchronization.

Finally, the user then places the Base Unit's mode switch to the 'run' position. This causes the Base Unit to generate a Link Cycle whose length is minimized for the number of Link Units, and thus optimized for detecting link breaks.

Should the perimeter be breached, the Base Unit's alarm output (via ALARM signal 630) activates some external alarm indication, such as an audible alarm. Additionally, for the second preferred embodiment, the base unit's breach location output (via signals link_brk_indic 4013 and link_brk_sync 4014) provides an indication as to the location of the broken link in the perimeter via an external device, such as a visual display.

I claim:

1. A perimeter alarm system using infrared energy for both the detection of a breach and communication of said breach, said perimeter alarm system comprising transceiver nodes that each receive infrared signals from one direction and transmit infrared signals in another direction, wherein;

(a) said transceiver nodes are arranged to form a secure perimeter such that:

(1) each of said transceiver nodes transmits a link infrared signal which includes information about the perimeter location of transmitting said transceiver node to the next one of said transceiver nodes in said perimeter; and (2) each of said transceiver nodes receives said link infrared signal from the previous one of said transceiver nodes in said perimeter;

(b) one of said transceiver nodes operates as a base node to continuously transmit said link infrared signal;

(c) each other of said transceiver nodes operates as a perimeter node, wherein each said perimeter node transmits said link infrared signal when receiving said link infrared signal, and ceases to transmit said link infrared signal when received said link infrared signal ceases;

(d) said base node presents an alarm indication when ceasing to receive said link infrared signal;

whereby an obstruction of said link infrared signals between said transceiver nodes is communicated to said base node since each of said perimeter nodes subsequent to the obstruction will be caused to cease transmission of said link infrared signals.

2. A perimeter alarm system according to claim 1, wherein:

each said transceiver node is responsive to said link infrared signal of the previous perimeter said transceiver node, and is not responsive to said link infrared signals of any other said transceiver nodes.

3. A perimeter alarm system according to claim 1, wherein:

each said transceiver node uses the previous said transceiver node's said link infrared signal to automatically determine its location in said perimeter.

4. A perimeter alarm system using infrared energy for both the detection of a breach and communication of said breach, said perimeter alarm system comprising transceiver nodes that each receive infrared signals from one direction and transmit infrared signals in another direction, wherein;

(a) said transceiver nodes are arranged to form a secure perimeter such that:

(1) each of said transceiver nodes transmits a link infrared signal which includes information about the perimeter location of said transceiver node;

(2) each of said transceiver nodes transmits said link infrared signal to the next one of said transceiver nodes in said perimeter; and (3) each of said transceiver nodes receives said link infrared signal from the previous one of said transceiver nodes in said perimeter;

(b) one of said transceiver nodes operates as a base node to continuously transmit said link infrared signal;

(c) each other of said transceiver nodes operates as a perimeter node, wherein;

(1) when reception of said link infrared signal ceases, said perimeter node transmits an altered infrared signal which includes information about the location of said disruption in the perimeter; and (2) upon receiving said altered infrared signal, said perimeter node transmits a said altered infrared signal; and (d) said base node presents an alarm indication when receiving said altered infrared signal, or when reception of said link infrared signal ceases;

whereby an indication of an obstruction of said link infrared signal between said transceiver nodes is communicated to said base node since each of said perimeter transceiver nodes subsequent to the obstruction will be caused to transmit a said altered infrared alarm signal.

5. A perimeter alarm system according to claim 4, wherein:

each said transceiver node is responsive to the link infrared signal of the previous perimeter transceiver node, and is not responsive to said link infrared signals of any other transceiver nodes.

6. A perimeter alarm system according to claim 4, wherein:

each said perimeter node uses the previous said perimeter node's said link infrared signal to automatically determine its location in said perimeter.

7. A boundary alarm system using infrared energy for both the detection of a breach and communication of said breach, said boundary alarm system comprising a plurality of source nodes that each initiate infra-red link transmissions, one or more transceiver nodes that each receive infrared signals from one or more directions and transmit infrared signals in a different direction, and an alarm node wherein;

(a) each of said source nodes and said transceiver nodes transmits a link infrared signal to a said transceiver node or said alarm node;

(b) said link infrared signal includes information about the boundary location of transmitting said source node or transmitting said transceiver node;

(c) each of said transceiver nodes:

(1) receives one or more said link infrared signal from each of one or more said source nodes, one or more said transceiver nodes, or a combination of both, and, (2) transmits a link infrared signal to either another of said transceiver nodes or to said alarm node, and;

(3) when reception of any said link infrared signal ceases, said transceiver node transmits an altered infra-red_signal, and;

(4) when receiving said altered infra-red signal, said transceiver node transmits an altered infra-red signal;

(d) said alarm mode presents an alarm indication when receiving said altered infra-red signal or when reception of said link infrared signal ceases;

whereby an indication of an obstruction of said link infrared signal is communicated to said alarm node since each said transceiver node between said obstruction and said alarm node transmits said altered infra-red signal.

8. A boundary alarm system according to claim 7, wherein:

said alarm node and each said transceiver node is responsive to the link infrared signals of configured said sources or said transceiver nodes, and is not responsive to link infrared signals of any other nodes.

* * * * *